US005840472A

United States Patent [19]

Sasaki et al.

[11] Patent Number: 5,840,472

[45] **Date of Patent: *Nov. 24, 1998**

[54] DEVELOPER FOR SILVER HALIDE PHOTOGRAPHIC PHOTOSENSITIVE MATERIAL

[75] Inventors: Hirotomo Sasaki; Harumi Watanabe; Kohzaburoh Yamada, all of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 797,633

[22] Filed: Feb. 7, 1997

[30] Foreign Application Priority Data

| | | | |
|---|---|---|---|
| Feb. 7, 1996 | [JP] | Japan | 8-044023 |
| Feb. 7, 1996 | [JP] | Japan | 8-044040 |
| Feb. 7, 1996 | [JP] | Japan | 8-044060 |
| Sep. 26, 1996 | [JP] | Japan | 8-254572 |

[51] Int. Cl.[6] ..... G03C 5/30

[52] U.S. Cl. ..... 430/488; 430/438; 430/440; 430/445; 430/446; 430/480; 430/481; 430/482; 430/483

[58] Field of Search ..... 430/488, 438, 430/440, 445, 446, 480, 481, 482, 483; 544/299, 301, 302, 319, 320, 321

[56] References Cited

U.S. PATENT DOCUMENTS

| | | | |
|---|---|---|---|
| 3,432,298 | 3/1969 | Rintelen | 430/488 |
| 4,169,733 | 10/1979 | Iytaka et al. | 430/425 |
| 4,748,105 | 5/1988 | Kadota et al. | 430/393 |
| 5,300,410 | 4/1994 | Date et al. | 430/488 |
| 5,356,761 | 10/1994 | Morimoto et al. | 430/488 |

FOREIGN PATENT DOCUMENTS

| | | | |
|---|---|---|---|
| A10032456 | 7/1981 | European Pat. Off. . | |
| A10556845 | 8/1993 | European Pat. Off. . | |
| 59-204037 | 11/1984 | Japan . | |
| 353244 | 3/1991 | Japan . | |
| 4011249 | 1/1992 | Japan | 430/488 |
| 6230525 | 8/1994 | Japan . | |

*Primary Examiner*—Hoa Van Le
*Attorney, Agent, or Firm*—Sughrue, Mion, Zinn, Macpeak & Seas, PLLC

[57] ABSTRACT

A developer for a silver halide photographic photosensitive material containing at least one of monocyclic dimercaptotriazine compounds, bis-type dimercaptotriazine compounds, mercapto-1,2,4-triazine compounds and dimercaptopyrimidine compounds, and a process for developing a silver halide photographic photosensitive material using the developer. The compounds of the present invention provides excellent effect in preventing silver stains without affecting the photographic properties of the photographic material.

8 Claims, No Drawings

DEVELOPER FOR SILVER HALIDE PHOTOGRAPHIC PHOTOSENSITIVE MATERIAL

FIELD OF THE INVENTION

The present invention relates to a development processing method for use in the processing of a silver halide photographic photosensitive material (hereinafter sometimes referred to as "photosensitive material"). More specifically, the present invention relates to a method of, in the development processing of a black-and-white photographic photosensitive material for general use, a black-and-white photographic photosensitive material for printing or an X-ray photographic photosensitive material for medical or industrial use, reducing silver stains (also called silver sludge) adhering to or precipitating in the development tank, development rack or rollers in an automatic developing machine to thereby facilitates daily maintenance of instruments and machines.

BACKGROUND OF THE INVENTION

Generally speaking, in the development processing of a silver halide photosensitive material, use of an automatic developing machine (hereinafter referred to as "automatic processor") increases in view of rapidity, simpleness and handleability. When the processing is performed using an automatic processor, development-fixing-water washing-drying steps are usually provided. In recent years, a demand for expediting the development processing is more and more increasing. To intensify activity of the developer is one means for achieving rapid processing. In the rapid processing of a black-and-white photosensitive material, the activity may be intensified by increasing concentration of the developing agent or elevating pH of the developer, however, the developer conspicuously deteriorates due to air oxidation and it is difficult to maintain the activity. Further, approach from the photosensitive material to the rapid processing is aggressively investigated. Reduction in the layer thickness (for example, protective layer) of the photosensitive material is effective in achieving rapid processing.

It is known from of old to use a sulfite for preventing deterioration of the developer, however, since a compound having an action of dissolving silver halide, such as sulfite, is added to the developer, silver is dissolved out from the photosensitive material into the developer as a sulfite silver complex. The silver complex is reduced in the developer and the silver gradually adheres to and accumulates in the development tank or the development roller. This is called silver stain or silver sludge. The silver stain or silver sludge adheres to the photosensitive material to be processed to soil the image and therefore, the instruments must be periodically washed and maintained. If the addition amount of the sulfite is increased, the amount of the sulfite complex dissolved out increases and as a result, the degree of silver stain becomes higher and advantages in the rapid processing cannot be used successfully.

On the other hand, as a method for reducing the silver stain, a method of adding a compound capable of decreasing silver ions to dissolve out into the developer and/or restraining reduction of silver ions to silver as described in JP-A-56-24347 (the term "JP-A" as used herein means an "unexamined published Japanese patent application") is known. However, according to this method, the development itself is inevitably restrained, and the method is disadvantageous in that lowering of sensitivity is involved. For the photosensitive material/development processing system intended to achieve sensitivity as high as possible, the above-described lowering of sensitivity is a serious problem. Further, to reduce the layer thickness (for example, protective layer) of the photosensitive material is very effective in performing rapid processing, however, if such a photosensitive material is subjected to running processing in an automatic processor, silver ions dissolved out into the developer increase and the silver stain is worsened.

The compound which reduces silver stains include various compounds hitherto disclosed. Mercaptotriazines are one example thereof.

JP-A-49-5334 has succeeded in removing tailing of a high-contrast photographic photosensitive material by adding a heterocyclic mercapto compound to a lith-type developer and discloses 2,4,6-trimercapto-1,3,5-triazine as a specific example. JP-A-59-204037 uses a heterocyclic mercapto compound in combination so as to prevent silver sludge (silver stain) of a black-and-white developer having a pH of 11.5 or more and discloses 2,4-dimercapto-6-hydroxy-1,3,5-triazine as a specific example. JP-A-3-53244 uses mercapto-1,3,5-triazine so as to prevent silver sludge of a developer. Further, JP-A-3-282457, JP-A-4-11249, JP-A-4-31852, JP-A-4-299337, JP-A-4-299338, JP-A-4-322248, JP-A-4-175178, JP-A-5-61159 and JP-A-5-303179 disclose that mercapto-1,3,5-triazine is effective.

However, these compounds adversely affect the photographic properties to a large extent, such as reduction in the sensitivity.

JP-A-6-230525 also discloses a mercaptotriazine compound and states that when processing is performed with a developer containing no alkanolamine, an effect of preventing black peppers is obtained without causing softening. However, it has no disclosure of the excellent effect obtained by the mercaptotriazine compound having a specific functional group as in the present invention, and this effect cannot be expected.

Mercapto 1,2,4-triazines are one example of the compounds which reduces silver stains.

JP-A-5-303179, JP-A-5-61159 and JP-A-6-324435 disclose that a mercapto 1,2,4-triazine compound having a hydroxy group is useful in preventing silver stains. The present inventors actually evaluated this compound and verified that the compound has a silver stain prevention effect, however, the effect is yet insufficient and a further improvement is demanded.

Furthermore, mercaptopyrimidines are one example of the compounds which reduces silver stains.

JP-A-59-204037 describes use of a heterocyclic mercapto compound in combination in a black-and-white developer having a pH of 11.5 or more for the purpose of inhibiting silver sludge and discloses 2-mercapto-4-hydroxypyrimidine as a specific example thereof. JP-A-4-362942 discloses an improved hydroxypyrimidine compound. However, these patent publications have no specific disclosure of the dimercaptopyrimidine compound as in the present invention. Further, on evaluating the above-described compounds, a prevention effect of silver sludge is verified, however, it is not necessarily satisfactory and in need of more improvement.

JP-A-49-11333 discloses that a dimercaptopyrimidine compound provides an effect to improve color tone of a silver image in a silver salt diffusion transfer viscous developer. JP-B-46-11630 (the term "JP-B" as used herein means an "examined Japanese patent publication") uses a 2,4-dimercaptopyrimidine compound as an inhibitor of sludge in an alkaline processing solution in an activator system diffusion transfer method. However, on evaluating these compounds, they showed not necessarily satisfactory prevention effect against silver sludge.

JP-A-53-141623 discloses that after development processing, a dimer of a nitrogen-containing heterocyclic compound having a mercapto group provides a bleaching acceleration effect. However, this patent publication does not refer at all to the effect of the dimercaptopyrimidine compound in the developer as in the present invention.

SUMMARY OF THE INVENTION

Accordingly, a first object of the present invention is, in the processing of a silver halide photosensitive material capable of rapid processing, to reduce silver stains generated in the development tank and/or the development rack and roller. A second object of the present invention is to facilitate maintenance of the automatic processor and the development instrument. A third object of the present invention is to reduce silver stains completely without affecting the photographic properties. A fourth object of the present invention to reduce silver stains without impairing stability of the developer.

The above-described objects of the present invention can be attained by the following developers for silver halide photographic photosensitive material.

(1) A developer for a silver halide photographic photosensitive material comprising at least one compound represented by the following formula (1-I) or (1-II):

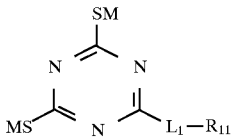

(1-I)

wherein $L_1$ represents a divalent group, $R_{11}$ represents an amino group, an ammonio group, an alkoxy group, and M represents a hydrogen atom or a cation;

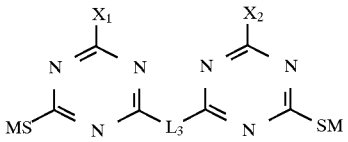

(1-II)

wherein $L_3$ represents a linking group, M represents a hydrogen atom or a cation, and $X_1$ and $X_2$ each represents a group capable of substituting to the triazine ring.

(2) A developer for a silver halide photographic photosensitive material comprising at least one compound represented by the following formula (2-I):

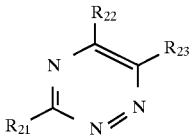

(2-I)

wherein $R_{21}$, $R_{22}$ and $R_{23}$ each represents a hydrogen atom, an aliphatic hydrocarbon group, an aromatic hydrocarbon group, a heterocyclic group, a halogen atom, a cyano group, a nitro group, a carboxy group, a sulfo group, a sulfino group, a phosphono group, an amino group, an ammonio group, a phosphonio group, a mercapto group, an oxy group, a thio group, an acyl group, a carbamoyl group, an acylamino group, a sulfamoyl group, a sulfonamido group, a sulfonyl group, a sulfinyl group, an oxycarbonyl group, a urethane group or a ureido group, provided that at least one of $R_{21}$, $R_{22}$ and $R_{23}$ represents a mercapto group.

(3) A developer for a silver halide photographic photosensitive material comprising at least one compound represented by the following formula (3-I) and/or (3-II):

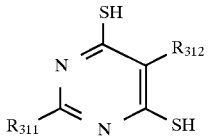

(3-I)

wherein $R_{311}$ and $R_{312}$ each represents a mercapto group or a group capable of substituting to the pyrimidine ring;

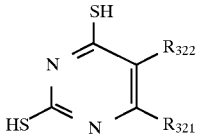

(3-II)

wherein $R_{321}$ represents an aromatic hydrocarbon group, a heterocyclic group, a halogen atom, a cyano group, a nitro group, a sulfo group, a sulfino group, a carboxy group, a phosphono group, an amino group, an ammonio group, a phosphonio group, a mercapto group, an oxy group, a thio group, an acyl group, a carbamoyl group, an acylamino group, a sulfamoyl group, a sulfonamido group, a sulfonyl group, a sulfinyl group, an oxycarbonyl group, a urethane group or a ureido group, and $R_{322}$ represents a mercapto group or a group capable of substituting to the pyrimidine ring.

(4) A developer for a silver halide photographic photosensitive material comprising at least one compound represented by the following formula (4):

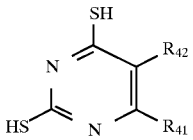

(4)

wherein $R_{41}$ represents a hydrogen atom or an aliphatic group, $R_{42}$ represents a hydrogen atom or a substituent, with the proviso that when $R_{42}$ represents a hydrogen atom, $R_{41}$ represents an aliphatic group substituted with at least one water-soluble group.

Formula (1-I) is described in detail below.

Examples of the amino group represented by $R_{11}$ in formula (1-I) include an unsubstituted amino group, a methylamino group, an ethylamino group, a dimethylamino group, a diethylamino group, an anilino group, an o-toluidino group and a 2,4-xylidino group.

Examples of the ammonio group represented by $R_{11}$ in formula (1-I) include a trimethylammonio group, a triethylammonio group, a diethylmethylammonio group and a tri-n-butylammonio group, and the counter anion for neutralizing the positive electric charge of the ammonio group is an inorganic anion (e.g., halogen ion (e.g., chloride ion, bromide ion)) or an organic anion (e.g., acetate ion, $CH_3OSO_3^-$ ion).

Examples of the alkoxy group represented by $R_{11}$ in formula (1-I) include a methoxy group, an ethoxy group, an isopropyl group, an n-butoxy group, a cyclohexyloxy group and a metoxyethoxy group.

Examples of the cation represented by M in formula (1-I) include alkali metal ions such as lithium ion, sodium ion, potassium ion and cesium ion, and ammonio ions such as ammonio ion and tetramethylammonio ion.

Examples of the divalent group represented by $L_1$ in formula (1-I) include an alkylene group having from 1 to 10 carbon atoms (preferably from 1 to 6 carbon atoms) (e.g., methylene, ethylene, propylene), —$N(R_{110})L_2$— (wherein $R_{110}$ represents a hydrogen atom or an aliphatic hydrocarbon group having from 1 to 6 carbon atoms), —O—$L_2$—, —S—$L_2$—, —C(O)—$L_2$—, —$SO_2$—$L_2$—, —C(O)O—$L_2$—, a methylenedioxy group, a ureylene group and a composite group thereof.

$L_2$ is a divalent and examples thereof include an alkylene group having from 1 to 10 carbon atoms (preferably from 1 to 6 carbon atoms) (e.g., methylene, ethylene, propylene).

The groups represented by $R_{11}$ and $L_1$ in formula (1-I) each may be substituted. Examples of the substituent include the followings:

a halogen atom (e.g., fluorine, chlorine, bromine), an alkyl group (e.g., methyl, ethyl, n-propyl, isopropyl, t-butyl, n-octyl, cyclopentyl, cyclohexyl), an alkenyl group (e.g., allyl, 2-butenyl, 3-pentenyl), an alkynyl group (e.g., propargyl, 3-pentenyl), an aralkyl group (e.g., benzyl, phenethyl), an aryl group (e.g., phenyl, naphthyl, 4-methylphenyl), a heterocyclic group (e.g., pyridyl, furyl, imidazolyl, piperidyl, morpholino), an alkoxy group (e.g., methoxy, ethoxy, butoxy), an aryloxy group (e.g., phenoxy, 2-naphthyloxy), an amino group (e.g., unsubstituted amino, dimethylamino, ethylamino, anilino), a ureido group (e.g., unsubstituted ureido, N-methylureido, N-phenylureido), a urethane group (e.g., methoxycarbonylamino, phenoxycarbonylamino), a sulfonyl group (e.g., mesyl, tosyl), a sulfinyl group (e.g., methylsulfinyl, phenylsulfinyl), an alkyloxycarbonyl group (e.g., methoxycarbonyl, ethoxycarbonyl), an aryloxycarbonyl group (e.g., phenoxycarbonyl), an acyl group (e.g., acetyl, benzoyl, formyl, pivaloyl), an acyloxy group (e.g., acetoxy, benzoyloxy), a phosphoramide group (e.g., N,N-diethylphosphoramide), an alkylthio group (e.g., methylthio, ethylthio), an arylthio group (e.g., phenylthio), a cyano group, a mercapto group, a phosphono group, a nitro group, a sulfino group, an ammonio group (e.g., trimethylammonio), a phosphonio group and a silyl group (e.g., trimethylsilyl, triethylsilyl, t-butyldimethylsilyl, t-butyldiphenylsilyl). These groups each may be further substituted. When two or more substituents are present, they may be the same or different.

Formula (1-II) is described in detail below.

Examples of the linking group represented by $L_3$ in formula (1-II) include an alkylene group (e.g., methylene, ethylene, propylene), an arylene group (e.g., o-phenylene, p-phenylene), a mere bond, —$N(R_{111})$— (wherein $R_{111}$ represents a hydrogen atom, an aliphatic hydrocarbon group, an aromatic hydrocarbon group or a heterocyclic group), —O—, —S—, —SS—, —C(O)—, —SO—, —$SO_2$—, —OC(O)O—, —SC(O)S—, a methylenedioxy group, a ureylene group and a composite group thereof.

Examples of the group capable of substituting to the triazine ring represented by $X_1$ or $X_2$ in formula (1-II) include substituents of $R_{11}$ and $L_1$ in formula (I) and additionally, an acylamino group (e.g., acetylamino, benzoylamino), a sulfonylamino group (e.g., methylsulfonylamino, phenylsulfonylamino), a sulfamoyl group (e.g., unsubstituted sulfamoyl, N,N-dimethylsulfamoyl, N-phenylsulfamoyl group), a carbamoyl group (e.g., unsubstituted carbamoyl, N,N-diethylcarbamoyl, N-phenylcarbamoyl), a sulfo group, a carboxy group and a hydroxy group.

The cation represented by M in formula (1-II) has the same meaning as the cation represented by M in formula (1-I).

In a preferred embodiment of formula (1-I), the divalent group represented by $L_1$ is an alkylene group, —$N(R_{110})$—$L_2$—, —O—$L_2$— or —C(O)—$L_2$—, $R_{11}$ is an amino group or an ammonio group and M is a hydrogen atom or a cation.

In a more preferred embodiment of formula (1-I), the divalent group represented by $L_1$ is an alkylene group or —$N(R_{110})$—$L_2$—, $R_{11}$ is an amino group or an ammonio group and M is a hydrogen atom or a cation.

In a most preferred embodiment of formula (1-I), the divalent group represented by $L_1$ is an alkylene group or —$N(R_{110})$—$L_2$—, $R_{11}$ is an amino group and M is a hydrogen atom or a cation.

In a preferred embodiment of formula (1-II), $L_3$ is an alkylene group, —$N(R_{111})$—, —O— or —S—, and M is a hydrogen atom or a cation.

In a more preferred embodiment of formula (1-II), $L_3$ is —$N(R_{111})$— (wherein $R_{111}$ represents a hydrogen atom or an aliphatic hydrocarbon group) or —O—, and M is a hydrogen atom or a cation.

Specific examples of the compounds represented by formula (1-I) or (1-II) are set forth below, however, the compounds of the present invention are by no means limited thereto.

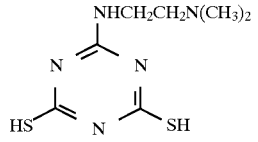

1-I-1

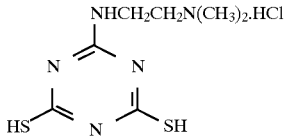

1-I-2

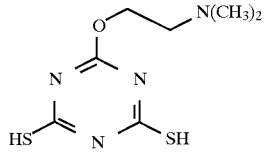

1-I-3

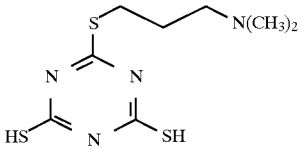

1-I-4

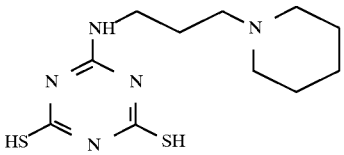

1-I-5

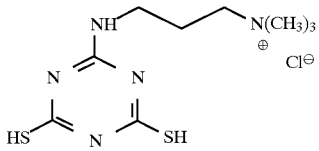

1-I-6

-continued

1-I-7

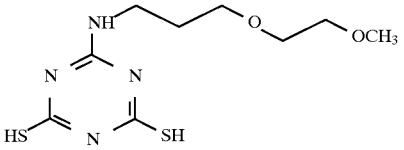

1-I-8

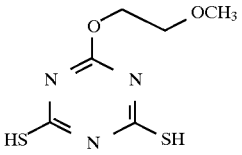

1-I-9

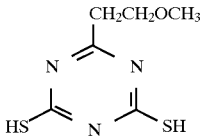

1-I-10

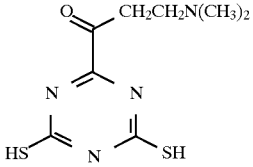

1-II-1

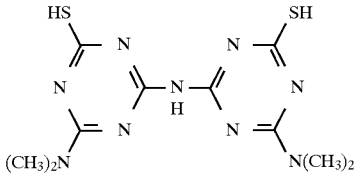

1-II-2

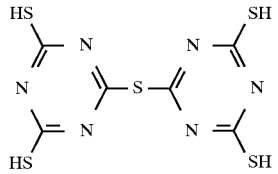

1-II-3

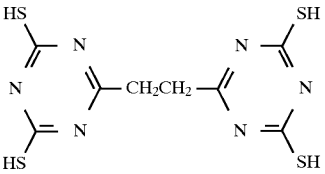

1-II-4

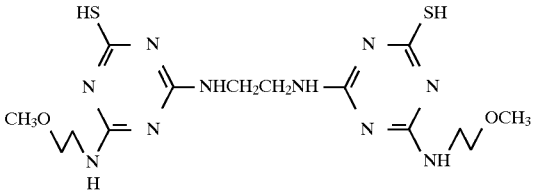

1-II-5

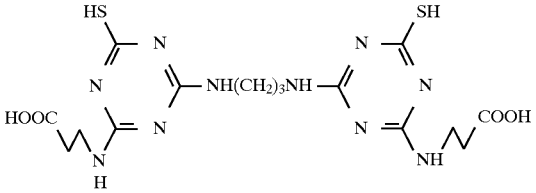

-continued

1-II-6

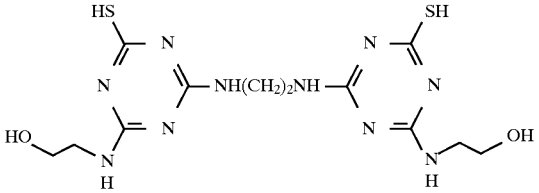

1-II-7

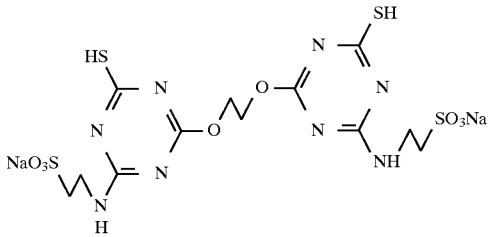

1-II-8

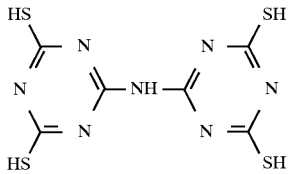

The compounds represented by formulae (1-I) and (1-II) can be synthesized according to the method described in E. M. Smolin and L. Lapoport, *s-Triazine and Derivatives* (*The Chemistry of Heterocyclic Compounds Series*), Interscience Publishers.

Formula (2-I) is described in detail below.

The aliphatic hydrocarbon group represented by $R_{21}$, $R_{22}$ or $R_{23}$ in formula (I) is preferably an aliphatic hydrocarbon group having from 1 to 15 carbon atoms, more preferably a linear, branched or cyclic alkyl, alkenyl, alkynyl or aralkyl group having from 1 to 8 carbon atoms. Out of these groups, branched groups each may be cyclized to form a saturated heterocyclic ring containing one or more hetero atoms. Examples of the alkyl group include a methyl group, an ethyl group, an isopropyl group, a t-butyl group, an n-octyl group, a cyclopropyl group, a cyclopentyl group and a cyclohexyl group. Examples of the alkenyl group include an allyl group, a 2-butenyl group and a 3-pentenyl group. Examples of the alkynyl group include a propargyl group and a 3-pentenyl group. Examples of the aralkyl group include a benzyl group.

The aromatic hydrocarbon group represented by $R_{21}$, $R_{22}$ or $R_{23}$ in formula (2-I) is preferably an aromatic hydrocarbon group having from 5 to 15 carbon atoms, more preferably a monocyclic or condensed ring aryl group having from 6 to 10 carbon atoms, and examples thereof include a phenyl group and a naphthyl group.

The heterocyclic group represented by $R_{21}$, $R_{22}$ or $R_{23}$ in formula (2-I) is a 3-, 4-, 5-, 6-, 7-, 8-, 9- or 10-membered saturated or unsaturated heterocyclic group containing at least one of a nitrogen atom, an oxygen atom and a sulfur atom. The heterocyclic group may be monocyclic or may form a condensed ring with other aromatic ring. The heterocyclic group is preferably a 5- or 6-membered aromatic heterocyclic group and examples thereof include a pyridyl group, an imidazolyl group, a quinolyl group, a benzimidazolyl group, a pyrimidyl group, a pyrazolyl group, an isoquinolinyl group, a thiazolyl group, a thienyl group, a furyl group and a benzothiazolyl group.

Examples of the halogen atom represented by $R_{21}$, $R_{22}$ or $R_{23}$ in formula (2-I) include a fluorine atom, a chlorine atom, a bromine atom and an iodine atom.

Examples of the amino group represented by $R_{21}$, $R_{22}$ or $R_{23}$ in formula (2-I) include an unsubstituted amino group, a methylamino group, an ethylamino group, a dimethylamino group, a diethylamino group, an anilino group, an o-toluidino group and a 2,4-xylidino group. Examples of the ammonio group include a trimethylammonio group, a triethylammonio group and an unsubstituted ammonio group. Examples of the phosphonio group include a trimethylphosphonio group and a triethylphosphonio group.

Examples of the oxy group represented by $R_{21}$, $R_{22}$ or $R_{23}$ in formula (2-I) include an alkoxy group (e.g., methoxy, ethoxy, isopropoxy, n-butoxy, cyclohexyloxy), an aryloxy group (e.g., phenoxy, p-methylphenoxy), an oxy group resulting from bonding of an oxygen atom to a heterocyclic ring (e.g., 2-pyridyloxy, 2-imidazolyloxy), an allyloxy group and a benzyloxy group.

Examples of the thio group represented by $R_{21}$, $R_{22}$ or $R_{23}$ in formula (2-I) include an alkylthio group (e.g., methylthio, ethylthio, isopropylthio, n-butylthio, cyclohexylthio), an arylthio group (e.g., phenylthio, p-methylphenylthio), a thio group resulting from bonding of a sulfur atom to a heterocyclic ring (e.g., 2-pyridylthio, 2-imidazolylthio), an allylthio group and a benzylthio group.

Examples of the acyl group represented by $R_{21}$, $R_{23}$ or $R_{23}$ in formula (2-I) include a formyl group, an acetyl group, a propionyl group, an isobutyryl group, a valeryl group, a pivaloyl group, an octanoyl group, an acryloyl group, a pyruvoyl group, a benzoyl group, a 1-naphthoyl group, an m-toluoyl group and a cynnamoyl group. Examples of the carbamoyl group include an unsubstituted carbamoyl group, an N-methylcarbamoyl group, an N-ethylcarbamoyl group, an N,N-dimethylcarbamoyl group, an N,N-diethylcarbamoyl group and an N-phenylcarbamoyl group. Examples of the acylamino group include an acetylamino group, a benzamido group, a propionylamino group and a pivaloylamino group. Examples of the sulfamoyl group include an unsubstituted sulfamoyl group, a methylsulfamoyl group, an ethylsulfamoyl group, a dimethylsulfamoyl group, a diethylsulfamoyl group and a phenylsulfamoyl group. Examples of the sulfonamido group include a benzenesulfonamido group and a methylsulfonylamino group. Examples of the sulfonyl group include a mesyl group, a tosyl group and a tauryl group. Examples of the sulfinyl group include a methylsulfinyl group and a phenylsulfinyl group.

Examples of the oxycarbonyl group represented by $R_{21}$, $R_{22}$ or $R_{23}$ in formula (2-I) include an alkoxycarbonyl group (e.g., methoxycarbonyl, ethoxycarbonyl, isopropoxycarbonyl) and an aryloxycarbonyl group (e.g., phenoxycarbonyl, naphthyloxycarbonyl).

Examples of the ureido group represented by $R_{21}$, $R_{22}$ or $R_{23}$ in formula (2-I) include an N'-methylureido group, an N',N'-dimethylureido group, an N,N',N'-trimethylureido group, an N'-ethylureido group and an N'-phenylureido group. Examples of the urethane group include a methoxycarbonylamino group and a phenoxycarbonylamino group.

The groups represented by $R_{21}$, $R_{22}$ or $R_{23}$ in formula (2-I) each may be substituted. Examples of the substituent include the following:

a halogen atom (e.g., fluorine, chlorine, bromine), an alkyl group (e.g., methyl, ethyl, n-propyl, isopropyl, t-butyl, n-octyl, cyclopentyl, cyclohexyl), an alkenyl group (e.g., allyl, 2-butenyl, 3-pentenyl), an alkynyl group (e.g., propargyl, 3-pentenyl), an aralkyl group (e.g., benzyl, phenethyl), an aryl group (e.g., phenyl, naphthyl, 4-methylphenyl), a heterocyclic group (e.g., pyridyl, furyl, imidazolyl, piperidyl, morpholino), an alkoxy group (e.g., methoxy, ethoxy, butoxy), an aryloxy group (e.g., phenoxy, 2-naphthyloxy), an amino group (e.g., unsubstituted amino, dimethylamino, ethylamino, anilino), a ureido group (e.g., unsubstituted ureido, N-methylureido, N-phenylureido), a urethane group (e.g., methoxycarbonylamino, phenoxycarbonylamino), a sulfonyl group (e.g., mesyl, tosyl), a sulfinyl group (e.g., methylsulfinyl, phenylsulfinyl), an alkyloxycarbonyl group (e.g., methoxycarbonyl, ethoxycarbonyl), an aryloxycarbonyl group (e.g., phenoxycarbonyl), an acyl group (e.g., acetyl, benzoyl, formyl, pivaloyl), an acyloxy group (e.g., acetoxy, benzoyloxy), a phosphoramide group (e.g., N,N-diethylphosphoramide), an alkylthio group (e.g., methylthio, ethylthio), an arylthio group (e.g., phenylthio), a cyano group, a mercapto group, a carboxy group, a sulfo group, a phosphono group, a nitro group, a sulfino group, an ammonio group (e.g., trimethylammonio), a phosphonio group and a silyl group (e.g., trimethylsilyl, triethylsilyl, t-butyldimethylsilyl, t-butyldiphenylsilyl). These groups each may be further substituted. When two or more substituents are present, they may be the same or different.

$R_{21}$, $R_{22}$ and $R_{23}$ in formula (2-I) each is preferably a hydrogen atom, an aliphatic hydrocarbon group, an aromatic hydrocarbon group, a heterocyclic group, a carboxy group, a sulfo group, an amino group, a mercapto group, an oxy group, a thio group, an acylamino group or a sulfonamido group, provided that at least one of $R_{21}$, $R_{22}$ and $R_{23}$ is a mercapto group.

$R_{21}$, $R_{22}$ and $R_{23}$ in formula (2-I) each is more preferably a hydrogen atom, an aliphatic hydrocarbon group, a heterocyclic group, a carboxy group, a sulfo group, an amino group, a mercapto group, an oxy group or an acylamino group, provided that at least one of $R_{21}$, $R_{22}$ and $R_{23}$ is a mercapto group.

$R_{21}$, $R_{22}$ and $R_{23}$ in formula (2-I) are most preferably all a mercapto group.

Specific examples of the compounds represented by formula (2-I) are set forth below, however, the compounds of the present invention are by no means limited thereto.

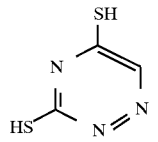

2-I-1.

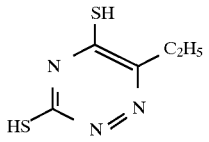

2-I-2.

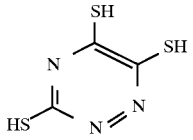

2-I-3.

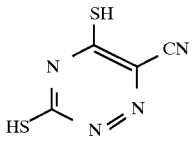

2-I-4.

-continued
2-I-5.
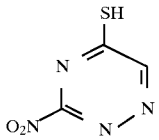
2-I-6.
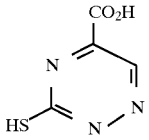
2-I-7.
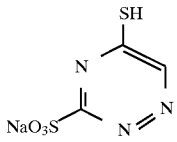
2-I-8.
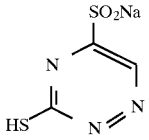
2-I-9.
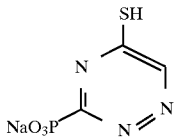
2-I-10.
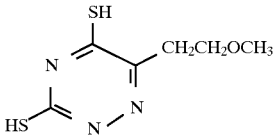
2-I-11.
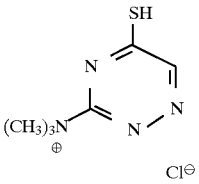
2-I-12.
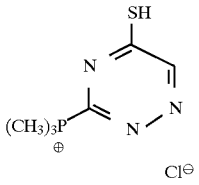
2-I-13.
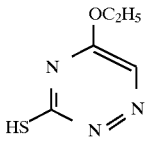
2-I-14.
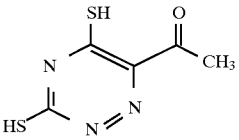
-continued
2-I-15.
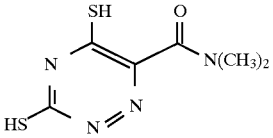
2-I-16.
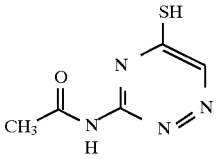
2-I-17.
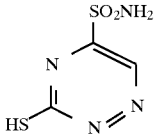
2-I-18.
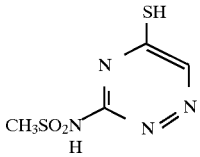
2-I-19.
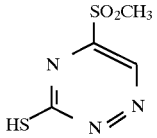
2-I-20.
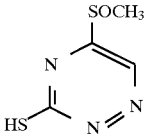
2-I-21.
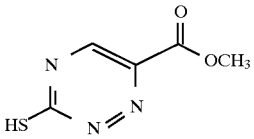
2-I-22.
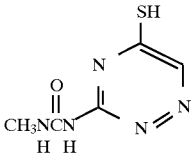
2-I-23.
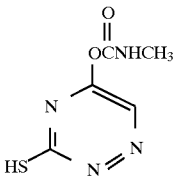
2-I-24.
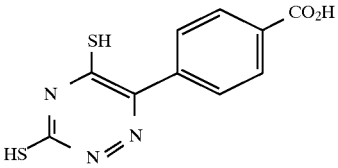

-continued

2-I-25.

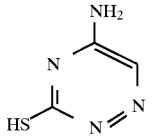

2-I-26.

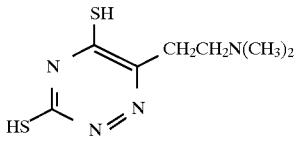

The compounds represented by formulae (2-I) can be synthesized according to the method described in J. G. Erickson, P. F. Wiley, and V. P. Wystrack, *The* 1,2,3- *and* 1,2,4-*Triazines, Tetrazines and Pentazines* (*The Chemistry of Heterocyclic Compounds Series*), Interscience Publishers.

Formula (3-I) is described in detail below.

Examples of the group capable of substituting to the pyrimidine ring, represented by $R_{311}$ or $R_{312}$ in formula (3-I) includes a hydrogen atom, an aliphatic hydrocarbon group, an aromatic hydrocarbon group, a heterocyclic group, a halogen atom, a cyano group, a nitro group, a sulfo group, a sulfino group, a carboxy group, a phosphono group, an amino group, an ammonio group, a phosphonio group, a mercapto group, an oxy group, a thio group, an acyl group, a carbamoyl group, an acylamino group, a sulfamoyl group, a sulfonamido group, a sulfonyl group, a sulfinyl group, an oxycarbonyl group, an acyloxy group, a urethane group and a ureido group.

The aliphatic hydrocarbon group represented by $R_{311}$ or $R_{312}$ in formula (3-I) is preferably an aliphatic hydrocarbon having from 1 to 15 carbon atoms, more preferably a linear, branched or cyclic alkyl, alkenyl, alkynyl or aralkyl group having from 1 to 8 carbon atoms. Among these, the branched group may be cyclized to form a saturated heterocyclic ring containing one or more hetero atoms therein. Examples of the alkyl group include a methyl group, an ethyl group, an isopropyl group, a t-butyl group, an n-octyl group, a cyclopropyl group, a cyclopentyl group and a cyclohexyl group. Examples of the alkenyl group include an allyl group, a 2-butenyl group and a 3-pentenyl group. Examples of the alkynyl group include a propargyl group and a 3-pentenyl group. Examples of the aralkyl group include a benzyl group.

The aromatic hydrocarbon group represented by $R_{311}$ or $R_{312}$ in formula (3-I) is preferably an aromatic hydrocarbon group having from 5 to 15 carbon atoms, more preferably a monocyclic or condensed ring aryl group having from 6 to 10 carbon atoms, and examples thereof include a phenyl group and a naphthyl group.

The heterocyclic group represented by $R_{311}$ or $R_{312}$ in formula (3-I) is a 3-, 4-, 5-, 6-, 7-, 8-, 9- or 10-membered saturated or unsaturated heterocyclic group containing at least one of a nitrogen atom, an oxygen atom and a sulfur atom. The group may be monocyclic or may form a condensed ring with other aromatic ring. The heterocyclic group is preferably a 5- or 6-membered aromatic heterocyclic group and examples thereof include a pyridyl group, an imidazolyl group, a quinolyl group, a benzimidazolyl group, a pyrimidyl group, a pyrazolyl group, an isoquinolyl group, a thiazolyl group, a thienyl group, a furyl group and a benzothiazolyl group.

Examples of the halogen atom represented by $R_{311}$ or $R_{312}$ in formula (3-I) include a fluorine atom, a chlorine atom, a bromine atom and an iodine atom.

Examples of the amino group represented by $R_{311}$ or $R_{312}$ in formula (3-I) include an unsubstituted amino group, a methylamino group, an ethylamino group, a dimethylamino group, a diethylamino group, an anilino group, an o-toluidino group and a 2,4-xylydino group. Examples of the ammonio group include a trimethylammonio group, a triethylammonio group and an unsubstituted ammonio group. Examples of the phosphonio group include a trimethylphosphonio group and a triethylphosphonio group.

Examples of the oxy group represented by $R_{311}$ or $R_{312}$ in formula (3-I) include an alkoxy group (e.g., methoxy, ethoxy, isopropoxy, n-butoxy, cyclohexyloxy), an aryloxy group (e.g., phenoxy, p-methylphenoxy), an oxy group resulting from bonding of an oxygen atom to a heterocyclic ring (e.g., 2-pyridyloxy, 2-imidazolyloxy), an allyloxy group and a benzyloxy group.

Examples of the thio group represented by $R_{311}$ or $R_{312}$ in formula (3-I) include an alkylthio group (e.g., methylthio, ethylthio, isopropylthio, n-butylthio, cyclohexylthio), an arylthio group (e.g., phenylthio, p-methylphenylthio), a thio group resulting from bonding of a sulfur atom to a heterocyclic ring (e.g., 2-pyridylthio, 2-imidazolylthio), an allylthio group and a benzylthio group.

Examples of the acyl group represented by $R_{311}$ or $R_{312}$ in formula (3-I) include a formyl group, an acetyl group, a propionyl group, an isobutyryl group, a valeryl group, a pivaloyl group, an octanoyl group, an acryloyl group, a pyruvoyl group, a benzoyl group, a l-naphthoyl group, an m-toluoyl group and a cynnamoyl group. Examples of the carbamoyl group include an unsubstituted carbamoyl group, an N-methylcarbamoyl group, an N-ethylcarbamoyl group, an N,N-dimethylcarbamoyl group, an N,N-diethylcarbamoyl group and an N-phenylcarbamoyl group. Examples of the acylamino group include an acetylamino group, a benzamido group, a propionylamino group and a pivaloylamino group. Examples of the sulfamoyl group include an unsubstituted sulfamoyl group, a methylsulfamoyl group, an ethylsulfamoyl group, an N,N-diemthylsulfamoyl group, a diethylsulfamoyl group and a phenylsulfamoyl group. Examples of the sulfonamido group include a benzenesulfonamido group and a methylsulfonylamino group. Examples of the sulfonyl group include a mesyl group, a tosyl group and a tauryl group. Examples of the sulfinyl group include a methylsulfinyl group and a phenylsulfinyl group.

Examples of the oxycarbonyl group represented by $R_{311}$ or $R_{312}$ in formula (3-I) include an alkoxycarbonyl group (e.g., methoxycarbonyl, ethoxycarbonyl, isopropoxycarbonyl) and an aryloxycarbonyl group (e.g., phenoxycarbonyl, naphthyloxycarbonyl).

Examples of the ureido group represented by $R_{311}$ or $R_{312}$ in formula (3-I) include an N'-methylureido group, an N',N'-dimethylureido group, an N,N',N'-trimethylureido group, an N'-ethylureido group and an N'-phenylureido group. Examples of the urethane group include a methoxycarbonylamino group and a phenoxycarbonylamino group.

The groups represented by $R_{311}$ or $R_{312}$ in formula (3-I) each may be substituted. Examples of the substituent include the following:

a halogen atom (e.g., fluorine, chlorine, bromine), an alkyl group (e.g., methyl, ethyl, n-propyl, isopropyl, t-butyl, n-octyl, cyclopentyl, cyclohexyl), an alkenyl group (e.g., allyl, 2-butenyl, 3-pentenyl), an alkynyl group (e.g., propargyl, 3-pentynyl), an aralkyl group (e.g., benzyl, phenethyl), an aryl group (e.g., phenyl, naphthyl, 4-methylphenyl), a heterocyclic group (e.g., pyridyl, furyl, imidazolyl, piperidyl, morpholino), an alkoxy group (e.g., methoxy, ethoxy, butoxy), an aryloxy group (e.g., phenoxy, 2-naphthyloxy), an amino group (e.g., unsubstituted amino, dimethylamino, ethylamino, anilino), a ureido group (e.g., unsubstituted ureido, N-methylureido, N-phenylureido), a urethane group (e.g., methoxycarbonylamino, phenoxycarbonylamino), a sulfonyl group (e.g., mesyl, tosyl), a sulfinyl group (e.g., methylsulfinyl, phenylsulfinyl), an alkyloxycarbonyl group (e.g., methoxycarbonyl, ethoxycarbonyl), an aryloxycarbonyl group (e.g., phenoxycarbonyl), an acyl group (e.g., acetyl, benzoyl, formyl, pivaloyl), an acyloxy group (e.g., acetoxy, benzoyloxy), a phosphoric amido group (e.g., N,N-diethylphosphoric amido), an alkylthio group (e.g., methylthio, ethylthio), an arylthio group (e.g., phenylthio), a cyano group, a mercapto group, a carboxy group, a phosphono group, a nitro group, a sulfino group, an ammonio group (e.g., trimethylammonio), a phosphonio group and a silyl group (e.g., trimethylsilyl, triethylsilyl, t-butyldimethylsilyl, t-butyldiphenylsilyl). These groups each may be further substituted. When two or more substituents are present, they may be the same or different.

$R_{311}$ and $R_{312}$ in formula (3-I) each is preferably a hydrogen atom, an aliphatic hydrocarbon group, an aromatic hydrocarbon group, a heterocyclic group, a sulfo group, a carboxy group, an amino group, a mercapto group, an oxy group, a thio group, an acylamino group or a sulfonamido group.

$R_{311}$ and $R_{312}$ in formula (3-I) each is more preferably an aliphatic hydrocarbon group, a sulfo group, a carboxy group, an amino group, a mercapto group, an oxy group or a thio group.

$R_{311}$ and $R_{312}$ in formula (3-I) each is most preferably an aliphatic hydrocarbon group, a sulfo group, a carboxy group, an amino group or a mercapto group.

Formula (3-II) is described in detail below.

The aromatic hydrocarbon group, the heterocyclic group, the halogen atom, the amino group, the ammonio group, the phosphonio group, the oxy group, the thio group, the acyl group, the carbamoyl group, the acylamino group, the sulfamoyl group, the sulfonamido group, the sulfonyl group, the sulfinyl group, the oxycarbonyl group, the acyloxy group, the urethane group and the ureido group represented by $R_{321}$ in formula (3-II) have the same meanings as the aromatic hydrocarbon group, the heterocyclic group, the halogen atom, the amino group, the ammonio group, the phosphonio group, the oxy group, the thio group, the acyl group, the carbamoyl group, the acylamino group, the sulfamoyl group, the sulfonamido group, the sulfonyl group, the sulfinyl group, the oxycarbonyl group, the acyloxy group, the urethane group and the ureido group represented by $R_{311}$ or $R_{312}$ in formula (3-I), respectively.

The group capable of substituting to the pyrimidine ring represented by $R_{322}$ in formula (3-II) has the same meaning as the group capable of substituting to the pyrimidine ring, represented by $R_{311}$ or $R_{312}$ in formula (3-I).

In formula (3-II), $R_{321}$ is preferably an aromatic hydrocarbon group, a heterocyclic group, a sulfo group, a carboxy group, an amino group, a mercapto group, an oxy group, a thio group, an acylamino group or a sulfonamido group, and $R_{322}$ is preferably a hydrogen atom, an aliphatic hydrocarbon group, an aromatic hydrocarbon group, a heterocyclic group, a sulfo group, a carboxy group, an amino group, a mercapto group, an oxy group, a thio group, an acylamino group or a sulfonamido group.

In formula (3-II), $R_{321}$ is more preferably a heterocyclic group, a sulfo group, a carboxy group, an amino group, a mercapto group, an oxy group, a thio group, an acylamino group, a sulfonamido group, and $R_{322}$ is more preferably a hydrogen atom, an aliphatic hydrocarbon group, a sulfo group, a carboxy group, an amino group, a mercapto group, an oxy group or a thio group.

In formula (3-II), $R_{321}$ is most preferably a sulfo group, a carboxy group, an amino group, a mercapto group or an oxy group, and $R_{322}$ is most preferably an aliphatic hydrocarbon group, a sulfo group, a carboxy group or an amino group.

Particularly preferred compounds among the compounds represented by formula (3-I) or (3-II) are described below.

Among the compounds represented by formula (3-I), particularly preferred are compounds in which $R_{311}$ represents a group substituted with a water-soluble group. Examples of the group substituted with a water-soluble group include an alkyl group, an aryl group, an alkylthio group, an arylthio group, an alkoxy group, an alkylamino group or an arylamino group. The water-soluble group herein represents a carboxy group (or a salt thereof), a hydroxy group, an amino group, an ammonio group, a sulfo group (or a salt thereof) or a group containing at least one of these groups.

$R_{311}$ in formula (3-I) is more preferably an alkyl group, an aryl group, an alkylthio group, an alkoxy group, an alkylamino group or an arylamino group, each being substituted with a water-soluble group. Most preferred are an alkyl group, an alkylamino group or an arylamino group, each being substituted with a water-soluble group. As a water-soluble group, more preferred are a carboxy group (or a salt thereof), a hydroxy group or a sulfo group (a salt thereof). $R_{312}$ in formula (3-I) represents particularly preferably a hydrogen atom.

One of the particularly preferred compounds among the compounds represented by formula (3-II) is a compound in which $R_{321}$ represents an alkylthio group, an arylthio group, an alkoxy group, an aryloxy group, an alkylamino group or an arylamino group, each being substituted with a water-soluble group. The water-soluble group herein represents a carboxy group (or a salt thereof), a hydroxy group, an amino group, an ammonio group, a sulfo group (or a salt thereof) or a group containing at least one of these groups.

$R_{321}$ in formula (3-II) is more preferably an alkylthio group, an alkoxy group, an alkylamino group or an arylamino group, each being substituted with a water-soluble group. Most preferred are an alkylamino group or an arylamino group, each being substituted with a water-soluble group. As a water-soluble group, more preferred are a carboxy group (or a salt thereof), a hydroxy group or a sulfo group (a salt thereof). $R_{322}$ in formula (3-II) represents particularly preferably a hydrogen atom.

The other of the particularly preferred compounds among the compounds represented by formula (3-II) is a compound in which $R_{321}$ represents a mercapto group and $R_{322}$ represents an alkyl group, an alkylthio group, an arylthio group, an alkoxy group, an aryloxy group, an alkylamino group or an arylamino group, each being substituted with a water-soluble group. The water-soluble group herein represents a carboxy group (or a salt thereof), a hydroxy group, an amino group, an ammonio group, a sulfo group (or a salt thereof) or a group containing at least one of these groups.

$R_{322}$ in formula (3-II) is more preferably an alkyl group, an alkylthio group, an alkoxy group, an alkylamino group or an arylamino group, each being substituted with a water-soluble group. An alkyl group substituted with a water-soluble group is most preferred. As a water-soluble group, more preferred are a carboxy group (or a salt thereof), a hydroxy group or a sulfo group (a salt thereof). $R_{322}$ in formula (3-II) represents particularly preferably a hydrogen atom.

Specific examples of the compounds represented by formula (3-I) or (3-II) are set forth below, however, the compounds of the present invention are by no means limited thereto.
3-I-1
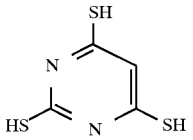
3-I-2
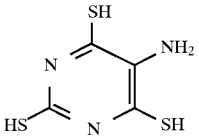
3-I-3
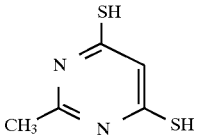
3-I-4
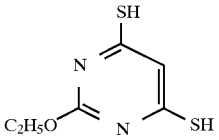
3-I-5
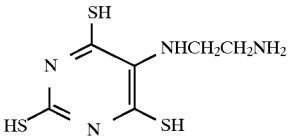
3-I-6
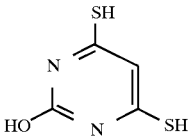
3-I-7
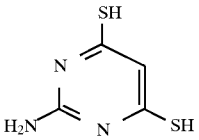
3-I-8
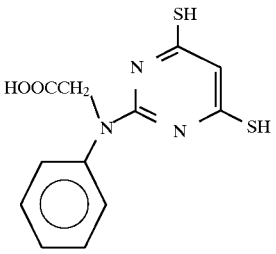
3-I-9
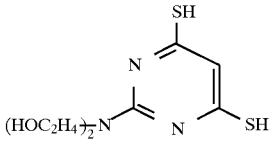
-continued
3-I-10
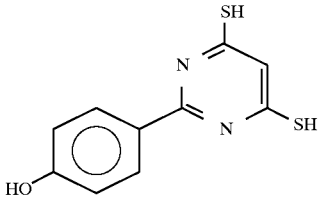
3-I-11
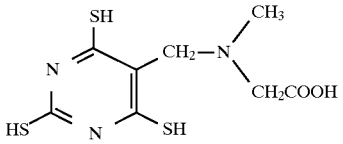
3-I-12
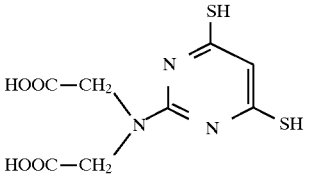
3-I-13
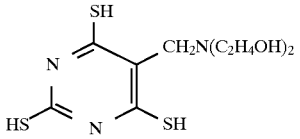
3-I-14
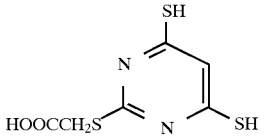
3-I-15
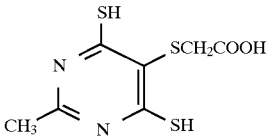
3-I-16
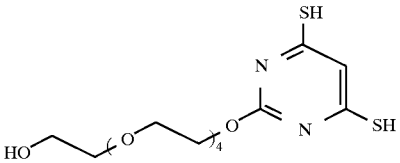
3-I-17
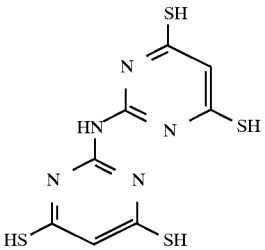
3-I-18
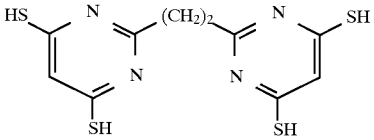

-continued
3-I-19
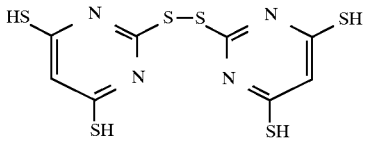
3-I-20
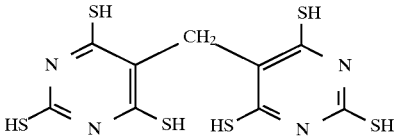
3-I-21
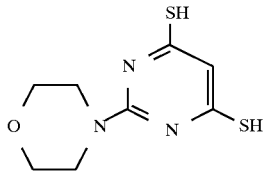
3-I-22
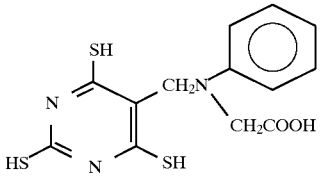
3-I-23
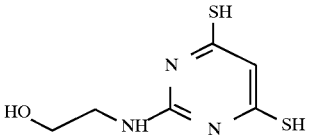
3-I-24
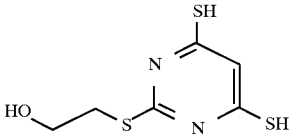
3-I-25
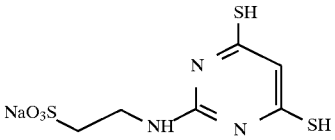
3-II-1
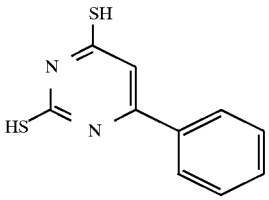
3-II-2
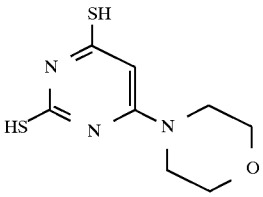
-continued
II-3
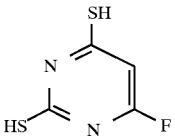
3-II-4
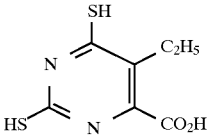
3-II-5
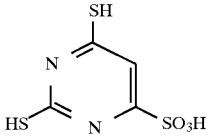
3-II-6
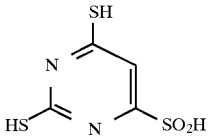
3-II-7
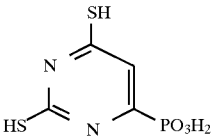
3-II-8
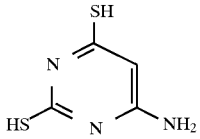
3-II-9
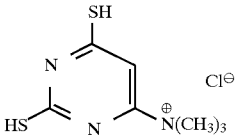
3-II-10
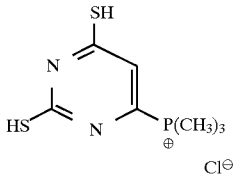
3-II-11
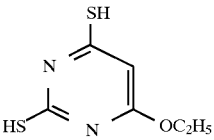
3-II-12
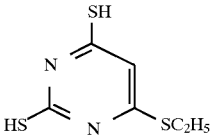

-continued
3-II-13
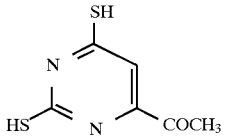
3-II-14
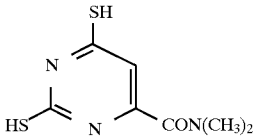
3-II-15
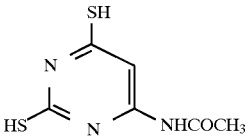
3-II-16
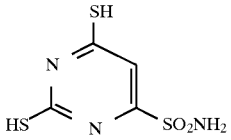
3-II-17
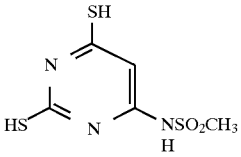
3-II-18
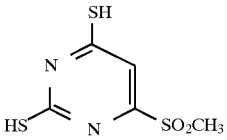
3-II-19
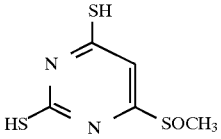
3-II-20
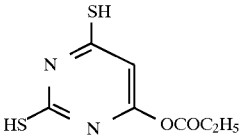
3-II-21
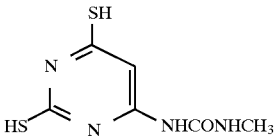
3-II-22
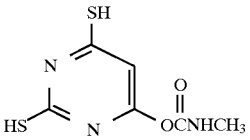
3-II-23
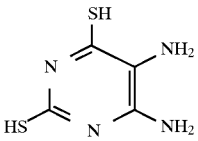
-continued
3-II-24
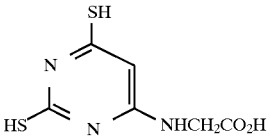
3-II-25
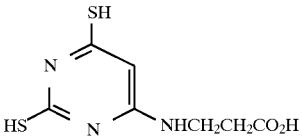
3-II-26
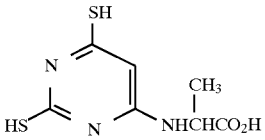
3-II-27
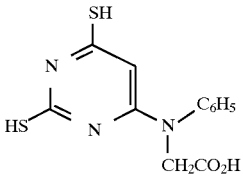
3-II-28
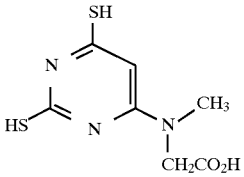
3-II-29
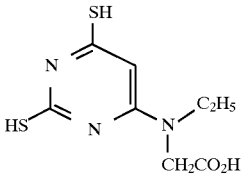
3-II-30
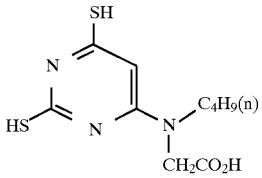
3-II-31
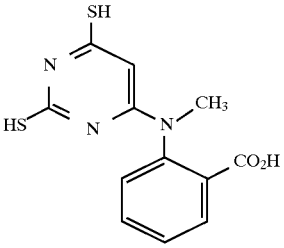

-continued

3-II-32

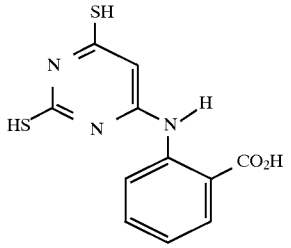

3-II-33

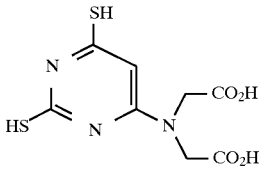

3-II-34

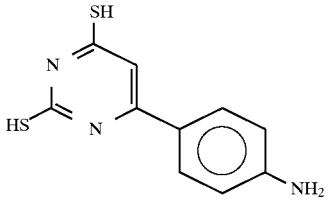

3-II-35

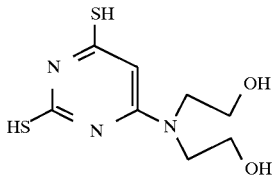

3-II-36

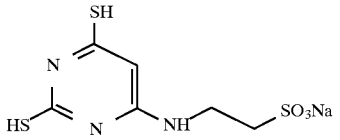

3-II-37

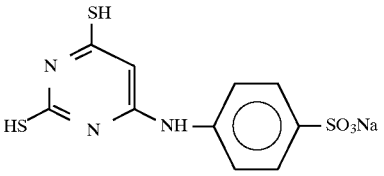

3-II-38

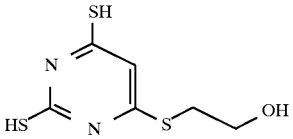

3-II-39

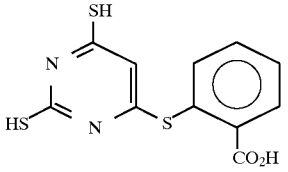

3-II-40

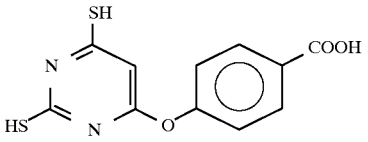

-continued

3-II-41

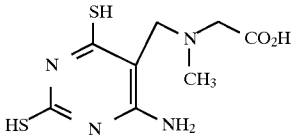

3-II-42

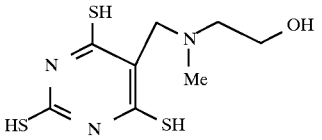

3-II-43

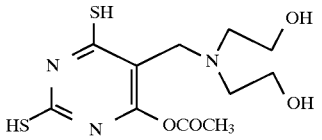

3-II-44

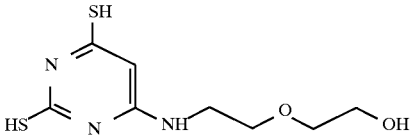

3-II-45

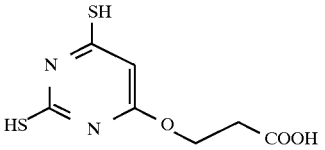

3-II-46

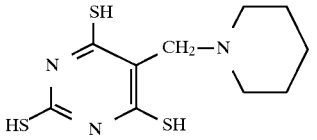

3-II-47

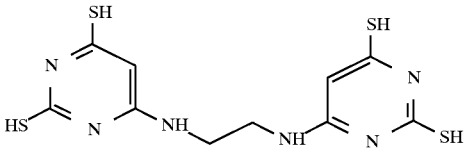

The compounds represented by formulae (3-I) and (3-II) can be synthesized according to the methods described in already known literatures, for example, D. J. Brown, *The Pyrimidines* (*The Chemistry of Heterocyclic Compounds Series*), Interscience Publishers.

Pyrimidine derivatives represented by formula (4) are described below.

$R_{41}$ in formula (4) represents a hydrogen atom or an aliphatic group.

The aliphatic group herein represents a linear, branched or cyclic alkyl group, alkenyl group or alkynyl group, which may be substituted or unsubstituted.

When the aliphatic group has a substituent, examples of the substituent include a halogen atom (e.g., fluorine, chlorine, bromine or iodine), an alkyl group (including an aralkyl group, a cycloalkyl group and active methine group), an alkenyl group, an alkynyl group, an aryl group, a heterocyclic group, a quarternized nitrogen-containing heterocyclic ring (e.g., pyridinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including groups having an ethyleneoxy group or a propyleneoxy group as a repeating unit), an aryloxy group, a heterocyclic oxy group, an acyloxy group, an alkoxyoxycarbonyloxy group, an aryloxycarbonyloxy group, a carbamoyloxy group, a sulfonyloxy group, an amino group, an alkylamino group, an arylamino group, a heterocyclic amino group, a hydroxyamino group, a saturated or unsaturated N-substituted nitrogen-containing heterocyclic group, an acylamino group, a sulfonamide group, an ureido group, a thioureido group, an imido group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, an alkylsulfinyl group, an arylsulfinyl group, a sulfo group or salt thereof, a sulfamoyl group, an acylsulfamoyl group, a sulfonylsulfamoyl group or salt thereof, a group containing a phosphoric amido or phosphoric ester structure.

These groups each may be further substituted with at least one of these groups.

The alkyl group represented by $R_{41}$ in formula (4) is an alkyl group having 1 to 10 carbon atoms, such as methyl, ethyl, propyl, cyclopropyl, 2-hydroxyethyl, cyanocarboxymethyl, phenylcarboxymethyl, tri(hydroxymethyl)methyl, methylthiomethyl and phenoxymethyl group. The alkyl group represented by $R_{41}$ may be an active methine group. The alkenyl group represented by $R_{41}$ is an alkenyl group having 1 to 10 carbon atoms, such as vinyl, 2-propenyl and styryl group. The alkynyl group represented by $R_{41}$ is an alkynyl group having 1 to 10 carbon atoms, such as ethynyl, 2-propynyl and 2-ethoxycarbonylethynyl group.

When $R_{42}$ in formula (4) represents a hydrogen atom, $R_{41}$ represents an aliphatic group substituted with at least one water-soluble group. The water-soluble group herein represents a sulfonic acid or salt thereof, a carboxylic acid or salt thereof, a salt comprising an ammonio group or a group containing a dissociative group capable of partly or completely dissociating by an alkaline developer. Specific examples of the water-soluble group include a sulfo group (or a salt thereof), a carboxy group (or a salt thereof), a hydroxy group, a mercapto group, an amino group, an ammonio group, a sulfonamido group, an acylsulfamoyl group, a sulfonylsulfamoyl group, an active methine group or a substituent containing at least one of these groups. The active methine group herein means a methyl group substituted with two electron-withdrawing groups, such as dicyanomethyl group, α-cyano-α-ethoxycarbonylmethyl group and α-acetyl-α-ethoxycarbonylmethyl group.

$R_{41}$ in formula (4) is preferably a hydrogen atom or an alkyl group. The alkyl group represented by $R_{41}$ in formula (4) is preferably an unsubstituted alkyl group having 1 to 4 carbon atoms in total, an active methine group having 3 to 8 carbon atoms in total or a substituted alkyl group having 1 to 8 carbon atoms in total. The substituent of the substituted alkyl group is preferably a water-soluble group or a substituent containing a water-soluble group. The water-soluble group for the alkyl group represented by $R_{41}$ is preferably a sulfo group (or a salt thereof), a carboxy group (or a salt thereof), a hydroxy group, a mercapto group or an amino group, particularly preferably a sulfo group (or a salt thereof), a carboxy group (or a salt thereof) or a hydroxy group.

$R_{42}$ in formula (4) is preferably a hydrogen atom or a substituent. Specific examples of the substituent represented by $R_{42}$ include the same as the substituents described above which the aliphatic group represented by $R_{41}$ may have.

The substituent represented by $R_{42}$ is preferably a substituent having 0 to 15 carbon atoms in total, such as a halogen atom (especially chlorine atom), an alkyl group, an aryl group, a heterocyclic group, a carboxy group or salt thereof, a cyano group, a hydroxy group, an alkoxy group, an aryloxy group, a heterocyclic oxy group, an acyloxy group, an amino group, an alkylamino group, an arylamino group, a heterocyclic amino group, a hydroxyamino group, a saturated or unsaturated N-substituted nitrogen-containing heterocyclic group, an acylamino group, a sulfonamido group, an ureido group, a thioureido group, an imido group, a sulfamoylamino group, a quaternary ammonio group, a nitro group, a mercapto group, an alkylthio group, an arylthio group, a heterocyclic thio group, an alkylsulfonyl group, an arylsulfonyl group, a sulfo group or salt thereof, or a sulfamoyl group, more preferably a chlorine atom, an alkyl group (especially a methyl group substituted with an amino group), an aryl group, an aryloxy group, an amino group, a mercapto group, an alkylthio group, an arylthio group or a heterocyclic thio group.

$R_{42}$ in formula (4) is preferably a hydrogen atom or a substituent substituted with a water-soluble group and having 1 to 15 carbon atoms in total, such as an alkyl group (especially a methyl group substituted with an amino group), an aryl group, an aryloxy group or an alkylthio group. The water-soluble group herein has the same meaning as the water-soluble group which the aliphatic group represented by $R_{41}$ when $R_{42}$ in formula (4) represents a hydrogen atom may have. The water-soluble group which the substituent represented by $R_{42}$ may have is preferably a sulfo group (or a salt thereof), a carboxy group (or a salt thereof), a hydroxy group, a mercapto group, an amino group, an ammonio group or a sulfonamido group.

Among the pyrimidine derivatives represented by formula (4), most preferred are pyrimidine derivatives represented by the following formula (4-2):

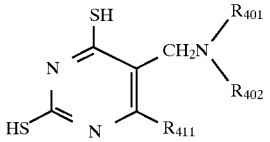

(4-2)

In the above formula, $R_{411}$ has the same meaning as $R_{41}$ in formula (4). Preferred examples of the group represented by $R_{411}$ also have the same meaning.

$R_{401}$ and $R_{402}$ may be same or different, and each represents a hydrogen atom, an alkyl group, an aryl group or a heterocyclic group, with the proviso that at least one of the substituents represented by $R_{401}$ and $R_{402}$ contains at least one water-soluble group. The water-soluble group herein has the same meaning as the water-soluble group which the aliphatic group represented by $R_{41}$ when $R_{42}$ in formula (4) represents a hydrogen atom may have. The water-soluble group is preferably a sulfo group (or a salt thereof), a carboxy group (or a salt thereof), a hydroxy group or an amino group.

$R_{401}$ and $R_{402}$ is preferably an alkyl group or an aryl group. When $R_{401}$ and $R_{402}$ each represents an alkyl group, the alkyl group is preferably a substituted or unsubstituted alkyl group having 1 to 4 carbon atoms in total. The substituent of the substituted alkyl group is preferably a water-soluble group, especially preferably a sulfo group (or a salt thereof), a carboxy group (or a salt thereof), a hydroxy group or an amino group. When $R_{401}$ and $R_{402}$ each represents an aryl group, the aryl group is preferably a substituted or unsubstituted phenyl group having 6 to 8 carbon atoms in total. The substituent of the substituted phenyl group is preferably a water-soluble group, especially preferably a sulfo group (or a salt thereof), a carboxy group (or a salt thereof), a hydroxy group or an amino group.

When $R_{401}$ and $R_{402}$ each represents an alkyl group or an aryl group, the substituents represented by $R_{401}$ and $R_{402}$ may bond to each other to form a ring structure.

Specific examples of the compounds represented by formula (4) are set forth below, however, the compounds of the present invention are by no means limited thereto.

4-I-1

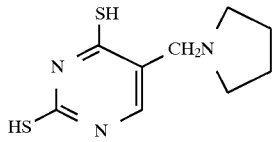

4-I-2

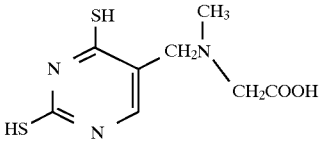

4-I-3

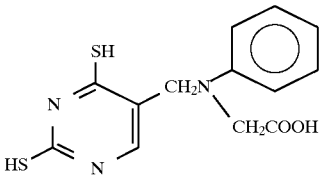

4-I-4

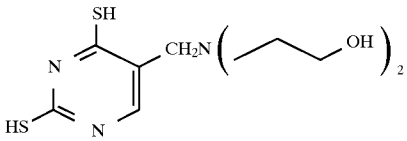

4-I-5

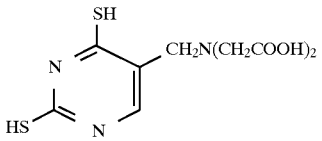

4-I-6

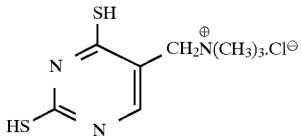

4-I-7

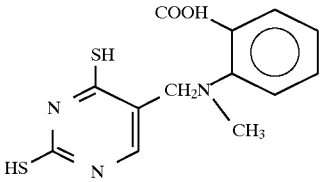

4-I-8

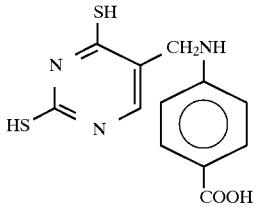

-continued

4-I-9

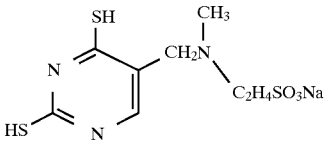

4-I-10

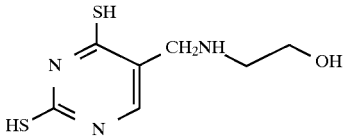

4-I-11

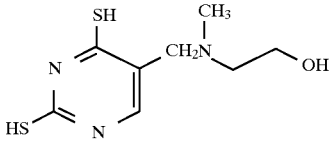

4-I-12

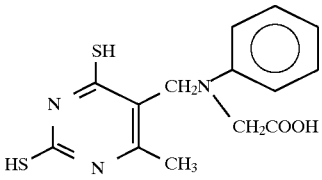

4-I-13

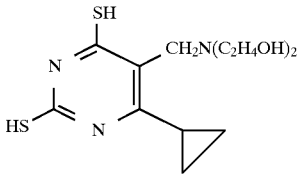

4-I-14

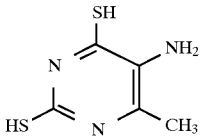

4-I-15

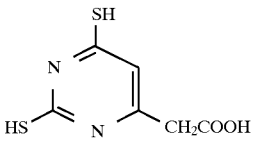

4-I-16

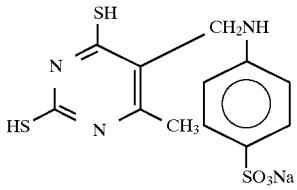

4-I-17

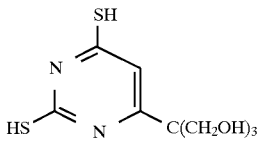

-continued
4-I-18
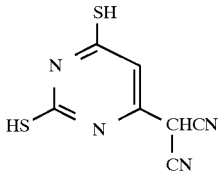
4-I-19
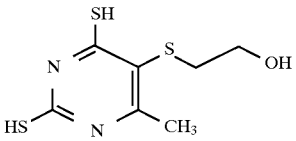
4-I-20
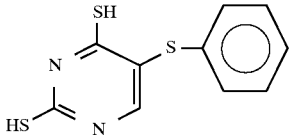
4-I-21
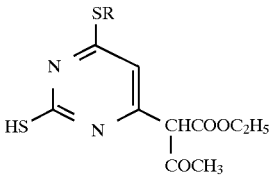
4-I-22
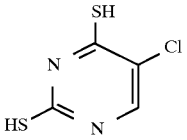
4-I-23
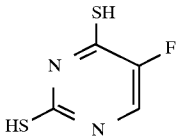
4-I-24
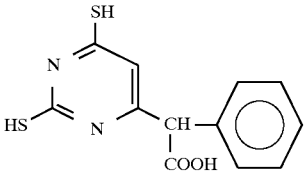
4-I-25
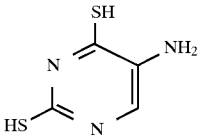
4-I-26
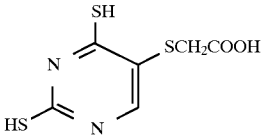
4-I-27
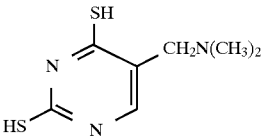
-continued
4-I-28
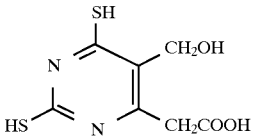
4-I-29
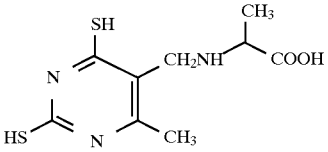
4-I-30
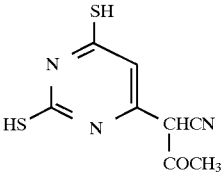
4-I-31
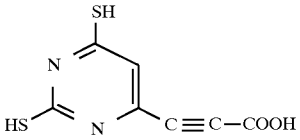
4-I-32
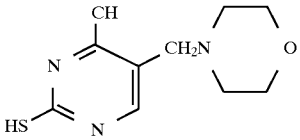
4-I-33
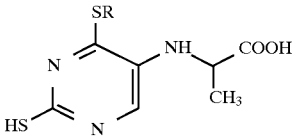
4-I-34
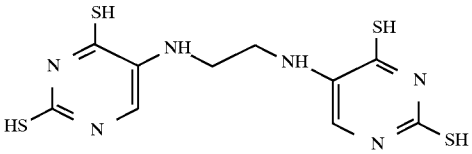
4-I-35
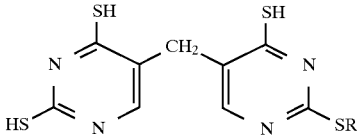
4-I-36
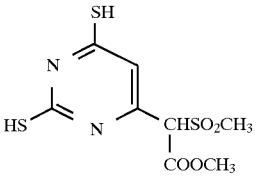
4-I-37
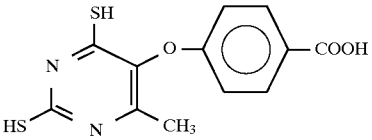

-continued

4-I-38

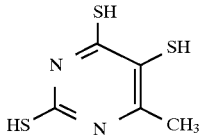

4-I-39

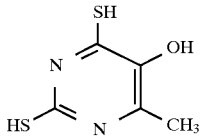

4-I-40

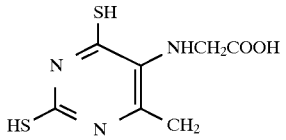

4-I-41

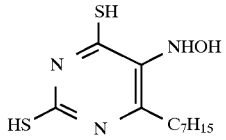

4-I-42

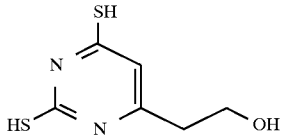

4-I-43

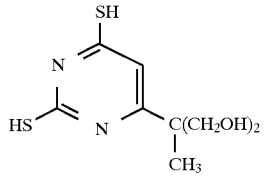

4-I-44

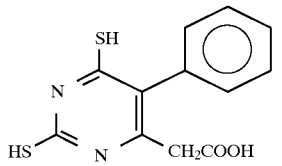

4-I-45

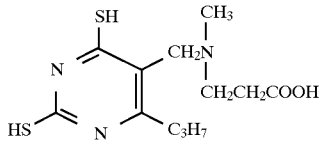

4-I-46

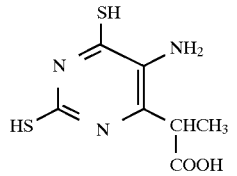

4-I-47

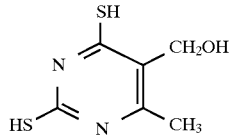

The compounds represented by formula (4) can be readily synthesized according to known methods described in already known literatures. Synthesis examples of the compounds represented by formula (4) are described below.

1. Synthesis of Compound 4-I-1

A mixture containing 28.8 g (0.2 mol) of 2,4-dimercaptopyrimidine, 17.9 g of 37% formalin aqueous solution, 18.2 ml (0.22 mol) of pyrrolidine and 300 ml of ethanol was heated and refluxed for 3 hours to give a precipitate. The precipitate was filtered off, washed with 100 ml of methanol and air-dried to obtain 40 g of crude crystals. The crude crystals were dissolved in 200 ml of 1N NaOH and acidified with 3N HCl to obtain 28 g of Compound 4-I-1 (yield: 62%).

2. Synthesis of Compound 4-I-2

Compound 4-I-2 was synthesized in the same manner as in Synthesis of Compound 4-I-1, except for using N-methylglycine instead of pyrrolidine.

3. Synthesis of Compound 4-I-3

Compound 4-I-3 was synthesized in the same manner as in Synthesis of Compound 4-I-1, except for using N-phenylglycine instead of pyrrolidine.

4. Synthesis of Compound 4-I-12

Compound 4-I-12 was synthesized in the same manner as in Synthesis of Compound 4-I-3, except for using 2,4-dimercapto-6-methylpyrimidine instead of 2,4-dimercaptopyrimidine.

The compound represented by formula (1-I), (1-II), (2-I), (3-I), (3-II) or (4) of the present invention is added to the developer preferably in an amount of from 0.01 to 10 mmol, more preferably from 0.1 to 5 mmol, per liter of the developer.

The processing agents such as developer and fixing solution, and the processing method for use in the present invention are described below, however, the present invention is by no means limited to the following description and specific examples.

In the development processing of the present invention, any known method may be used and known development processing solutions may be used.

The developing agent used in the developer (the development initiating solution and the development replenisher are collectively called a developer, hereinafter the same) for use in the present invention is not particularly restricted, however, it preferably contains a dihydroxybenzene, an ascorbic acid derivative or a hydroquinone monosulfonate, and these may be used individually or in combination. Further, in view of developing capability, a combination of a dihydroxybenzene or an ascorbic acid derivative with a 1-phenyl-3-pyrazolidone and a combination of a dihydroxybenzene or an ascorbic acid with a p-aminophenol are preferred.

Examples of the dihydroxybenzene developing agent for use in the present invention include hydroquinone, chlorohydroquinone, isopropylhydroquinone and methylhydroquinone, with hydroquinone being particularly preferred. Examples of the ascorbic acid derivative developing agent include an ascorbic acid, an isoascorbic acid and a salt thereof, and sodium erythorbate is particularly preferred in view of the cost for materials.

An auxiliary developing agent is preferably used in the present invention.

Examples of the 1-phenyl-3-pyrazolidone or a derivative thereof as the auxiliary developing agent for use in the present invention include 1-phenyl-3-pyrazolidone, 1-phenyl-4,4-dimethyl-3-pyrazolidone and 1-phenyl-4-methyl-4-hydroxymethyl-3-pyrazolidone.

Examples of the p-aminophenol-base auxiliary developing agent for use in the present invention include N-methyl-p-aminophenol, p-aminophenol, N-(β-hydroxyphenyl)-p-aminophenol and N-(4-hydroxyphenyl)glycine, with N-methyl-p-aminophenol being particularly preferred.

The dihydroxybenzene-base developing agent is usually used preferably in an amount of from 0.05 to 0.8 mol/l. In the case when a dihydroxybenzene and a 1-phenyl-3-pyrazolidone or a p-aminophenol are used in combination, the former is preferably used in an amount of from 0.05 to 0.6 mol/l, more preferably from 0.23 to 0.5 mol/l, and the latter is preferably used in an amount of 0.06 mol/l or less, more preferably from 0.03 to 0.003 mol/l.

The ascorbic acid derivative developing agent is usually used preferably in an amount of from 0.01 to 0.5 mol/l, more preferably from 0.05 to 0.3 mol/l. In the case when an ascorbic acid derivative and a 1-phenyl-3-pyrazolidone or a p-aminophenol are used in combination, the ascorbic acid is preferably used in an amount of from 0.01 to 0.5 mol/l, and the 1-phenyl-3-pyrazolidone or p-aminophenol is preferably used in an amount of from 0.005 to 0.2 mol/l.

The developer for use in processing the photosensitive material of the present invention may contain additives (e.g., developing agent, alkali agent, pH buffer, preservative, chelating agent) which are commonly used. Specific examples thereof are described below, however, the present invention is by no means limited thereto.

Examples of the buffer for use in the developer used in processing the photosensitive material of the present invention include a carbonate, a boric acid described in JP-A-62-186259, saccharides (e.g., saccarose) described in JP-A-60-93433, oximes (e.g., acetoxime), phenols (e.g., 5-sulfosalicylic acid) and a tertiary phosphate (e.g., sodium salt, potassium salt), and a carbonate and a boric acid are preferably used. The buffer, particularly carbonate, is used preferably in an amount of 0.5 mol/l or more, more preferably from 0.5 to 1.5 mol/l.

Examples of the preservative for use in the present invention include sodium sulfite, potassium sulfite, lithium sulfite, ammonio sulfite, sodium bisulfite, potassium metabisulfite and sodium formaldehyde bisulfite. The sulfite is used in an amount of 0.2 mol/l or more, preferably 0.3 mol/l or more, however, if it is added in excess, silver stains are caused in the developer and therefore, the upper limit is preferably 1.2 mol/l. The sulfite is more preferably used in an amount of from 0.35 to 0.7 mol/l.

As the preservative of the dihydroxybenzene-base developing agent, a small amount of an ascorbic acid derivative may be used in combination with the sulfite. In particular, sodium erythorbate is preferred in view of the cost for materials. The addition amount thereof is, in terms of a molar ratio to the dihydroxybenzene-base developing agent, preferably from 0.03 to 0.12, more preferably from 0.05 to 0.10. In the case where an ascorbic acid derivative is used as the preservative, the developer preferably contains no boron compound.

Examples of additives other than those described above include a development inhibitor such as sodium bromide and potassium bromide; an organic solvent such as ethylene glycol, diethylene glycol, triethylene glycol and dimethylformamide; a development accelerator such as alkanolamine (e.g., diethanolamine, triethanolamine), imidazole and a derivative thereof, and a physical development unevenness inhibitor such as heterocyclic mercapto compound (e.g., sodium 3-(5-mercaptotetrazol-1-yl)benzenesulfonate, 1-phenyl-5-mercaptotetrazole) and the compounds described in JP-A-62-212651.

Further, the developer may contain an antifoggant or a black pepper inhibitor such as a mercapto-base compound, an indazole-base compound, a benzotriazole-base compound and a benzimidazole-base compound. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazol-2-yl)thio)butanesulfonate, 5-amino-1,3,4-thiadiazole-2-thiol, methylbenzotriazole, 5-methylbenzotriazole and 2-mercaptobenzotriazole. These additives are each usually used in an amount of from 0.01 to 10 mmol, preferably from 0.1 to 2 mmol, per liter of the developer.

The developer of the present invention can further use various organic or inorganic chelating agents individually or in combination.

Examples of the inorganic chelating agent include sodium tetrapolyphosphate and sodium hexametaphosphate.

Examples of the organic chelating agent which is predominantly used, include an organic carboxylic acid, an aminopolycarboxylic acid, an organic phosphonic acid, an aminophosphonic acid and an organic phosphonocarboxylic acid.

Examples of the organic carboxylic acid include an acrylic acid, an oxalic acid, a malonic acid, a succinic acid, a glutaric acid, a gluconic acid, an adipic acid, a pimelic acid, an azelaic acid, a sebacic acid, a nonanedicarboxylic acid, a decanedicarboxylic acid, an undecanedicarboxylic acid, a maleic acid, an itaconic acid, a malic acid, a citric acid and a tartaric acid.

Examples of the aminopolycarboxylic acid include di(carboxymethyl)aspartic acid, iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminetetraacetic acid, and the compounds described in JP-A-52-25632, JP-A-55-67747, JP-A-57-102624 and JP-B-53-40900.

Examples of the organic phosphonic acid include hydroxyalkylidene diphosphonic acid described in U.S. Pat. Nos. 3,214,454 and 3,794,591 and German Patent Application (OLS) No. 2,227,396, and the compounds described in *Research Disclosure*, Vol. 181, Item 18170 (May 1979).

Examples of the aminophosphonic acid include aminotris (methylenephosphonic acid), ethylenediaminetetramethylenephosphonic acid, aminotrimethylenephosphonic acid, and the compounds described in *Research Disclosure* (supra), No. 18170, JP-A-57-208554, JP-A-54-61125, JP-A-55-29883 and JP-A-56-97347.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure* (supra), No. 18170.

The organic and/or inorganic chelating agents are not limited to those described above. Further, they may be used in the form of an alkali metal salt or an ammonio salt. The chelating agent is preferably added in an amount of from $1\times10^{-4}$ to $1\times10^{-1}$ mol, more preferably from $1\times10^{-3}$ to $1\times10^{-2}$ mol, per liter of the developer.

The compounds of the present invention as a silver stain inhibitor may be used individually or may be used in combination with a compound described in JP-B-56-24347, JP-B-56-46585, JP-B-62-2849 and JP-A-4-362942 or a polyoxyalkyl phosphate described in U.S. Pat. No. 5,457,011. The silver stain inhibitor is added in an amount of preferably from 0.05 to 10 mmol, more preferably from 0.1 to 5 mmol, per liter of the developer.

Further, the developer may use the compound described in JP-A-62-212651 as an uneven development inhibitor and the compound described in JP-A-61-267759 as a dissolution aid.

The developer may also contain a color toner, a surface active agent, a defoaming agent and a hardening agent, if desired.

The developer preferably has a pH of from 9.0 to 12.0, more preferably from 9.5 to 11.0, particularly preferably from 9.5 to 10.7. The pH of the development replenisher and the pH of the developer in a developer tank in continuous processing are also in the same range as described above. The alkali agent used for adjusting the pH may be a usual water-soluble inorganic alkali metal salt (e.g., sodium hydroxide, potassium hydroxide, sodium carbonate, potassium carbonate).

The replenishing amount of the developer is 390 ml or less, preferably from 30 to 325 ml, most preferably from 120 to 180 ml, per 1 $m^2$ of the photosensitive material. The development replenisher may have the same composition and/or concentration as the development initiating solution or may have a composition and/or a concentration different from the initiating solution.

Examples of the fixing agent in the fixing processing agent for use in the present invention includes ammonio thiosulfate, sodium thiosulfate and ammonio sodium thiosulfate. The use amount of the fixing agent may be varied appropriately, however, it is generally from about 0.7 to about 3.0 mol/l.

The fixing solution for use in the present invention may contain a water-soluble aluminum salt or a water-soluble chromium salt which acts as a hardening agent, and of these, a water-soluble aluminum salt is preferred. Examples thereof include aluminum chloride, aluminum sulfate, potassium alum, ammonio aluminum sulfate, aluminum nitrate and aluminum lactate. These are each preferably contained, in terms of an aluminum ion concentration in the solution used, in an amount of from 0.01 to 0.15 mol/l.

When the fixing solution is stored as a concentrated solution or a solid agent, it may be constituted by a plurality of portions preparing a hardening agent or the like as a separate portion or may be constituted as a one-part agent containing all components.

The fixing processing agent may contain, if desired, a preservative (e.g., sulfite, bisulfite, metabisulfite, in an amount of 0.015 mol/l or more, preferably from 0.02 to 0.3 mol/l), a pH buffer (e.g., acetic acid, sodium acetate, sodium carbonate, sodium hydrogencarbonate, phosphoric acid, succinic acid, adipic acid, in an amount of from 0.1 to 1 mol/l, preferably from 0.2 to 0.7 mol/l), or a compound having aluminum stabilizing ability or hard water softening ability (e.g., gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, tylon, ascorbic acid, glutaric acid, aspartic acid, glycine, cysteine, ethylenediaminetetraacetic acid, nitrilotriacetic acid, a derivative and a salt thereof, saccharides, boric acid, in an amount of from 0.001 to 0.5 mol/l, preferably from 0.005 to 0.3 mol/l).

[0058]

In addition, the developer may contain a compound described in JP-A-62-78551, a pH adjusting agent (e.g., sodium hydroxide, ammonia, sulfuric acid), a surface active agent, a wetting agent or a fixing accelerator. Examples of the surface active agent include anionic surface active agents such as sulfated product and sulfonated product, polyethylene-base surface active agents, and amphoteric surface active agents described in JP-A-57-6840. A known defoaming agent may also be used. Examples of the wetting agent include alkanolamine and alkylene glycol. Examples of the fixing accelerator include alkyl- or aryl-substituted thiosulfonic acids and salts thereof described in JP-A-6-308681, thiourea derivatives described in JP-B-45-35754, JP-B-58-122535 and JP-B-58-122536, alcohols having a triple bond within a molecule, thioether compounds described in U.S. Pat. No. 4,126,459, mercapto compounds described in JP-A-1-4739, JP-A-1-159645 and JP-A-3-101728, meso-ionic compounds described in JP-A-4-170539 and thiocyanates.

The fixing solution for use in the present invention has a pH of 4.0 or more, preferably from 4.5 to 6.0, and more preferably from 4.7 to 5.0.

The replenishing amount of the fixing solution is 500 ml or less, preferably 390 ml or less, more preferably from 80 to 320 ml, per 1 $m^2$ of the photosensitive material. The replenisher may have the same composition and/or concentration as the initiating solution or may have a composition and/or a concentration different from the initiating solution.

The fixing solution may be reused using a known fixing solution regeneration method such as electrolytic silver recovery. Examples of the regeneration apparatus include Reclaim R-60 manufactured by Fuji Hunt Electronics Technology Co., Ltd.

When the developer or the fixing processing solution for use in the present invention is stored in the liquid form, it is preferably stored in a packaging material having a low oxygen permeability described, for example, in JP-A-61-73147. And, when these solutions each is supplied as a concentrated solution, it is diluted with water to have a predetermined concentration on use and the water for dilution is used in an amount of from 0.2 to 3 parts per 1 part of the concentrated solution.

When the development processing agent or the fixing processing agent for use in the present invention is used as a solid, the same effects as provided by the liquid agent can be obtained. The solid processing agent is described below.

The solid processing agent for use in the present invention may be used in a known shape (e.g., powder, grain, granule, lump, tablet, compactor, briquette, plate, cracked product, stick, paste). The solid agent may be prepared by coating respective components with a water-soluble coating agent or coating film so as to separate components which react with each other on contacting or may have a plural layer structure so as to separate components which react with each other. These techniques may also be used in combination.

The coating may be performed using a known compound and polyvinyl pyrrolidone, polyethylene glycol, sulfonated polystyrene and a vinyl-base compound are preferred. In addition, gelatin, pectin, polyacrylic acid, polyvinyl alcohol, vinyl acetate copolymer, polyethylene oxide, sodium carboxymethyl cellulose, hydroxypropyl cellulose, methyl cellulose, ethyl cellulose, alginic acid, xanthane gum, gum arabic, tragacanth gum, carrageenan, methyl vinyl ether, maleic anhydride copolymer, a polyoxyethylene alkyl ether such as polyoxyethylene stearyl ether and polyoxyethylene ethyl ether, a polyoxyethylene alkylphenol ether such as polyoxyethylene octylphenol ether and polyoxyethylene nonylphenol ether, or a water-soluble binder described in EP 469,877A may be used individually or in combination of two or more thereof. These each may also be used as a granulating aid.

In the case of a plural layer structure, a component which does not react on contacting may be interposed between components which react with each other and the layer structure may be processed into a tablet or a briquette. Or, components in a known shape may also be constituted into the same layer structure and then packaged. These methods are described, for example, in JP-A-61-259921, JP-A-4-15641, JP-A-4-16841, JP-A-4-32837, JP-A-4-78848 and JP-A-5-93991.

The solid processing agent has a bulk density of preferably from 0.5 to 6.0 g/cm$^3$, particularly in the case of a tablet, it is preferably from 1.0 to 5.0 g/cm$^3$ and in the case of a granule, from 0.5 to 1.5 g/cm$^3$.

The solid processing agent for use in the present invention may be prepared by any known method. For example, the packaging method is described in JP-A-61-259921, JP-A-4-16841 and JP-A-4-78848 and the compression method is described in JP-A-4-85533, JP-A-4-85534, JP-A-4-85535, JP-A-5-134362, JP-A-5-197070, JP-A-5-204098, JP-A-5-224361, JP-A-6-138604 and JP-A-6-138605.

More specifically, a rolling granulation method, an extrusion granulation method, a compressive granulation method, a cracking granulation method, an agitating granulation method, a spray dry method, a dissolving coagulation method, a briquetting method or a roller compacting method may be used.

The grain size and the shape of the granulated product suitable for the present invention vary depending on the characteristics desired, however, in general, taking account of solubility of the photographic processing agent requested and the residual powder amount in the waste package after preparation of the solution or durability against rupture of the granulated product due to vibration upon transportation, in the case of granule, the sphere conversion grain size is approximately from 0.5 to 50 mm, preferably approximately from 1 to 15 mm, and the shape is a cylindrical, sphere, cubic or rectangular parallelopiped form, preferably a spherical or cylindrical form.

The solid processing agent prepared by a roller compacting process may be cracked and further may be sieved to have a size of approximately from 2 mm to 1 cm.

In the case of a briquette or a tablet, the grain size and the shape similarly vary depending on the characteristics desired, however, the size is preferably on the order of from 2 mm to 5 cm, and the shape is preferably a cylindrical, spherical, cubic or rectangular parallelopiped form, more preferably a spherical or cylindrical form. When improvement in the solubility is desired, a platy form reduced in the thickness or further reduced in the thickness in the central portion, or a hollow doughnut form is useful. On the contrary, the size or the thickness may further be increased so as to perform dissolution gradually. Thus, the size and the shape can be selected as needed. In order to control the solubility, the surface condition (e.g., smooth, porous) may be changed. It is also possible to impart different solubilities to a plurality of granulated products or to have a plurality of shapes so as to harmonize the solubility of materials different in the solubility. Further, a granulated product comprising a plurality of layers different in the composition between the surface and the inside may be used.

The packaging material for the solid processing agent is preferably a material having low permeability to oxygen and water. The shape of the packaging material may be a known form such as a bag, a cylinder or a box. Further, a shape capable of folding as disclosed in JP-A-6-242585 to JP-A-6-242588, JP-A-6-247432, JP-A-6-247448, JP-A-7-5664, JP-A-7-5666 to JP-A-7-5669 is also preferred so as to save the space for storing waste packaging materials. The packaging material may be fixed at the takeout port for the processing agent by a screw cap, a pull-top or an aluminum seal or may be heat sealed, and in addition, a known means may be used, however, the present invention is by no means limited thereto. The waste packaging material is preferably recycled or reused in view of environmental conservation.

The method for dissolving or replenishing the solid processing agent of the present invention is not particularly restricted and known methods may be used. Examples of the method include a method of dissolving a constant amount of solid processing agent in a dissolving apparatus having an agitation function and replenishing it, a method of dissolving a solid processing agent in a dissolving apparatus having a dissolving portion and a portion for stocking the finished solution and replenishing the solution from the stock portion as described in Japanese Patent Application No. Hei. 7-235499, a method of charging a processing agent into a circulation system of an automatic developing machine and dissolving and replenishing it in the system as described in JP-A-5-119454, JP-A-6-19102 and JP-A-7-261357, and a method of charging and dissolving a processing agent according to the processing of a photosensitive material in an automatic developing machine containing a dissolution tank. Other than these, any known method may be used. The charging of the processing agent may be performed by manually unsealing the package and charging the processing agent or by means of automatic unsealing and automatic charging in a dissolving apparatus or automatic developing machine having an unsealing mechanism as described in Japanese Patent Application No. Hei. 7-235498. In view of working environment, the latter is preferred. Specific examples of the method include a method of bursting, peeling off, cutting out or pushing away the takeout port and methods described in JP-A-6-19102 and JP-A-6-95331.

The photosensitive material processed through development and fixing is then subjected to water washing or stabilization (hereinafter, unless otherwise specified, water washing includes stabilization and the solution for use therein is called water or washing water). The water for use in water washing may be tap water, ion exchanged water, distilled water or a stabilizing solution. The replenishing amount of the washing water is generally from about 8 l to about 17 l per m$^2$ of the photosensitive material, however, a replenishing amount lower than the above-described range may also be used. In particular, when the replenishing amount is 3 l or less (including 0, namely, standing water washing), not only processing with water saving can be performed but also the processing can dispense with piping for installation of an automatic developing machine. When water washing is performed with a small replenishing amount of water, a rinsing tank such as squeeze roller or cross-over roller described in JP-A-63-18350 and JP-A-62-287252 is preferably provided. Or, addition of various oxidizing agents (e.g., ozone, hydrogen peroxide, sodium hypochloride, active halogen, chlorine dioxide, sodium carbonate hydrogen peroxide salt) or filter filtration may be combined so as to reduce the pollution load which is a problem encountered in water washing with a small amount of water or for preventing water scale.

As a method for reducing the replenishing amount of washing water, a multi-stage countercurrent system (for example, two stages or three stages) has been known from of old, and the replenishing amount of washing water is preferably from 50 to 200 ml per m$^2$ of the photosensitive material. This effect can be also obtained similarly in the case of an independent multi-stage system (a method of not using a countercurrent system but supplying a new solution individually to the multi-stage water washing tanks).

In the method of the present invention, a means for preventing water scale may be provided in the water washing step. The water scale preventing means is not particularly restricted and a known means may be used. Examples thereof include a method of adding a fungicide (so-called water scale inhibitor), a method of applying electricity, a method of irradiating ultraviolet rays, infrared rays or far infrared rays, a method of applying magnetic field, a method of performing ultrasonic wave treatment, a method of applying heat, and a method of evacuating the tank on standing. The water scale preventing means may be performed according to the processing of the photosensitive material, may be performed at a predetermined interval irrespective of the use state, or may be performed only in the period of non-processing time such as night time. Or, the washing water may be previously treated with a water scale preventing means and then replenished. Also, in view of preventing generation of resistance microbes, it is preferred to perform different water scale preventing means every a predetermined period.

The fungicide is not particularly restricted and a known fungicide may be used. Examples thereof include, in addition to the above-described oxidizing agents, glutaraldehyde, a chelating agent such as aminopolycarboxylic acid, a cationic surface active agent and mercaptopyridine oxide (e.g., 2-mercaptopyridine-N-oxide), and a sole fungicide may be used or a plurality of fungicides may be used in combination.

The electricity may be applied according to the method described in JP-A-3-224685, JP-A-3-224687, JP-A-4-16280 or JP-A-4-18980.

A known water-soluble surface active agent or defoaming agent may be added so as to prevent uneven processing due to bubbling or to prevent transfer of stains. Further, a dye adsorbent described in JP-A-63-163456 may be provided in the water washing system so as to prevent stains due to a dye dissolved out from the photosensitive material.

The overflow solution from water washing step may be partly or wholly used by mixing it with the processing solution having fixing ability as described in JP-A-60-235133. It is also preferred in view of conservation of natural environment to reduce the biochemical oxygen demand (BOD), chemical oxygen demand (COD) or iodine consumption before discharge by subjecting the solution to microorganism treatment (a treatment with a filter comprising a porous carrier such as activated carbon or ceramic, having carried thereon sulfur oxidation bacteria, activated sludge process or microorganisms) or oxidation treatment by electrification or with an oxidizing agent, or to reduce silver concentration in waste water by passing the solution through a filter using a polymer having affinity for silver or by adding a compound which forms a sparingly soluble silver complex, such as trimercaptotriazine to precipitate silver and then passing the solution through a filter.

In some cases, stabilization may be performed subsequent to the water washing and as one example, a bath containing the compound described in JP-A-2-201357, JP-A-2-132435, JP-A-1-102553 and JP-A-46-44446 may be used as a final bath of the photosensitive material. This stabilization bath may also contain, if desired, an ammonium compound, a metal compound such as Bi or Al, a fluorescent brightening agent, various chelating agents, a layer pH adjusting agent, a layer hardening agent, a bactericide, a fungicide, an alkanolamine or a surface active agent.

The additives and the stabilizing agents, such as a fungicide, added to the water washing or stabilization bath may be formed into a solid agent similarly to the above-described development and fixing processing agents.

Waste water of the developer, the fixing solution, the washing water or the stabilizing solution for use in the present invention is preferably burned for disposal. The waste water may also be formed into a concentrated solution or a solid by a concentration apparatus as described, for example, in JP-B-7-83867 and U.S. Pat. No. 5,439,560 and then disposed.

In the case when the replenishing amount of the processing agent is reduced, it is preferred to prevent evaporation or air oxidation of the solution by reducing the contact area of the processing tank with air. A roller transportation-type automatic developing machine is described in U.S. Pat. Nos. 3,025,779 and 3,545,971, and in the present invention, it is referred to simply as a roller transportation-type automatic processor. This automatic processor comprises four steps of development, fixing, water washing and drying, and it is most preferred to follow this four-step processing also in the present invention, though other steps (e.g., stopping step) are not excluded. Further, a rinsing bath may be provided between development and fixing and/or between fixing and water washing.

In the development of the present invention, the dry-to-dry time is preferably from 25 to 160 seconds, the development time and the fixing time each is 40 seconds or less, preferably from 6 to 35 seconds, and the temperature of each solution is preferably from 25° to 50° C., more preferably from 30° to 40° C. The temperature and the time of water washing are preferably from 0° to 50° C. and 40 seconds or less, respectively. According to the method of the present invention, the photosensitive material after development, fixing and water washing may be passed through squeeze rollers for squeezing washing water and then dried. The drying is performed at a temperature of from about 40° C. to about 100° C. The drying time may be appropriately varied depending upon the ambient condition. The drying method is not particularly restricted and any of known methods may be used, however, hot air drying, drying by a heat roller as disclosed in JP-A-4-15534, JP-A-5-2256 and JP-A-5-289294, and drying by far infrared rays may be used, and a plurality of drying methods may be used in combination.

In the silver halide emulsion for use in the photosensitive material of the present invention, the silver halide may be any commonly used in the silver halide emulsion, such as silver bromide, silver iodobromide, silver chloride, silver chlorobromide and silver chloroiodobromide, and it is preferably, for the negative silver halide emulsion, silver chlorobromide having a silver chloride content of 60 mol % or more, and for the positive silver halide emulsion, silver chlorobromide, silver bromide or silver iodobromide each having a silver bromide content of 60 mol % or more. The silver halide grain may be obtained by any of an acid process, a neutral process and an ammonia process. The silver halide grain may be either a grain having a uniform silver halide composition distribution within the grain or a core/shell grain different in the silver halide composition between the inside and the surface layer of the grain. Further, the silver halide grain may be either a grain where a latent image is formed mainly on the surface or a grain where the latent image is formed mainly in the inside of the grain. The surface of the grain may be previously fogged. The silver halide grain for use in the present invention may have any shape. One preferred example is a cubic form having a crystal surface of {100} face. Further, a grain having an octahedral, tetradecahedral or dodecahedral form may be prepared according to the methods described in U.S. Pat. Nos. 4,183,756 and 4,225,666, JP-A-55-26589, JP-B-55-42737, *J. Photogr. Sci.*, 21–39 (1973), and used. Furthermore, a grain having a twin plane may be used. The silver halide grains for use in the present invention may have a uniform form or a mixture of grains having various shapes may be used. In the present invention, a monodisperse emulsion is preferred. In the monodisperse silver halide grains in the monodisperse emulsion, the weight of silver halide grains having a grain size of an average grain size γ±10% preferably accounts for 60% or more of the weight of all silver halide grains.

The silver halide emulsion for use in the present invention is not particularly limited on the halogen composition, however, in order to achieve the objects of the present invention more effectively, silver chloride, silver chlorobromide and silver chloroiodobromide each having a silver chloride content of 50 mol % or more are preferred. The silver iodide content is preferably less than 5 mol %, more preferably less than 2 mol %.

In the present invention, a photosensitive material suitable for high illuminance exposure such as scanner exposure or a photosensitive material for line work photographing contains a rhodium compound so as to achieve high contrast and low fog.

A water-soluble rhodium compound may be used as the rhodium compound for use in the present invention. Examples thereof include rhodium(III) halogenide compounds and rhodium complex salts having a halogen, an amine or an oxalate as a ligand, such as hexachlororhodium (III) complex salt, hexabromorhodium(III) complex salt, hexaaminerhodium(III) complex salt and trioxalaterhodium (III) complex salt. The rhodium compound is dissolved in water or an appropriate solvent before use, however, a method commonly well used for stabilizing the rhodium compound solution, that is, a method of adding an aqueous solution of hydrogen halogenide (e.g., hydrochloric acid, bromic acid, fluoric acid) or halogenated alkali (e.g., KCl, NaCl, KBr, NaBr) may be used. In place of using water-soluble rhodium, separate silver halide grains previously doped with rhodium may be added and dissolved at the time of preparation of silver halide.

The amount of the rhodium compound added is from $1\times10^{-8}$ to $5\times10^{-6}$ mol, preferably from $5\times10^{-8}$ to $1\times10^{-6}$, per mol of silver in the silver halide emulsion.

The rhodium compound may be appropriately added at the time of production of silver halide emulsion grains or at respective stages before coating of the emulsion, however, it is preferably added at the time of formation of the emulsion and integrated into the silver halide grain.

The photographic emulsion for use in the present invention can be prepared according to the methods described in P. Glafkides, *Chimie et Physique Photographique*, Paul Montel (1967), G. F. Duffin, *Photographic Emulsion Chemistry*, The Focal Press (1966), and V. L. Zelikman et al, *Making and Coating Photographic Emulsion*, The Focal Press (1964).

A soluble silver salt and a soluble halogen salt may be reacted by any of a single jet method, a double jet method and a combination thereof.

A method of forming grains in the presence of excessive silver ions (so-called reverse mixing method) may also be used. Further, a method of maintaining constant the pAg in the liquid phase where the silver halide is formed, a so-called controlled double jet method as one form of the double jet method, may be used. The grains are preferably formed using a so-called silver halide solvent such as ammonia, thioether or tetra-substituted thiourea. The tetra-substituted thiourea compound is more preferred and this is described in JP-A-53-82408 and JP-A-55-77737. Preferred examples of the thiourea compound include tetramethylthiourea and 1,3-dimethyl-2-imidazolidinethione.

In the controlled double jet method and the grain formation method using a silver halide solvent, a silver halide emulsion having a regular crystal form and a narrow grain size distribution can be easily prepared, and these are a useful means for preparing a silver halide emulsion for use in the present invention.

The silver halide for use in the present invention is not particularly limited on the shape of grain and any of cubic, octahedral and spherical silver halide grains and in addition, tabular silver halide grains having a high aspect ratio described in *Research Disclosure*, 22534 (January 1983), may be used.

In order to achieve a uniform grain size, it is preferred to rapidly grow grains within the range of not exceeding the critical saturation degree, using a method of changing the addition rate of silver nitrate or halogenated alkali according to the grain growth rate as described in British Patent 1,535,016, JP-B-48-36890 and JP-B-52-16364, or a method of changing the concentration of the aqueous solution as described in British Patent 4,242,445 and JP-A-55–158124.

The emulsion of the present invention is preferably a monodisperse emulsion having a coefficient of variation of 20% or less, more preferably 15% or less.

The grains in the monodisperse silver halide emulsion have an average grain size of 0.5 μm or less, more preferably from 0.1 to 0.4 μm.

The silver halide emulsion of the present invention is preferably subjected to chemical sensitization. The chemical sensitization may be performed using a known method such as sulfur sensitization, selenium sensitization, tellurium sensitization or noble metal sensitization, and these sensitization methods may be used individually or in combination. When these sensitization methods are used in combination, a combination of sulfur sensitization and gold sensitization, a combination of sulfur sensitization, selenium sensitization and gold sensitization, and a combination of sulfur sensitization, tellurium sensitization and gold sensitization are preferred.

The sulfur sensitization for use in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as thiosulfates, thioureas, thiazoles and rhodanines. Preferred sulfur compounds are a thiosulfate and a thiourea compound. The addition amount of the sulfur sensitizer varies depending upon various conditions such as the pH and the temperature at the time of chemical ripening and the size of silver halide grains, however, it is generally from $10^{-7}$ to $10^{-2}$ mol, preferably from $10^{-5}$ to $10^{-3}$ mol, per mol of silver halide.

Examples of the sulfur sensitizer include, in addition to the sulfur compound contained in gelatin, various sulfur compounds such as thiosulfates, thioureas, thiazoles and rhodanines. Specific examples thereof include those described in U.S. Pat. Nos. 1,574,944, 2,278,947, 2,410,689, 2,728,668, 3,501,313 and 3,656,955. Preferred sulfur compounds are a thiosulfate and a thiourea compound. The pAg at the chemical sensitization is preferably 8.3 or less, more preferably from 7.3 to 8.0.

Further, good results may be obtained also by a method of using polyvinylpyrrolidone and a thiosulfate in combination as reported in Moisar, *Klein Gelationc. Proc. Symp.* 2nd, 301–309 (1970).

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, JP-A-4-109240 and JP-A-4-324855, and among these, particularly preferred are the compounds represented by formulae (VIII) and (IX) of JP-A-4-324855.

The tellurium sensitizer for use in the present invention is a compound of forming silver telluride presumed to be a sensitization speck, on the surface or in the inside of a silver halide grain. The formation rate of silver telluride in a silver halide emulsion can be examined by a method described in JP-A-5-313284.

Specific examples of the tellurium sensitizer include the compounds described in U.S. Pat. Nos. 1,623,499, 3,320,069 and 3,772,031, British Patents 235,211, 1,121,496, 1,295,462 and 1,396,696, Canadian Patent 800,958, JP-A-4-204640, JP-A-4-271341, JP-A-4-333043, JP-A-5-303157, *J. Chem. Soc. Chem. Commun.*, 635 (1980), ibid., 1102 (1979), ibid., 645 (1979), *J. Chem. Soc. Perkin. Trans.*, 1, 2191 (1980), S. Patai (compiler), *The Chemistry of Organic Selenium and Tellurium Compounds*, Vol. 1 (1986), and ibid., Vol. 2 (1987). The compounds represented by formulae (II), (III) and (IV) of JP-A-5-313284 are particularly preferred.

The use amount of the selenium sensitizer or the tellurium sensitizer for use in the present invention varies depending upon silver halide grains used or chemical ripening conditions, however, it is generally on the order of from $10^{-8}$ to $10^{-2}$ mol, preferably from $10^{-7}$ to $10^{-3}$ mol, per mol of silver halide. The conditions for chemical sensitization in the present invention are not particularly restricted, however, the pH is from 5 to 8, the pAg is from 6 to 11, preferably from 7 to 10, and the, temperature is from 40° to 95° C., preferably from 45° to 85° C.

Examples of the noble metal sensitizer for use in the present invention include gold, platinum, palladium and iridium, and gold sensitization is particularly preferred. Specific examples of the gold sensitizer for use in the present invention include chloroauric acid, potassium chlorate, potassium aurithiocyanate and gold sulfide, and the gold sensitizer is used in an amount of approximately from $10^{-7}$ to $10^{-2}$ mol per mol of silver halide.

In the silver halide emulsion for use in the present invention, a cadmium salt, a sulfite, a lead salt or a thallium salt may be present together during formation or physical ripening of silver halide grains.

In the present invention, reduction sensitization may be used. Examples of the reduction sensitizer which can be used include stannous salt, amines, formamidinesulfinic acid and silane compounds.

To the silver halide emulsion of the present invention, a thiosulfonic acid compound may be added according to the method described in European Unexamined Patent Publication (EP) 293917.

In the photosensitive material for use in the present invention, one kind of silver halide emulsion may be used or two or more kinds of silver halide emulsions (for example, different in the average grain size, different in the halogen composition, different in the crystal habit, or different in chemical sensitization conditions) may be used in combination.

In the present invention, the silver halide emulsion particularly suitable for a dot-to-dot work photosensitive material comprises silver halide having a silver chloride content of 90 mol % or more, preferably 95 mol % or more, more specifically, silver chlorobromide or silver chloroiodobromide containing from 0 to 10 mol % of silver bromide. If the proportion of silver bromide or silver iodide increases, the safelight safety in a bright room may be worsened or the γ value may be disadvantageously lowered.

The silver halide emulsion for use in the dot-to-dot work photosensitive material of the present invention preferably contains a transition metal complex and examples of the transition metal include Rh, Ru, Re, Os, Ir and Cr.

Examples of the ligand include a nitrosyl cross-linked ligand, a thionitrosyl cross-linked ligand, a halide ligand (e.g., fluoride, chloride, bromide, iodide), a cyanide ligand, a cyanate ligand, a thiocyanate ligand, a selenocyanate ligand, a tellurocyanate ligand, an acid ligand and an aquo ligand. When an aquo ligand is present, it preferably occupies one or more of the ligands.

More specifically, the rhodium atom may be incorporated by forming it into a metal salt in any form, such as a single salt or a complex salt, and adding the salt at the time of preparation of grains.

Examples of the rhodium salt include rhodium monochloride, rhodium dichloride, rhodium trichloride and ammonium hexachlororhodate, and preferred are a halogen complex compound of water-soluble trivalent rhodium, such as hexachlororhodium(III) acid and a salt thereof (e.g., ammonium salt, sodium salt, potassium salt).

The addition amount of the water-soluble rhodate is from $1.0\times10^{-6}$ to $1.0\times10^{-3}$, preferably $1.0\times10^{-5}$ to $1.0\times10^{-3}$, more preferably from $5.0\times10^{-5}$ to $5.0\times10^{-4}$ mol, per mol of silver halide.

The following transition metal complexes are also preferred.

1. $[Ru(NO)Cl_5]^{-2}$
2. $[Ru(NO)_2Cl_4]^{-1}$
3. $[Ru(NO)(H_2O)Cl_4]^{-1}$
4. $[Rh(NO)CN_5]^{-2}$
5. $[Re(NO)CN_5]^{-2}$
6. $[Re(NO)ClCN_4]^{-2}$
7. $[Rh(NO)_2Cl_4]^{-1}$
8. $[Rh(NO)(H_2O)Cl_4]^{-1}$
9. $[Ru(NO)CN_5]^{-2}$
10. $[Ru(NO)Br_5]^{-2}$
11. $[Rh(NS)Cl_5]^{-2}$
12. $[Os(NO)Cl_5]^{-2}$
13. $[Cr(NO)Cl_5]^{-3}$
14. $[Re(NO)Cl_5]^{-1}$
15. $[Os(NS)Cl_4(TeCN)]^{-2}$
16. $[Ru(NS)I_5]^{-2}$
17. $[Re(NS)Cl_4(SeCN)]^{-2}$
18. $[Os(NS)Cl(SCN)_4]^{-2}$
19. $[Ir(NO)Cl_5]^{-2}$

The spectral sensitizing dye for use in the present invention is not particularly restricted.

The addition amount of the sensitizing dye for use in the present invention varies depending upon the shape or size of silver halide grains, however, it is generally from $4\times10^{-6}$ to $8\times10^{-3}$ mol per mol of silver halide. For example, when the silver halide grain size is from 0.2 to 1.3 μm, the addition amount is preferably from $2\times10^{-7}$ to $3.5\times10^{-6}$ mol, more preferably from $6.5\times10^{-7}$ to $2.0\times10^{-6}$ mol, per 1 $m^2$ of the surface area of silver halide grains.

[0099]

The photosensitive silver halide emulsion of the present invention may be spectrally sensitized by a sensitizing dye to blue light, green light, red light or infrared light, each having a relatively long wavelength. Examples of the sensitizing dye which can be used include a cyanine dye, a merocyanine dye, a complex cyanine dye, a complex merocyanine dye, a holopolar cyanine dye, a styryl dye, a hemicyanine dye, an oxonol dye and a hemioxonol dye.

Useful sensitizing dyes for use in the present invention are described, for example, in *Research Disclosure*, Item 17643, IV-A, page 23 (December 1978), ibid., Item 18341-X, page 437 (August 1979), U.S. Pat. Nos. 4,425,425 and 4,425,426, and publications cited therein.

In particular, sensitizing dyes having spectral sensitivity suitable for spectral characteristics of various scanner light sources can be advantageously selected.

For example, A) for an argon laser light source, simple merocyanines described in JP-A-60-162247, JP-A-2-48653, U.S. Pat. No. 2,161,331, West German Patent 936,071 and JP-A-5-11389, B) for a helium-neon laser light source, trinuclear cyanine dyes described in JP-A-50-62425, JP-A-54-18726 and JP-A-59-102229, C) for an LED light source and a red semiconductor laser, thiacarbocyanines described in JP-B-48-42172, JP-B-51-9609, JP-B-55-39818, JP-A-62-284343 and JP-A-2-105135, and D) for an infrared semiconductor laser light source, tricarbocyanines described in JP-A-59-191032 and JP-A-60-80841, and dicarbocyanines containing a 4-quinoline nucleus described in JP-A-59-192242 and JP-A-3-67242, formulae (IIIa) and (IIIb), may be advantageously selected.

These sensitizing dyes may be used individually or in combination, and the combination of sensitizing dyes is often used for the purpose of supersensitization. In combination with the sensitizing dye, a dye which itself has no spectral sensitization effect or a material which absorbs substantially no visible light, but exhibits supersensitization may be incorporated into the emulsion.

Useful sensitizing dyes, combinations of dyes which exhibit supersensitization, and materials which show supersensitization are described in *Research Disclosure*, Vol. 176, 17643, page 23, Item IV-J (December 1978). Specific examples thereof are described below.

S1-1

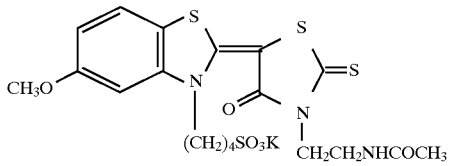

S1-2

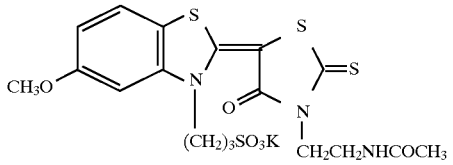

S1-3

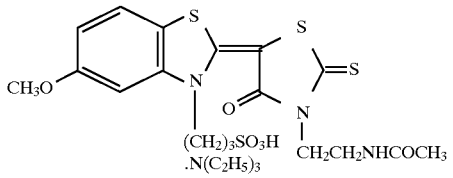

-continued

S1-4

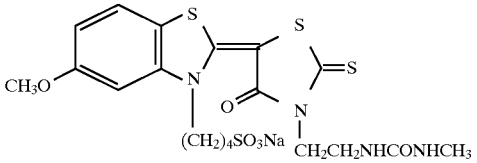

S1-5

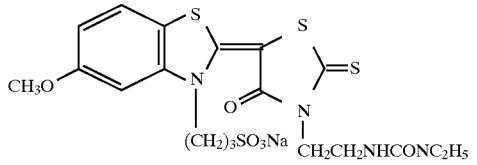

S1-6

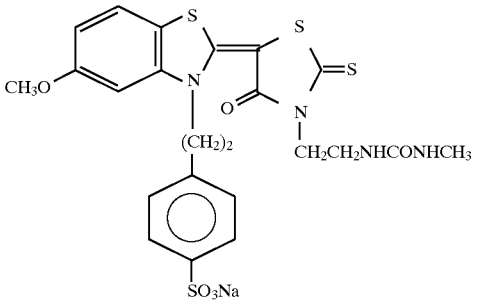

S1-7

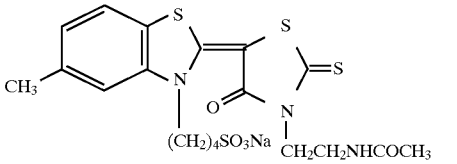

S1-8

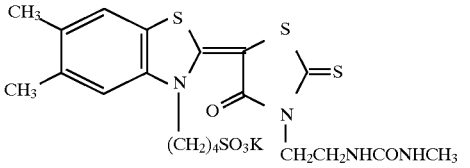

S1-9

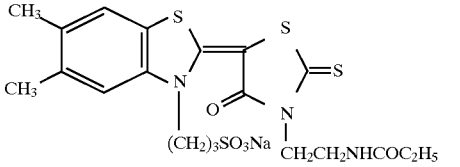

S1-10

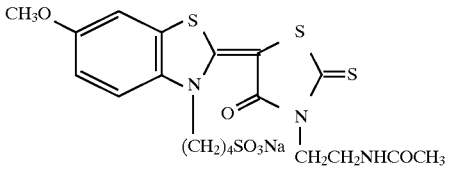

S1-11

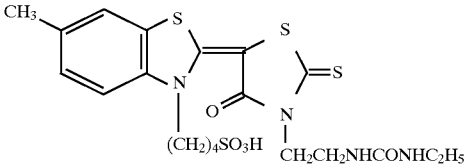

-continued
S1-12
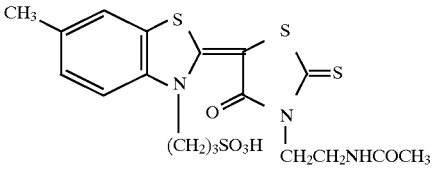
-continued
S1-13
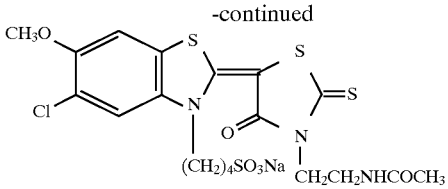
For the helium-neon light source, the sensitizing dyes represented by formula (I) of JP-A-6-75322 are particularly preferred as well as the compounds as described above. Specific examples thereof are described below.
S2-1
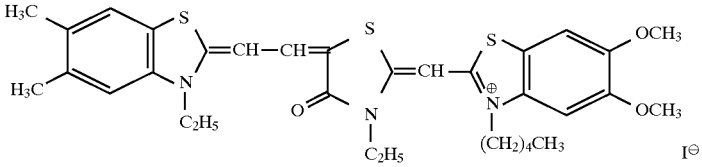
S2-2
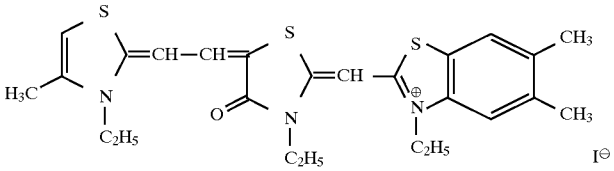
S2-3
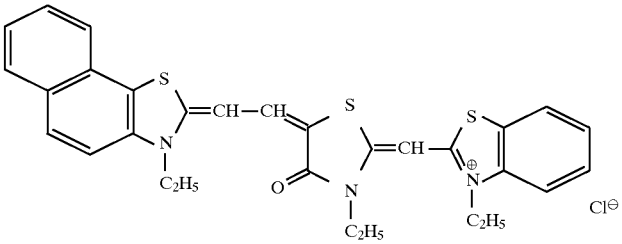
S2-4
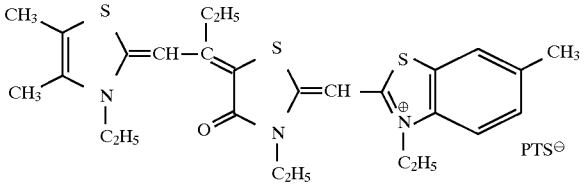
S2-5
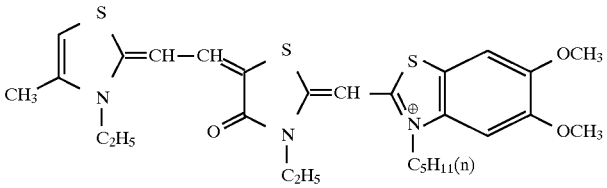
S2-6
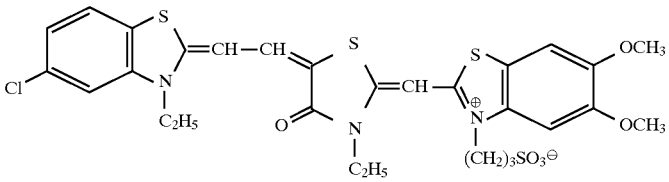
S2-7
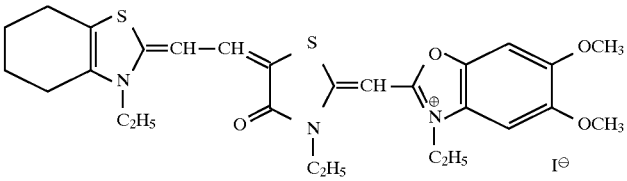

-continued
S2-8
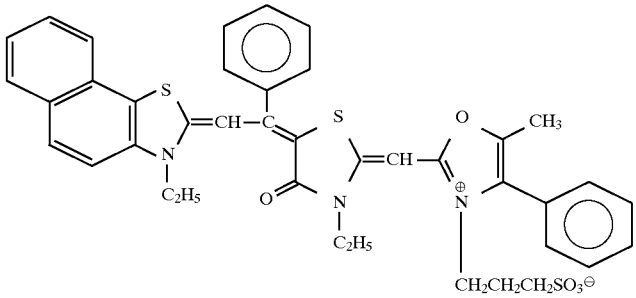
For the LED light source and the infrared semiconductor laser, the dyes described below are particularly preferred.
S3-1
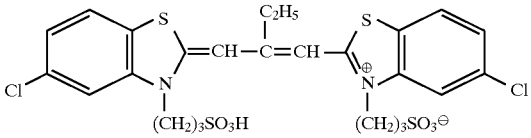
S3-2
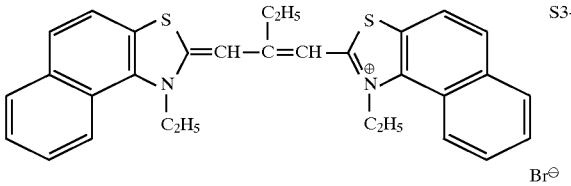
S3-3
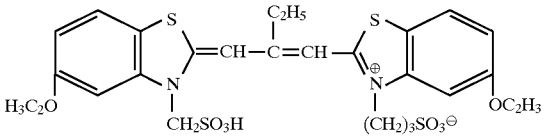
S3-4
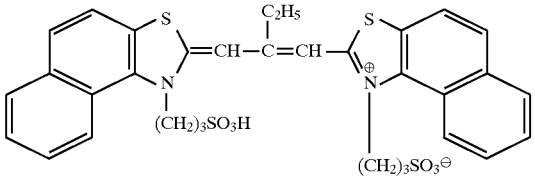
-continued
S3-5
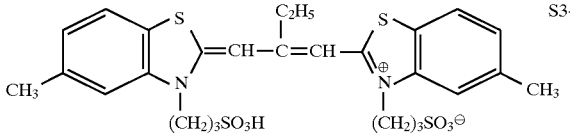
S3-6
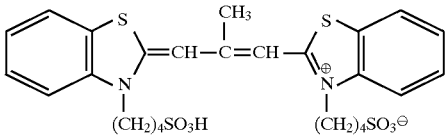
S3-7
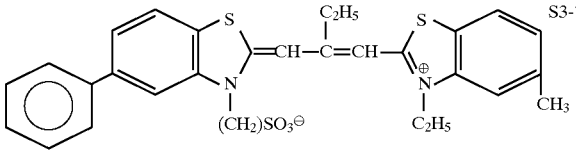
S3-8
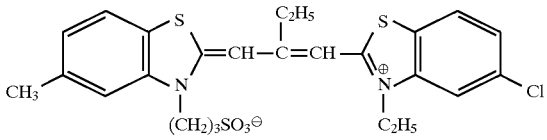
For the infrared semiconductor laser light source, the dyes described below are particularly preferred.
S4-1
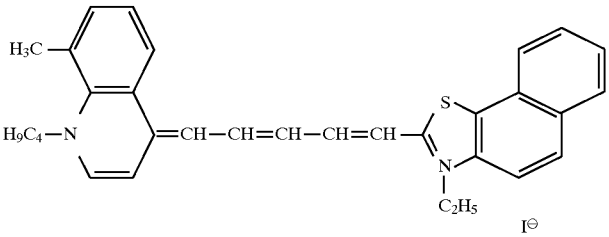

-continued
S4-2
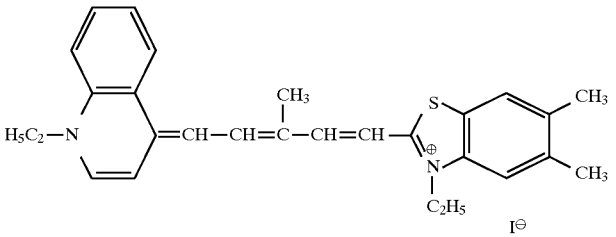
S4-3
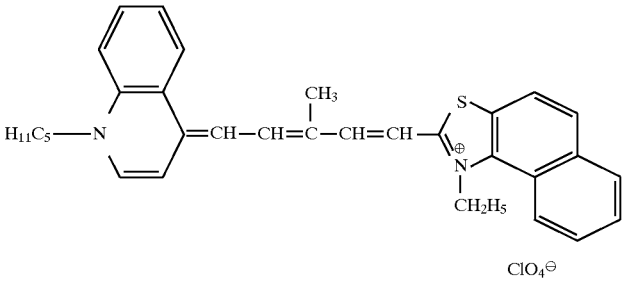
S4-4
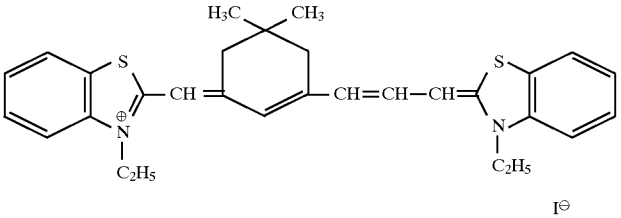
S4-5
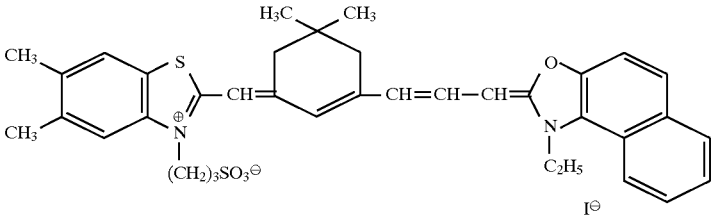
S4-6
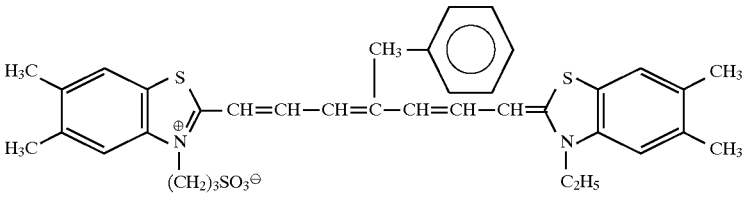
S4-7
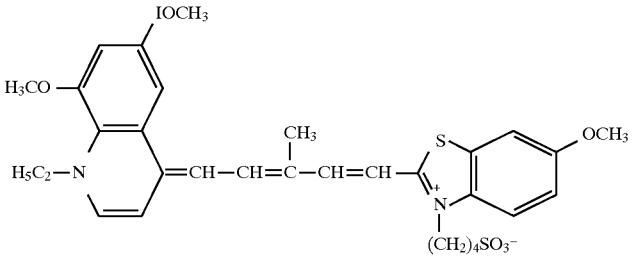

-continued
S4-8
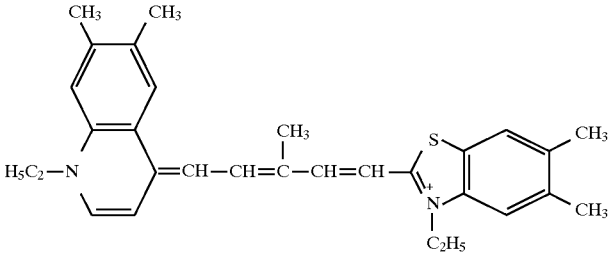
I⁻
S4-9
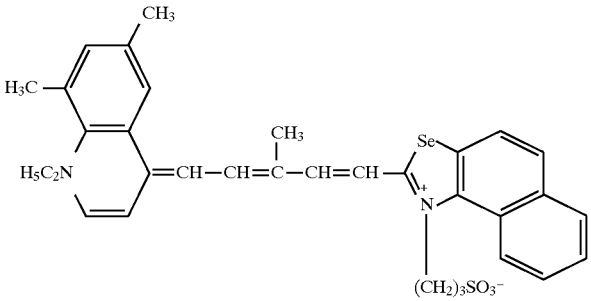
For the white light source in camera work, the sensitizing dyes represented by formula (IV) of JP-A-7-36139 are preferably used. Specific examples thereof are described below.
S5-1
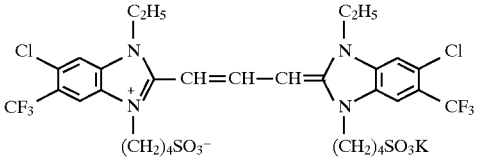
S5-2
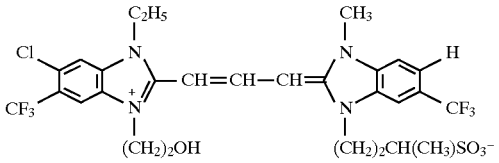
S5-3
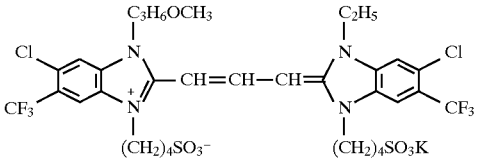
S5-4
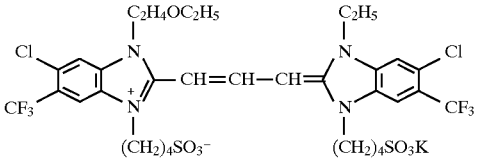
S5-5
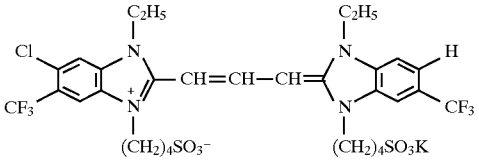
-continued
S5-6
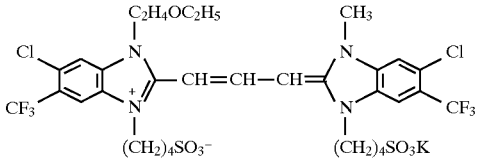
S5-7
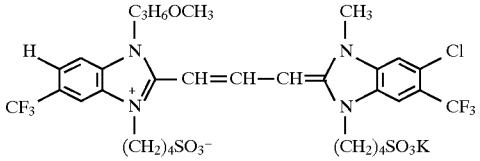
S5-8
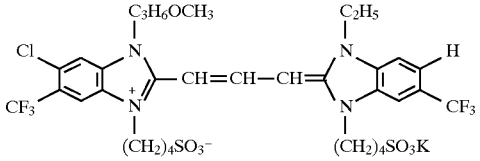
S5-9
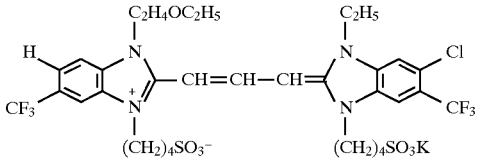
S5-10
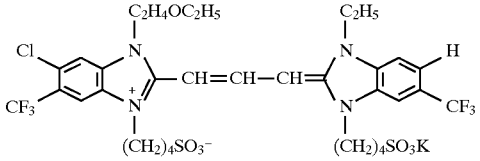
S5-11
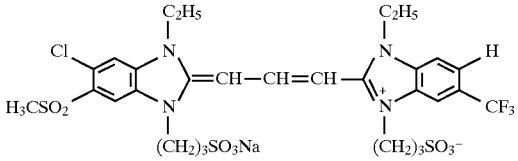

-continued

S5-12

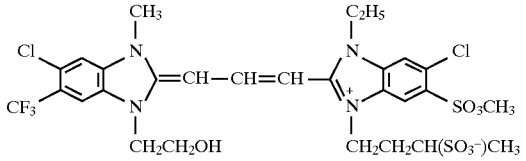

S5-13

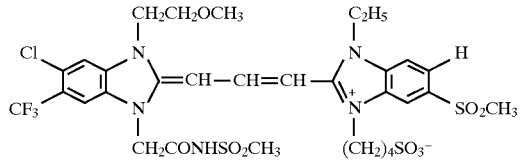

S5-14

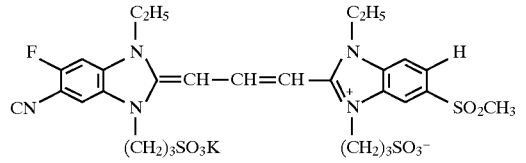

S5-15

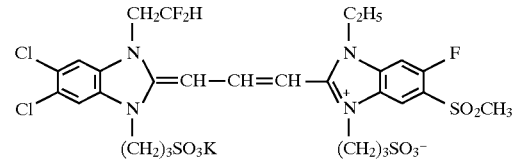

S5-16

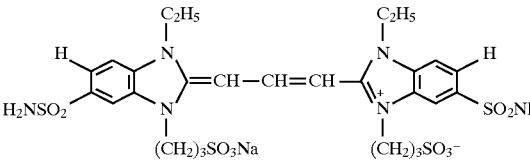

S5-17

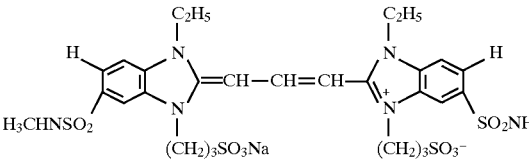

S5-18

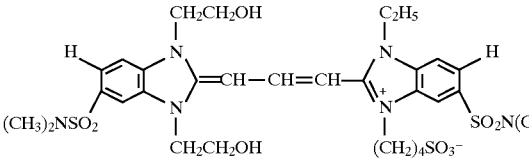

S5-19

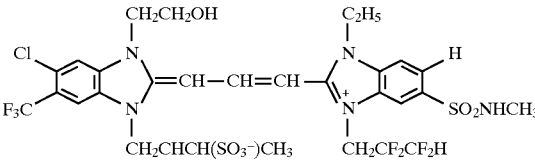

S5-20

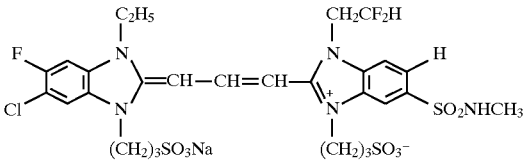

In the case of an X-ray photosensitive material, tabular silver halide emulsion is preferably used. In this case, silver bromide or silver iodobromide is preferred and the silver iodide content is preferably 10 mol % or less, more preferably from 0 to 5 mol %. This emulsion can achieve high sensitivity and is suitable for rapid processing.

In the preferred grain form of the tabular silver halide emulsion, the aspect ratio is from 4 to less than 20, more preferably from 5 to less than 10. The grain thickness if preferably 0.3 μm or less, more preferably 0.2 μm or less. The aspect ratio of the tabular silver halide emulsion is the ratio of an average of diameters of circles each having an area equal to the area of individual tabular grains, to an average of thicknesses of individual tabular grains.

The tabular grains are preferably present at a proportion of 80 wt %, more preferably 90 wt % or more, of all grains in the tabular silver halide emulsion.

By using the tabular silver halide emulsion, stability of photographic properties can be further increased in the running processing according to the present invention. Further, the coated silver amount can be reduced and accordingly, the load in the fixing step and the drying step is lightened, whereby rapid processing can be achieved.

The tabular silver halide emulsion is described in Cugnac and Chateau, *Evolution of the Morphology of Silver Bromide Crystals during Physical Ripening*, Vol. 33, No. 2, pp. 121–125, Science et Industrie Photography (1962), Duffin, *Photographic Emulsion Chemistry*, The Focal Press, New York, pp. 66–72 (1966), A. P. H. Tribvlli and W. F. Smith, *Photographic Journal*, Vol. 80, page 285 (1940), and can be easily prepared by referring to the methods described in JP-A-58-127921, JP-A-58-113927 and JP-A-58-113928.

The tabular silver halide emulsion can also be obtained by forming seed crystals where tabular grains are present at a proportion of 40 wt % or more in an atmosphere of relatively low pBr value of 1.3 or less and growing the seed crystals by simultaneously adding silver and a halogen solution while keeping the pBr value on the order of the same value.

In the process of grain formation, silver and a halogen solution are preferably added so that new crystal nuclei are not generated.

The size of tabular silver halide grains can be adjusted by controlling the temperature, selecting the kind and the amount of solvent or controlling the addition rate of silver salt and halide used in the growth of grains.

In the present invention, a tetrazolium compound, a hydrazine compound or a nucleation accelerator may be added.

As the hydrazine derivative for use in the present invention, the compound represented by formula (I) of JP-A-7-287335 (corresponding to EP 670516A) is preferred and specifically, Compounds I-1 to I-53 may be used.

In addition, the following hydrazine derivatives may be preferably used.

The compound represented by (Chem. 1) of JP-B-6-77138, specifically, compounds described at pages 3 and 4; the compound represented by formula (I) of JP-B-6-93082, specifically, Compounds 1 to 38 described at pages 8 to 18; the compounds represented by formulae (4), (5) and (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40; the compounds represented by formulae (1) and (2) of JP-A-6-289520, specifically, Compounds 1-1) to 1-17) and 2-1) described at pages 5 to 7; the compounds represented by (Chem. 2) and (Chem. 3) of JP-A-6-313936, specifically, compounds described at pages 6 to 19; the compound represented by (Chem. 1) of JP-A-6-313951, specifically, compounds described at pages 3 to 5; the compound represented by formula (I) of JP-A-7-5610, specifically, Compounds I-1 to I-38 described at pages 5 to 10; the compound represented by formula (II) of JP-A-7-77783, specifically, Compounds II-1 to II-102 described at pages 10 to 27; and the compounds represented by formulae (H) and (Ha) of JP-A-7-104426, specifically, Compounds H-1 to H-44 described at pages 8 to 15.

With respect to the addition method and the addition amount of the hydrazine derivative, and the layer where the hydrazine derivative is added, JP-A-7-287335 (corresponding to EP 670516A) (supra) may be referred to.

The photographic emulsion of the present invention may contain various compounds so as to prevent reduction in the sensitivity or generation of fogging, during preparation, storage or processing of the silver halide photographic photosensitive material. More specifically, a compound known as an antifoggant or a stabilizer may be added and examples thereof include a large number of compounds such as azoles (e.g., benzothiazolium salt), nitroindazoles, chlorobenzimidazoles, bromobenzimidazoles, mercaptotetrazoles, mercaptothiazoles, mercaptobenzothiazoles, mercaptothiadiazoles, aminotriazoles, benzothiazoles and nitrobenzotriazoles; mercaptotriazines; thioketo compounds (e.g., oxazolinethione); azaindenes (e.g., triazaindenes, tetrazaindenes (in particular, 4-hydroxy-substituted (1,3,3a,7)-tetrazaindenes) and pentazaindenes); benzenethiosulfonic acids; benzenesulfinic acids; and benzenesulfonic acid amides. Among these, preferred are benzotriazoles (e.g., 5-methylbenzotriazole) and nitroindazoles (e.g., 5-nitroindazole). This compound may also be incorporated into a processing solution. Further, the photographic emulsion may contain a compound which releases a inhibitor into the developer described in JP-A-62-30243, as a stabilizer or for the purpose of preventing black peppers.

A technique for incorporating a polymer latex into the silver halide emulsion or the backing layer to improve dimensional stability may also be used. This technique is described, for example, in JP-B-39-4272, JP-B-39-17702 and JP-B-43-13482. For the purpose of achieving dimensional stability, in addition, the photographic emulsion may contain a water-insoluble or difficultly soluble synthetic polymer dispersion. For example, polymers comprising as a monomer component alkyl (meth)acrylate, alkoxyacryl (meth)acrylate, glycidyl (meth)acrylate, individually or in combination, or a mixture thereof with an acrylic acid or a methacrylic acid may be used.

The photographic photosensitive material of the present invention may contain in the emulsion layer a polymer or an emulsified product such as alkyl acrylate latex or a plasticizer such as polyols (e.g., trimethylpropane) so as to improve pressure property.

The photosensitive material prepared according to the present invention may contain in the photographic emulsion layer or other hydrophilic colloid layer various surface active agents as a coating aid or for the purposes of electrification inhibition, improvement of slipperiness, emulsion dispersion, prevention of adhesion or improvement of photographic characteristics (e.g., development acceleration, high contrast, sensitization).

Examples thereof include nonionic surface active agents such as saponin (steroid-base), alkylene oxide derivatives (e.g., polyethylene glycol, polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, polyethylene oxide adducts of silicone), glycidol derivatives (e.g., alkenylsuccinic polyglyceride, alkylphenol polyglyceride), fatty acid esters of polyhydric alcohols and alkyl esters of saccharide; anionic surface active agents containing an acidic group such as a carboxy group, a sulfo group, a phospho group, a sulfuric ester group or a phosphoric ester group, such as alkyl carboxylate, alkyl sulfonate, alkylbenzenesulfonate, alkylnaphthalenesulfonate, alkylsulfuric esters, alkylphosphoric esters, N-acyl-N-alkyltaurines, sulfosuccinic esters, sulfoalkylpolyoxyethylene alkylphenyl ethers and polyoxyethylene alkylphosphoric esters; amphoteric surface active agents such as amino acids, aminoalkylsulfonic acids, aminoalkylsulfuric esters, aminoalkylphosphoric esters, alkylbetaines and aminoxides; and cationic surface active agents such as alkylamine salts, aliphatic and aromatic quaternary ammonium salts, heterocyclic quaternary ammonium salts such as pyridinium and imidazolium, aliphatic or heterocyclic ring-containing phosphonium salts, and aliphatic or heterocyclic ring-containing sulfonium salts.

The silver halide photographic photosensitive material for use in the present invention comprises a support having thereon at least one silver halide emulsion layer, however, in the case of a direct medical X-ray photosensitive material, as described in JP-A-58-127921, JP-A-59-90841, JP-A-58-111934 and JP-A-61-201235, at least one silver halide emulsion layer is preferably provided on both surfaces of the support.

In addition, the photographic material of the present invention may have, if desired, an interlayer, a filter layer, an antihalation layer and the like.

The silver amount of the photosensitive material for use in the present invention is preferably from 0.5 to 5 $g/m^2$ (per one surface), more preferably from 1 to 4 $g/m^2$ (per one surface).

In view of suitability for rapid processing, the silver amount preferably does not exceed 5 $g/m^2$ and in order to obtain constant image density and contrast, the silver amount is preferably 0.5 $g/m^2$ or more.

Gelatin is used as a binder in the photosensitive material for use in the present invention, however, hydrophilic colloid such as a gelatin derivative, a cellulose derivative, a graft polymer of gelatin to other polymer, a protein other than these, a saccharide derivative and a synthetic hydrophilic polymer material such as a homopolymer or a copolymer, may be used in combination.

As the bonder or protective colloid of the photographic emulsion, gelatin is advantageously used, however, other hydrophilic colloid may be used and examples thereof include gelatin derivatives, graft polymers of gelatin to other polymer, proteins such as albumin and casein, cellulose derivatives such as hydroxyethyl cellulose, carboxymethyl cellulose and cellulose sulfuric esters, saccharide derivatives such as sodium alginate and starch derivative, and various synthetic hydrophilic polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole.

The gelatin may be a lime-processed gelatin or an acid-processed gelatin, and a hydrolyzate or an enzymolyzate of gelatin may also be used.

The X-ray photosensitive material preferably contains in the emulsion layer or other hydrophilic colloid layer an organic substance which dissolves out during development processing. When the substance which dissolves out is gelatin, the gelatin is preferably such a type as not to participate in the cross-linking reaction of gelatin by a hardening agent, and examples thereof include acetylated gelatin and phthalated gelatin. This gelatin preferably has a small molecular weight. Effective examples of the polymer material other than gelatin include hydrophilic polymers such as polyacrylamide described in U.S. Pat. No. 3,271,158, polyvinyl alcohol and polyvinyl pyrrolidone, and saccharides such as dextran, saccharose, pullurane are also effective. Among these, polyacrylamide and dextran are preferred and polyacrylamide is more preferred. This polymer material has an average molecular weight of preferably 20,000 or less, more preferably 10,000 or less. The effective outflow on processing is from 10 to 50%, preferably from 15 to 30%, of the total weight of organic materials coated other than silver halide grains.

The organic material to be dissolved out on processing may be added to either an emulsion layer or a surface protective layer, however, if the total coated weight of the above-described organic material is the same, it is preferably incorporated into both a surface protective layer and an emulsion layer rather than into only an emulsion layer, more preferably incorporated into only a surface protective layer. In the case of a photosensitive material comprising multilayer structure emulsion layers, if the coated total amount of the above-described organic material is the same, it is preferably added in a larger amount to the emulsion layer closer to the surface protective layer.

As the matting agent, fine particles of an organic compound such as a polymethyl methacrylate homopolymer, a methyl methacrylate/methacrylic acid copolymer or starch as described in U.S. Pat. Nos. 2,992,101, 2,701,245, 4,142, 894 and 4,396,706, or of an inorganic compound such as silica, titanium dioxide, ballium strontium sulfate may be used. The particle size is preferably from 1.0 to 10 $\mu$m, more preferably from 2 to 5 $\mu$m.

In the silver halide photographic photosensitive material of the present invention, a photographic layer or other layer may be colored by a dye for the purpose of absorbing light in a specific wavelength region, in other words, for preventing halation or irradiation, or to provide a filter layer for controlling spectral composition of light entering into the photographic emulsion layer. In the case of a double emulsion film such as direct, medical Roentgen film, a layer for the purpose of crossover cut may be provided under an emulsion layer. Examples of the dye used to this effect include an oxonol dye having a pyrazolone nucleus or a barbituric acid nucleus, a hemioxonol dye, an azo dye, an azomethine dye, an anthraquinone dye, an arylidene dye, a styryl dye, a triarylmethane dye, a merocyanine dye and a cyanine dye.

Among these, a oxonol dye, a hemioxonol dye and a merocyanine dye are useful. Specific example thereof are described in West German Patent 616,007, British Patents 584,609 and 1,117,429, JP-B-26-7777, JP-B-39-22069, JP-B-54-38129, JP-A-48-85130, JP-A-49-99620, JP-A-49-114420, JP-A-49-129537, *PB Report* 74175 and *Photo. Abst.* 128 ('21). These dyes are suitably used particularly in the photosensitive material for dot-to-dot work in a bright room. Further, solid fine particle dispersion of dyes described in JP-A-7-168311 may be used. In the silver halide photographic photosensitive material according to the present invention, when a dye or an ultraviolet absorbent is incorporated into a hydrophilic colloid layer, it may be mordanted by a cationic polymer or the like.

In using the above-described dye, to mordant an anionic dye to a specific layer of the photosensitive material using a polymer having a cationic site is an effective technique. In this case, it is preferred to use a dye which is irreversibly decolored in the development-fixing-water washing process. The layer to be mordanted by a dye using a polymer having a cation site may be in an emulsion layer or on the surface of a surface protective layer opposite to the emulsion layer through a support, however, it is preferably between an emulsion layer and a support. In particular, for the purpose of crossover cut of a medical X-ray double emulsion film, the dye is ideally mordanted to an undercoat layer.

As the coating aid of the undercoat layer, a polyethylene oxide-base nonionic surface active agent is preferably used in combination with the polymer having a cation site.

The polymer which offers a cation site is preferably an anion conversion polymer.

Examples of the anion conversion polymer include various known quaternary ammonium salt (or phosphonium salt) polymers. The quaternary ammonium salt (or phosphonium salt) polymer is broadly known as a mordant polymer or an antistatic agent polymer.

Examples thereof include water dispersion latexes described in JP-A-59-166940, U.S. Pat. No. 3,958,995, JP-A-55-142339, JP-A-54-126027, JP-A-54-155835, JP-A-53-30328 and JP-A-54-92274; polyvinyl pyridinium salts described in U.S. Pat. Nos. 2,548,564, 3,148,061 and 3,756, 814; water-soluble quaternary ammonium salt polymers described in U.S. Pat. No. 3,709,690; and water-insoluble quaternary ammonium salt polymers described in U.S. Pat. No. 3,898,088.

Further, in order to prevent transfer of the dye from a desired layer to other layer or the processing solution to adversely affect the photographic properties, a cross-linked aqueous polymer latex obtained by copolymerizing a monomer having at least two or more (preferably from 2 to 4) ethylenically unsaturated groups, is preferably used.

To immobilize the dye, a solid dispersion method described in JP-A-55-155350 or WO88/04794 is also effective.

The photographic photosensitive material of the present invention may contain a developing agent such as a hydroquinone derivative or a phenidone derivative for various purposes, for example, as a stabilizer or an accelerator.

The photographic photosensitive material of the present invention may contain in the photographic emulsion layer or other hydrophilic colloid layer an inorganic or organic hardening agent. Examples thereof include chromium salts (e.g., chromium alum, chromium acetate), aldehydes (e.g., formaldehyde, glutaraldehyde), N-methylol compounds (e.g., dimethylolurea), dioxane derivatives, active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine) and mucohalogen acids (e.g., mucochloric acid), and these may be used either individually or in combination.

The photographic photosensitive material of the present invention may contain in a photographic emulsion layer or other hydrophilic colloid layer, a hydroquinone derivative which releases a development inhibitor (so-called DIR-hydroquinone) in correspondence with the density of an image at the time of development.

Specific examples thereof include the compounds described in U.S. Pat. Nos. 3,379,529, 3,620,746, 4,377,634 and 4,332,878, JP-A-49-129536, JP-A-54-67419, JP-A-56-153336, JP-A-56-153342, JP-A-59-278853, JP-A-59-90435, JP-A-59-90436 and JP-A-59-138808.

The photographic photosensitive material of the present invention preferably contains in a silver halide emulsion layer or other layer a compound having an acid radical. Examples of the compound having an acid radical include organic acids such as salicylic acid, acetic acid and ascorbic acid, and homopolymers and copolymers having a repeating unit of an acid monomer such as acrylic acid, maleic acid or phthalic acid. These compounds are described in JP-A-61-223834, JP-A-61-228437, JP-A-62-25745 and JP-A-62-55642. Among these compounds, more preferred are, as a low molecular compound, an ascorbic acid, and as a high molecular compound, a water dispersing latex of a copolymer comprising an acid monomer such as acrylic acid and a cross-linking monomer having two or more unsaturated groups, such as divinylbenzene.

The thus produced silver halide emulsion is coated on a support such as cellulose acetate film or polyethylene terephthalate film, by a dip coating method, an air knife coating method, a bead coating method, an extrusion doctor coating method or a double-side coating method, and then dried.

The present invention can be applied also to a color photosensitive material. In this case, various color couplers may be used. The term "color coupler" as used herein means a compound capable of forming a dye upon coupling reaction with an oxidation product of an aromatic primary amine developing agent. Typical examples of useful color couplers include naphthol- and phenol-base compounds, pyrazolone- and pyrazoloazole-base compounds, and open chain or heterocyclic ketomethylene compounds. Specific examples of the cyan, magenta and yellow couplers which can be used in the present invention are described in the patents cited in *Research Disclosure* (*RD*), 17643, Item VII-D (December 1978) and ibid., 18717 (November 1979).

Various additives for use in the photosensitive material of the present invention are not particularly limited and, for example, those described below may be preferably used:

| Items | Pertinent Portions |
|---|---|
| 1) Nucleation accelerator | Compounds represented by formulae (I), (II), (III), (IV), (V) and (VI) of JP-A-6-82943; compounds represented by formulae (II-m) to (II-p) of JP-A-2-103536, from page 9, right upper column, line 13 to page 16, left upper column, line 10, and Compounds II-1 to II-22; and compounds described in JP-A-1-179939. |
| 2) Spectral sensitizing dye | Spectral sensitizing dyes described in JP-A-2-12236, page 8, from left lower column, line 13 to right lower column, line 4, JP-A-2-103536, from page 16, right lower column, line 3 to page 17, left lower column, line 20, JP-A-1-112235, JP-A-2-124560 and JP-A-3-7928, JP-A-5-11389. |
| 3) Surface Active agent | Compounds described in JP-A-2-12236, page 9, right upper column, line 7 to right lower column, line 7, and JP-A-2-18542, from page 2, left lower column, line 13 to page 4, right lower column, line 18. |
| 4) Antifoggant | Compounds described in JP-A-2-103536, from page 17, right lower column, line 19 to page 18, right upper column, line 4 and right lower column lines 1 to 5; and thiosulfinic acid compounds described in JP-A-1-237538. |
| 5) Polymer latex | Compounds described in JP-A-2-103536, page 18, left lower column, lines 12 to 20. |
| 6) Compound having acid radical | Compounds described in JP-A-2-103536, from page 18, right lower column, line 6 to page 19, left upper column, line 1. |
| 7) Matting agent, slipping agent and plasticizer | Compounds described in JP-A-2-103536, page 19, from left upper column, line 15 to right upper column, line 15. |
| 8) Hardening agent | Compounds described in JP-A-2-103536, page 18, right upper column, lines 5 to 17. |
| 9) Dye | Dyes described in JP-A-2-103536, page 17, right lower column, lines 1 to 18; and solid dyes described in JP-A-2-294638 and JP-A-5-11382. |
| 10) Binder | Compounds described in JP-A-2-18542, page 3, right lower column, lines 1 to 20. |
| 11) Black pepper inhibitor | Compounds described in U.S. Pat. 4,956,257 and JP-A-1-118832. |
| 12) Redox compound | Compounds represented by formula (I) of JP-A-2-301743 (particularly Compounds 1 to 50); compounds represented by formulae (R-1), (R-2) and (R-3) of JP-A-3-174143, pages 3 to 20, and Compounds 1 to 75; compounds described in JP-A-5-257239 and JP-A-4-278939. |
| 13) Monomethine compounds | Compounds represented by formula (II) of JP-A-2-287532 (Compounds II-1 to II-26). |
| 14) Dihydroxybenzenes | Compounds described in JP-A-3-39948, from page 11, left upper column to page 12, left lower column, and EP 452772A. |

EXAMPLES

Photosensitive Materials (1-1) to (1-4) used in Examples were prepared as follows.

Production of Photosensitive Material (1-1):

Emulsion A was prepared as follows.

To Solution 1 shown in Table 1 kept at 38° C. and having a pH of 4.5, Solution 2 and Solution 3 were simultaneously added while stirring over 24 minutes to form grains having a size of 0.18 μm. Subsequently, Solution 4 and Solution 5 shown in Table 1 were added over 8 minutes and then 0.15 g of potassium iodide was added to complete grain formation.

Thereafter, the grains were washed with water by flocculation in a usual manner, gelatin was added, the pH and the pAg were adjusted to 5.2 and 7.5, respectively, and thereto 4 mg of sodium thiosulfate, 2 mg of N,N-dimethylselenourea, 10 mg of chloroauric acid, 4 mg of sodium benzenethiosulfonate and 1 mg of sodium benzenethiosulfinate were added to perform chemical sensitization so as to have an optimal sensitivity at 55° C.

Further, 50 mg of 2-methyl-4-hydroxy-1,3,3a,7-tetraazaindene as a stabilizer and phenoxy ethanol as an antiseptic in an amount of giving a coverage of 100 ppm were added. The grains finally obtained were silver iodochlorobromide cubic grains having a silver chloride content of 80 mol % and an average grain size of 0.20 μm (coefficient of variation: 9%).

| Solution 1: | |
|---|---|
| Water | 1.0 l |
| Gelatin | 20 g |
| Sodium chloride | 2 g |
| 1,3-Dimethylimidazolidine-2-thione | 20 mg |
| Sodium benzenethiosulfonate | 3 mg |
| Solution 2: | |
| Water | 600 ml |
| Silver nitrate | 150 g |

-continued

| | |
|---|---|
| Solution 3: | |
| Water | 600 ml |
| Sodium chloride | 45 g |
| Potassium bromide | 21 g |
| Potassium hexachloroiridate (III) (0.001% aq. soln.) | 15 ml |
| Ammonium hexabromorhodate (III) (0.001% aq. soln.) | 1.5 ml |
| Solution 4: | |
| Water | 200 ml |
| Silver nitrate | 50 g |
| Solution 5: | |
| Water | 200 ml |
| Sodium chloride | 15 g |
| Potassium bromide | 7 g |
| $K_4Fe(CN)_6$ | 30 mg |

Preparation of Silver Halide Photographic Photosensitive Material:

On a polyethylene terephthalate film having a moisture-proofing undercoat layer containing vinylidene chloride, the UL, EM, PC and OC layers were coated to prepare a sample having a layer structure of UL, EM, PC and OC in this order from the support side.

The preparation method and the coating amount of each layer are described below.

UL Layer:

To an aqueous gelatin solution, 30 wt %, based on gelatin, of polyethylacrylate dispersion was added and the resulting solution was coated to have a gelatin coverage of 0.5 g/m$^2$.

EM Layer:

To Emulsion A prepared above, $2.5\times10^{-4}$ mol/mol-Ag of Compound (S-1) shown below as a sensitizing dye was added and further, $3\times10^{-4}$ mol/mol-Ag of a mercapto compound shown below as Compound (a), $3\times10^{-3}$ mol/mol-Ag of KBr, $7.0\times10^{-4}$ mol/mol-Ag of 4-hydroxy-6-methyl-1,3,3a,7-tetrazaindene, 4×10–4 mol/mol-Ag of a mercapto compound shown below as Compound (b), $4\times10^{-4}$ mol of a triazine compound shown below as Compound (c), $2\times10^{-3}$ mol/mol-Ag of 5-chloro-8-hydroxyquinoline, $7.0\times10^{-5}$ mol/mol-Ag of Nucleating Agent (HZ-1) (hydrazine derivative), $4.2\times10^{-4}$ mol/mol-Ag of Nucleation Accelerator (AC-1), $9\times10^{-3}$ mol/mol-Ag of sodium p-dodecylbenzenesulfonate and $3\times10^{-2}$ mol/mol-Ag of hydroquinone were added. Furthermore, 200 mg/m$^2$ of a polyethyl acrylate dispersion, 200 mg/m$^2$ of a latex copolymer of methyl acrylate, sodium 2-acrylamide-2-methylpropanesulfonate and 2-acetoacetoxyethyl methacrylate (weight ratio: 88:5:7), 200 mg/m$^2$ of colloidal silica having an average particle size of 0.02 $\mu$m and 200 mg/m$^2$ of compound (d) as a hardening agent were added. The resulting mixed solution was coated to have a coated silver amount of 3.5 g/m$^2$. The finished solution had a pH of 5.7.

PC Layer:

To an aqueous gelatin solution, 50 wt %, based on gelatin, of an ethyl acrylate dispersion, Surface Active Agent (e) shown below in an amount of giving a coverage of 5 mg/m$^2$ and 1,5-dihydroxy-2-benzaldoxime in an amount of giving a coverage of 10 mg/m$^2$ were added, and the resulting solution was coated to have a gelatin coverage of 0.5 g/m$^2$.

OC Layer:

Gelatin (0.5 g/m$^2$), 40 mg/m$^2$ of an amorphous $SiO_2$ matting agent having an average particle size of about 3.5 $\mu$m, 0.1 g/m$^2$ of methanol silica, 100 mg/m$^2$ of polyacrylamide, 20 mg/m$^2$ of silicone oil, and as coating aids, 5 mg/m$^2$ of a fluorine surface active agent shown below by structural formula (f), 10 mg/m$^2$ of sodium dodecylbenzenesulfonate and 20 mg/m$^2$ of a compound shown below by structural formula (g) were coated.

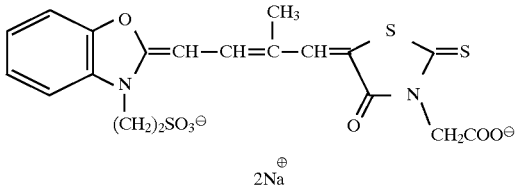
(S-1)

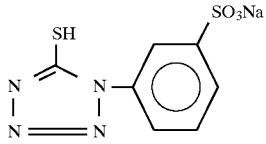
(a)

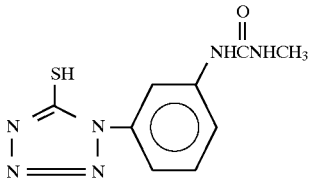
(b)

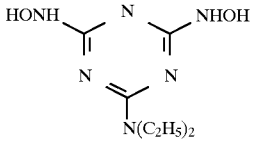
(c)

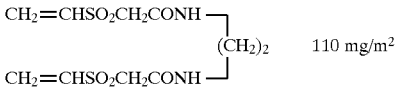
(d)

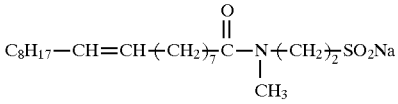
(e)

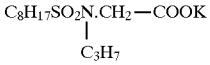
(f)

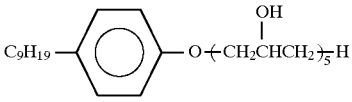
(g)

-continued

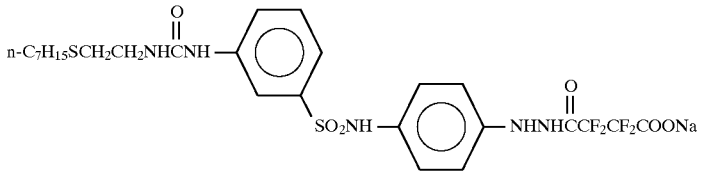

H-1

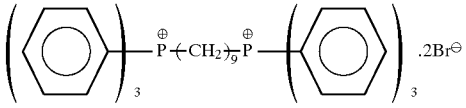

AC-1

The thus-obtained coated sample had a back layer and a back protective layer having the following compositions.

| Formulation of Back Layer: | |
|---|---|
| Gelatin | 3 g/m$^2$ |
| Latex: polyethyl acrylate | 2 g/m$^2$ |
| Surface active agent: | 40 mg/m$^2$ |
| Sodium p-dodecylbenzenesulfonate | |
| Hardening agent: Compound (d) shown below | 200 mg/m$^2$ |
| $SnO_2$/Sb | 200 mg/m$^2$ |
| (weight ratio: 90/10, average particle size: 0.20 $\mu$m) | |
| Dye: Mixture of Dye [a], Dye [b] and Dye [c] | |
| Dye [a] 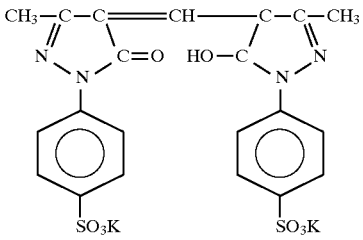 | 70 mg/m$^2$ |
| Dye [b] 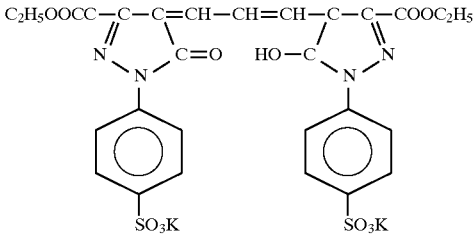 | 70 mg/m$^2$ |
| Dye [c] 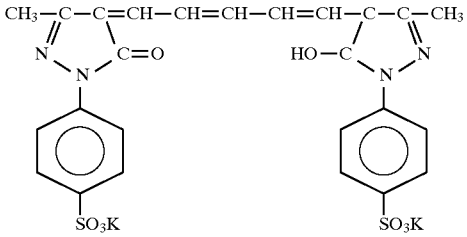 | 90 mg/m$^2$ |
| **Back Protective Layer:** | |
| Gelatin | 0.8 g/m$^2$ |
| Polymethyl methacrylate fine particles | 30 mg/m$^2$ |
| (average particle size: 4.5 $\mu$m) | |
| Sodium dihexyl-$\alpha$-sulfosuccinate | 15 mg/m$^2$ |
| Sodium p-dodecylbenzenesulfonate | 15 mg/m$^2$ |
| Sodium acetate | 40 mg/m$^2$ |

The swelling ratio ((swollen layer thickness/dry layer thickness)×100) on the side having an emulsion layer was 100.

Preparation of Photosensitive Material (1-2):

Emulsion B:

Emulsion B was prepared in the same manner as Emulsion A except for changing the amount of sodium thiosulfate added to 2 mg per mol of silver and using no selenium sensitizer.

A sample was prepared in the same manner as Photosensitive Material (1-1) except for replacing the sensitizing dyes of Photosensitive Material (1-1) by the following Sensitizing Dyes S-2 ($5\times10^{-4}$ mol/mol-Ag) and S-3 ($5\times10^{-4}$ mol/mol-Ag) and using Emulsion B as the emulsion in EM layer.

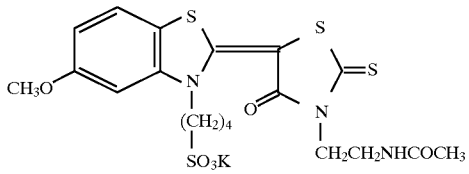

(S-2)

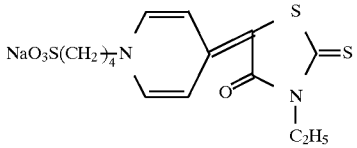

(S-3)

The swelling ratio on the side having an emulsion layer was the same as in Photosensitive Material (1-1).

Preparation of Photosensitive Material (1-3):

Emulsion C:

An aqueous 1.5% gelatin solution kept at 40° C., containing sodium chloride, $3\times10^{-5}$ mol/mol-Ag of sodium benzenesulfonate and $5\times10^{-3}$ mol/mol-Ag of 4-hydroxy-6-methyl-1,3,3a,7-tetraazaindene and having a pH of 2.0 and an aqueous sodium chloride solution containing $2.0\times10^{-6}$ mol/mol-Ag of $K_2Ru(NO)Cl_5$ were added simultaneously by a double jet method at a potential of 95 mV over 3 minutes and 30 seconds to consume a half of the silver amount of the final grain, thereby preparing core grains having a size of 0.12 μm. Thereafter, an aqueous silver nitrate solution and an aqueous sodium chloride solution containing $6.0\times10^{-6}$ mol/mol-Ag of $K_2Ru(NO)Cl_5$ were added in the same manner as above over 7 minutes to prepare silver chloride cubic grains having an average grain size of 0.15 μm (coefficient of variation: 12%).

The grains were washed with water by a flocculation method well known in the art to remove soluble salts, then gelatin was added, 60 mg/mol-Ag of Compound A and 60 mg/mol-Ag of phenoxy ethanol as antiseptics were added, the pH and the pAg were adjusted to 5.7 and 7.5, respectively, $4\times10^{-5}$ mol/mol-Ag of chloroauric acid and $4\times10^{-5}$ mol/mol-Ag of Compound Z were added, and then $1\times10^{-5}$ mol/mol-Ag of sodium thiosulfate and $1\times10^{-5}$ mol/mol-Ag of potassium selenocyanide were added to perform chemical sensitization under heating at 60° C. for 60 minutes. Thereafter, $1\times10^{-3}$ mol/mol-Ag of 4-hydroxy-6-methyl-1,3,3a,7-tetraazaindene as a stabilizer was added. (The grains finally obtained had a pH of 5.7, a pAg of 7.5 and an Ru content of $4.0\times10^{-6}$ mol/mol-Ag.)

On the support described below, EM, PC and OC were coated in this order.

EM:

The following compounds were added to Emulsion C prepared above and a silver halide emulsion layer was coated to have a gelatin coated amount of 0.9 g/m$^2$ and a coated silver amount of 2.7 g/m$^2$.

| | |
|---|---|
| 1-Phenyl-5-mercaptotetrazole | 1 mg/m$^2$ |
| Nucleation Accelerator (AC-2) | $3.6\times10^{-3}$ mol/mol-Ag |
| N-Oleyl-N-methyltaurin sodium salt | 10 mg/m$^2$ |
| Compound B | 10 mg/m$^2$ |
| Compound C | 10 mg/m$^2$ |
| Compound D | 10 mg/m$^2$ |
| n-Butyl acrylate/2-acetoacetoxyethyl methacrylate/acrylic acid copolymer (89/8/3) | 760 mg/m$^2$ |
| Compound E (hardening agent) | 105 mg/m$^2$ |
| Sodium polystyrenesulfonate | 57 mg/m$^2$ |
| Nucleating Agent (HZ-3) | $1.2\times10^{-3}$ mol/mol-Ag |

PC:

The following compounds were added to an aqueous gelatin solution and the resulting solution was coated to give a gelatin coated amount of 0.6 g/m$^2$.

| | |
|---|---|
| Gelatin ($Ca^{++}$ content: 2,700 ppm) | 0.6 g/m$^2$ |
| Sodium p-dodecylbenzenesulfonate | 10 mg/m$^2$ |
| Sodium polystyrenesulfonate | 6 mg/m$^2$ |
| Compound A | 1 mg/m$^2$ |
| Compound F | 14 mg/m$^2$ |
| n-Butyl acrylate/2-acetoacetoxyethyl methacrylate/acrylic acid copolymer (89/8/3) | 250 mg/m$^2$ |

OC:

The following compounds were added to an aqueous gelatin solution and the resulting solution was coated to give a gelatin coated amount of 0.45 g/m$^2$.

| | |
|---|---|
| Gelatin ($Ca^{++}$ content: 2,700 ppm) | 0.45 g/m$^2$ |
| Amorphous silica matting agent (average particle size: 3.5 μm, pore diameter: 25 Å, surface area: 700 m$^2$/g) | 40 mg/m$^2$ |
| Amorphous silica matting agent (average particle size: 2.5 μm, pore diameter: 170 Å, surface area: 300 m$^2$/g) | 10 mg/m$^2$ |
| Potassium N-perfluorooctanesulfonyl-N-propylglycine | 5 mg/m$^2$ |
| Sodium p-dodecylbenzenesulfonate | 30 mg/m$^2$ |
| Compound A | 1 mg/m$^2$ |
| Liquid paraffin | 40 mg/m$^2$ |
| Solid Disperse Dye $G_1$ | 30 mg/m$^2$ |
| Solid Disperse Dye $G_2$ | 150 mg/m$^2$ |
| Sodium polystyrenesulfonate | 4 mg/m$^2$ |

Then, on the opposite surface of the support, the following electrically conductive layer and back layer were simultaneously coated.

Preparation of Coating Solution for Electrically Conductive Layer and Coating:

The following compounds were added to an aqueous gelatin solution and the resulting solution was coated to give a gelatin coated amount of 0.06 g/m$^2$.

| | |
|---|---|
| $SnO_2$/Sb (9/1 by weight, average particle size: 0.25 μm) | 186 mg/m$^2$ |
| Gelatin ($Ca^{++}$ content: 3,000 ppm) | 60 mg/m$^2$ |
| Sodium p-dodecylbenzenesulfonate | 13 mg/m$^2$ |
| Sodium dihexyl-α-sulfosuccinate | 12 mg/m$^2$ |
| Sodium polystyrenesulfonate | 10 mg/m$^2$ |
| Compound A | 1 mg/m$^2$ |

Preparation of Coating Solution for Back Layer and Coating:

The following compounds were added to an aqueous gelatin solution and the resulting solution was coated to give a gelatin coated amount of 1.94 g/m$^2$.

| | |
|---|---|
| Gelatin (Ca++ content: 30 ppm) | 1.94 g/m$^2$ |
| Polymethyl methacrylate fine particles (average particle size: 3.4 $\mu$m) | 15 mg/m$^2$ |
| Compound H | 140 mg/m$^2$ |
| Compound I | 140 mg/m$^2$ |
| Compound J | 30 mg/m$^2$ |
| Compound K | 40 mg/m$^2$ |
| Sodium p-dodecylbenzenesulfonate | 7 mg/m$^2$ |
| Sodium dihexyl-$\alpha$-sulfosuccinate | 29 mg/m$^2$ |
| Compound L | 5 mg/m$^2$ |
| Potassium N-perfluorooctanesulfonyl-N-propylglycine | 5 mg/m$^2$ |
| Sodium sulfate | 150 mg/m$^2$ |
| Sodium acetate | 40 mg/m$^2$ |
| Compound E (hardening agent) | 105 mg/m$^2$ |

Support and Undercoat Layer:

An undercoat first layer and an undercoat second layer each having the following composition were coated on both surfaces of a biaxially stretched polyethylene terephthalate support (thickness: 100 $\mu$m).

| Undercoat First Layer: | |
|---|---|
| Core-shell type vinylidene chloride copolymer (1) | 15 g |
| 2,4-Dichloro-6-hydroxy-s-triazine | 0.25 g |
| Polystyrene fine particles (average particle size: 3 $\mu$m) | 0.05 g |
| Compound M | 0.20 g |
| Colloidal silica (Snowtex ZL, produced by Nissan Chemical KK, particle size: 70 to 100 $\mu$m) | 0.12 g |
| Water to make | 100 g |

The resulting coating solution was adjusted to have a pH of 6 by adding 10 wt % of KOH and coated at a drying temperature of 180° C. within 2 minutes to give a dry thickness of 0.9 $\mu$m.

| Undercoat Second Layer: | |
|---|---|
| Gelatin | 1 g |
| Methyl cellulose | 0.05 g |
| Compound N | 0.02 g |
| $C_{12}H_{25}O(CH_2CH_2O)_{10}H$ | 0.03 g |
| Compound A | $3.5 \times 10^{-3}$ g |
| Acetic acid | 0.2 g |
| Water to make | 100 g |

The resulting coating solution was coated at a drying temperature of 170° C. within 2 minutes to give a dry thickness of 0.1 $\mu$m, thereby preparing a sample.

The swelling ratio on the side having an emulsion layer was 100.

Compound A

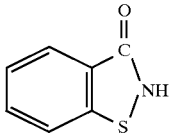

-continued

Compound B

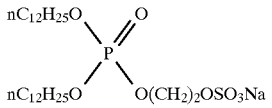

Compound C

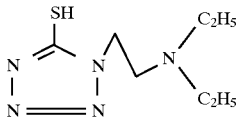

Compound D

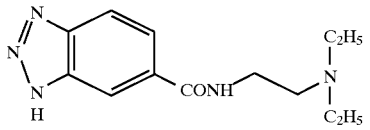

Compound E

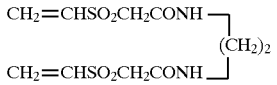

Compound F

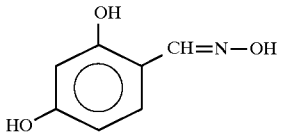

Solid Disperse Dye $G_1$

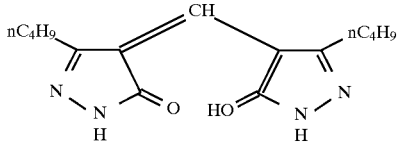

Solid Disperse Dye $G_2$

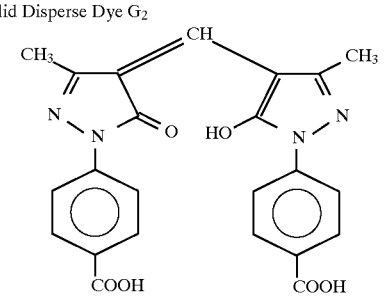

AC-2

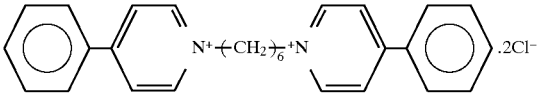

-continued

H-2

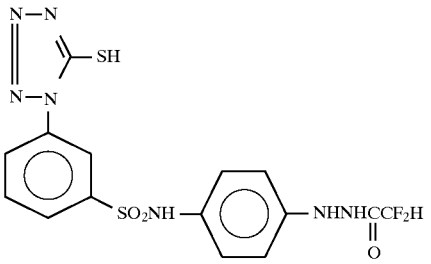

Compound H

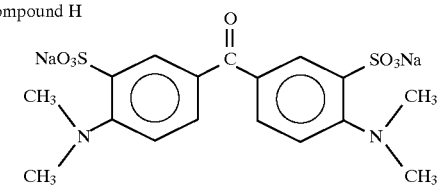

Compound I

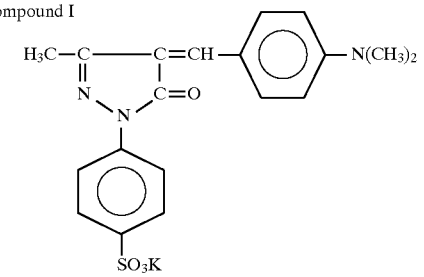

Compound J

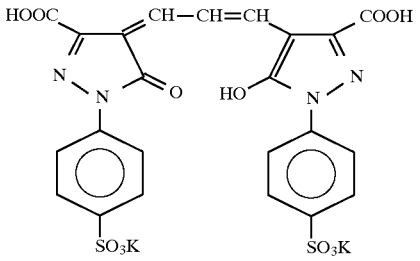

Compound K

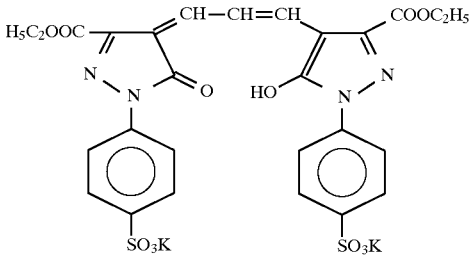

Compound L $C_8F_{17}SO_3Li$

-continued

Core-shell-type vinylidene chloride copolymer (1)

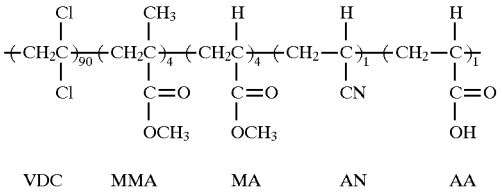

VDC MMA MA AN AA

Core: VDC/MMA/MA (80 wt%)
Shell: VDC/AN/AA (20 wt%)
Average grain size: 70 nm

Compound M

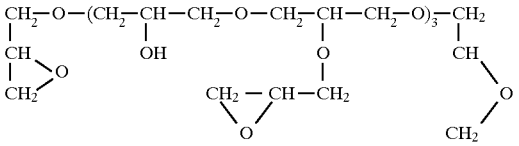

Compound N

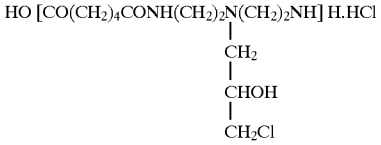

Compound Z

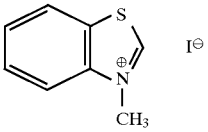

Preparation of Photosensitive Material (1-4):

Emulsion D:

An aqueous silver nitrate solution (250 ml) having dissolved therein 64 g of silver nitrate and 250 ml of an aqueous halogen salt solution containing $K_2Rh(H_2O)Cl_5$ corresponding to $1\times10^{-7}$ mol per mol of silver in the entire emulsion, $K_3IrCl_6$ corresponding to $2\times10^{-7}$ mol per mol of silver in the entire emulsion, 20 g of potassium bromide and 14 g of sodium chloride were added to a 2% aqueous gelatin solution containing sodium chloride (0.3%), 1,3-dimethyl-2-imidazolithione (0.002%) and a citric acid (0.05%), while stirring at 38° C. by a double jet method over 12 minutes to obtain silver chlorobromide grains having an average grain size of 0.16 $\mu$m and a silver chloride content of 55 mol %, thereby performing nucleation. Subsequently, 300 ml of an aqueous silver nitrate solution having dissolved therein 106 g of silver nitrate and 300 ml of an aqueous halogen salt solution having dissolved therein 28 g of potassium bromide and 26 g of sodium chloride were added by a double jet method over 20 minutes to perform grain formation.

Thereafter, $1\times10^{-3}$ mol/mol-Ag of a KI solution was added to perform conversion and the grains were washed with water by flocculation in a usual manner. Thereto, 40 g/mol-Ag of gelatin was added, the pH and the pAg were adjusted to 5.9 and 7.5, respectively, and then 3 mg/mol-Ag of sodium benzenethiosulfonate, 1 mg/mol-Ag of sodium benzenesulfinate, 2 mg of sodium thiosulfate, 2 mg of a compound shown below by structural formula (h) and 8 mg of chloroauric acid were added to perform chemical sensitization under heating at 60° C. for 70 minutes. Then, 150 mg of 4-hydroxy-6-methyl-1,3,3a,7-tetraazaindene as a stabilizer and 100 mg of proxel as an antiseptic were added. Thereafter, 400 mg of a dye shown below by structural formula (i) was added and after 10 minutes, the temperature was lowered. The grains obtained were silver iodochlorobromide cubic grains having an average grain size of 0.22 μm and a silver chloride content of 60 mol % (coefficient of variation: 10%).

Preparation of Coating Solution for Emulsion Layer:

To the thus-obtained emulsion, $2\times10^{-4}$ mol/mol-Ag of a short wave cyanine dye shown below by structural formula (j), $5\times10^{-3}$ mol/mol-Ag of potassium bromide, $2\times10^{-4}$ mol/mol-Ag of 1-phenyl-5-mercaptotetrazole, $2\times10^{-4}$ mol/mol-Ag of a mercapto compound shown below by structural formula (k), $3\times10^{-4}$ mol/mol-Ag of a triazine compound shown below by structural formula (1), $6\times10^{-4}$ mol/mol-Ag of Nucleation Accelerator (AC-1) and $2\times10^{-4}$ mol/mol-Ag of Nucleating Agent (HZ-2) were added, and further hydroquinone, sodium p-dodecylbenzenesulfonate, colloidal silica (Snowtex C, produced by Nissan Chemical KK), a polyethyl acrylate dispersion and 1,2-bis(vinylsulfonylacetamido)ethane were added to give a coated amount of 100 mg/m$^2$, 10 mg/m$^2$, 150 mg/m$^2$, 500 mg/M$^2$ and 80 mg/M$^2$, respectively, to prepare a coating solution for the emulsion layer. The coating solution was adjusted to have a pH of 5.6.

(h)

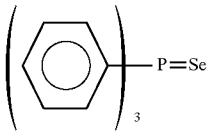

(i)

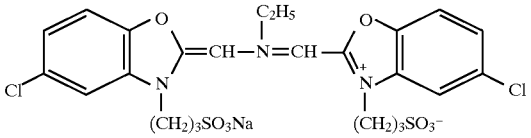

(j)

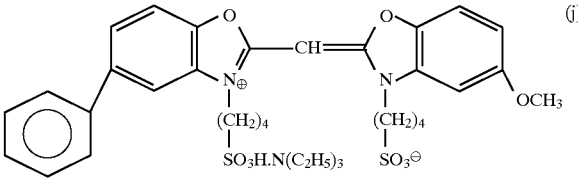

(k)

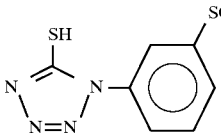

(l)

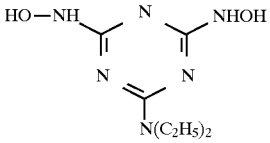

H-3

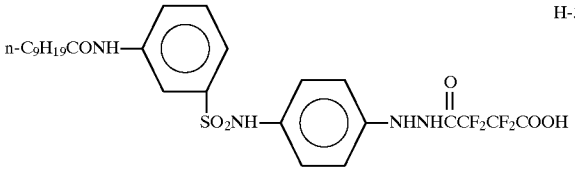

Preparation of Coating Solutions for PC and OC:

To an aqueous gelatin solution containing proxel as an antiseptic, Compound (n), Compound (o) and a polyethyl acrylate dispersion were added to give a coated amount of 10 mg/m$^2$, 100 mg/m$^2$ and 300 mg/m$^2$, respectively, thereby preparing a PC solution.

Further, to a gelatin solution containing proxel as an antiseptic, an amorphous $SiO_2$ matting agent having an average particle size of about 3.5 μm, colloidal silica (Snowtex C, produced by Nissan Chemical KK), liquid paraffin, and as coating aids, a fluorine surface active agent shown below by structural formula (p) and sodium p-dodecylbenzenesulfonate were added to give a coated amount of 50 mg/m$^2$, 100 mg/m$^2$, 30 mg/m$^2$, 5 mg/m$^2$ and 30 mg/m$^2$, respectively, thereby preparing an OC solution.

(n)

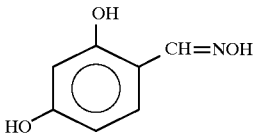

(o)

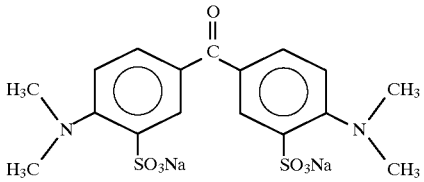

(p)

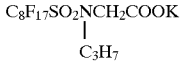

These coating solutions were coated on a polyethylene terephthalate film having on both surfaces thereof a moisture-proofing undercoat containing vinylidene chloride, to have a layer structure of an emulsion layer (silver amount: 3.0 g/m$^2$, gelatin: 1.5 g/m$^2$) as a lowermost layer, PC (gelatin: 0.5 g/m$^2$) and OC (gelatin: 0.4 g/m$^2$). The sample obtained had a layer surface pH on the emulsion surface of 5.8.

A back layer having the following formulation was coated.

| Back Layer: | |
|---|---|
| Gelatin | 1.5 g/m$^2$ |
| Surface active agent: Sodium p-dodecylbenzenesulfonate | 30 mg/m$^2$ |
| Gelatin hardening agent: 1,2-bis(vinylsulfonylacetamido)ethane | 100 mg/m$^2$ |
| Dye: Mixture of the following Dyes (q), (r), (s) and (t) | |
| Dye (q) | 50 mg/m$^2$ |
| Dye (r) | 100 mg/m$^2$ |
| Dye (s) | 30 mg/m$^2$ |
| Dye (t) | 50 mg/m$^2$ |
| Proxel | 1 mg/m$^2$ |

(q)

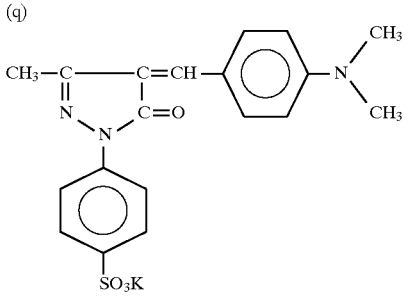

(r)

-continued

Back Layer:

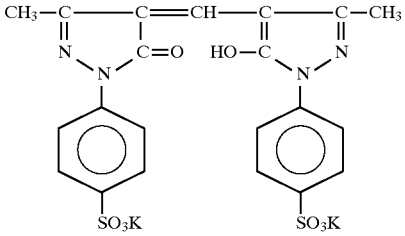

(s)

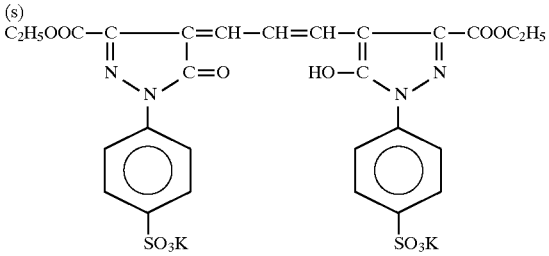

(t)

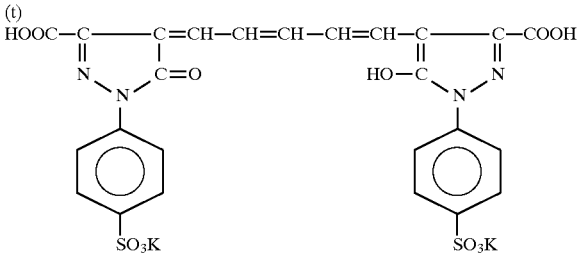

The swelling ratio on the side having an emulsion layer was 150.

Example 1

Developer (1-1) had the following composition per 1 l of the use solution.

| | |
|---|---|
| Potassium hydroxide (100%) | 35.0 g |
| Diethylenetriaminepentaacetic acid | 2.0 g |
| Potassium carbonate | 40.0 g |
| Sodium metabisulfite | 40.0 g |
| Potassium bromide | 3.0 g |
| Diethylene glycol | 20.0 g |
| Hydroquinone | 25.0 g |
| 5-Methylbenzotriazole | 0.08 g |
| 4-Hydroxymethyl-4-methyl-1-phenyl-3-pyrazolidone | 0.45 g |
| 2,3,5,6,7,8-Hexahydro-2-thioxo-4-(1H)-quinazoline | 0.04 g |
| Sodium 2-mercaptobenzimidazole-5-sulfonate | 0.15 g |
| Sodium erythorbate | 3.0 g |
| Compound shown in Table 1-1 | shown in Table 1-1 |
| pH | 10.5 |

Developer (1-2) had the following composition.

| | |
|---|---|
| Sodium hydroxide (100%) | 40.0 g |
| Diethylenetriaminepentaacetic acid | 2.0 g |
| Potassium carbonate | 60.0 g |
| Sodium metabisulfite | 70.0 g |
| Potassium bromide | 7.0 g |
| Diethylene glycol | 5.0 g |
| Hydroquinone | 40.0 g |

-continued

| | |
|---|---|
| 5-Methylbenzotriazole | 0.35 g |
| 4-Hydroxymethyl-4-methyl-1-phenyl-3 pyrazolidone | 1.50 g |
| Sodium 2-mercaptobenzimidazole-5-sulfonate | 0.30 g |
| Sodium 3-(5-Mercaptotetrazole-1-yl)-benzenesulfonate | 0.10 g |
| Sodium erythorbate | 6.0 g |
| Compound shown in Table 1-2 | shown in Table 1-2 |
| pH | 10.5 |

Fixing solution (1-1) had the following formulation per 1 l of the use solution.

| | |
|---|---|
| Ammonium thiosulfate | 119.7 g |
| Disodium ethylenediaminetetraacetate dihydrate | 0.03 g |
| Sodium thiosulfate pentahydrate | 10.9 g |
| Sodium metasulfite | 25.0 g |
| Sodium hydroxide (100%) | 12.4 g |
| Glacial acetic acid | 29.1 g |
| Tartaric acid | 2.9 g |
| Sodium gluconate | 1.7 g |
| Aluminum sulfate | 8.4 g |
| pH | 4.8 |

Example 1-1

After dipping 16 sheets of contact film RU-100 (3.6 cm×12 cm) produced by Fuji Photo Film Co., Ltd. in 250 ml of a developer at 38° C. for 20 seconds while stirring by nitrogen bubbling, the silver concentration in the developer was measured.

The results in Developer (1-1) are shown in Table 1-1 and the results in Developer (1-2) are shown in Table 1-2. The compounds of the present invention exhibited excellent capability to inhibit dissolving out of silver.

Example 1-2

In an automatic developing machine FG-460A (manufactured by Fuji Photo Film Co., Ltd.) filled with a developer and a fixing solution, Photosensitive Materials (1-1) to (1-4), output photosensitive material LS-5500 produced by the same company, dupe paper photosensitive material DU-150WP each was subjected to sensitometry. The exposure and processing conditions were as follows.

Photosensitive Material (1-1):
exposed to xenon flash light through an interference filter of 633 nm and a step wedge for an emission time of $10^{-6}$ second Photosensitive Material (1-2):
exposed to xenon flash light through an interference filter having a peak at 488 nm and a step wedge for an emission time of $10^{-5}$ second Photosensitive Material (1-3):
exposed by P-627FM Printer manufactured by Dainippon Screen Mfg. Co., Ltd. through a step wedge Photosensitive Material (1-4):
exposed to tungsten light of 3200° K through a step wedge LS-5500:
exposed to xenon flash light through an interference filter having a peak at 488 nm and a step wedge for an emission time of $10^{-4}$ second DU-150WP:
exposed by P-627FM Printer manufactured by Dainippon Screen Mfg. Co., Ltd. through a step wedge Processing Conditions:

Photosensitive Materials (1-1), (1-2) and (1-4) were processed at a development temperature of 35° C. and a fixing temperature of 34° C. for a development time of 30 seconds;

the other photosensitive material was processed at a development temperature of 38° C. and a fixing temperature of 37° C. for a development time of 20 seconds In Tables 1-1 and 1-2, difference of the minimum density (Dmin) from blank and difference of sensitivity at a density of 3.0 (S3.0) from blank are shown. The smaller the difference, the smaller the influence on photographic properties and the more preferred. It is seen that the compounds of the present invention little affect the photographic properties. In particular, even when the addition amount is large, excellent result is obtained that the Dmin of dupe photosensitive material is not affected. The tolerance in practice is 0.03 or less for Dmin difference and within ±0.02 for S3.0 difference.

Example 1-3

After unexposed contact film RU-100 produced by the same company was processed at a rate of 100 $m^2$ per day for 5 days in Example 1-2, unexposed contact paper photosensitive material KU-150WP (10×12 inches) produced by the same company was processed and stains were observed. Developer (1-1) was replenished in an amount of 320 ml/$m^2$, Developer (1-2) was replenished in an amount of 160 ml/$m^2$ and the fixing solutions each was replenished in an amount of 260 ml/$m^2$. The results obtained are shown in Tables 1-1 and 1-2. Samples on the level of 4 or higher have no problem in practice.

By using the compounds of the present invention, an excellent effect in preventing silver stains can be achieved without affecting the photographic properties at all.

TABLE 1-1

(results in Developer (1-1))

| | | | | S3.0 Difference | | | | | |
|---|---|---|---|---|---|---|---|---|---|
| Compound | Addition Amount (m/M) | Amount of Silver Dissolved Out (ppm) | Dmin Difference DU-150WP | Photo-sensitive Material 1–1 | Photo-sensitive Material 1–2 | Photo-sensitive Material 1–3 | Photo-sensitive Material 1–4 | LS-5500 | Stain |
| 1-I-1 | 0.5 | 0.11 | ±0 | ±0 | ±0 | ±0 | ±0 | ±0 | 5 |
| Invention | 1.0 | 0.06 | ±0 | +0.01 | ±0 | +0.01 | ±0.01 | ±0 | 5 |
| 1-I-3 | 0.5 | 0.20 | ±0.01 | ±0 | −0.01 | ±0 | −0.01 | ±0 | 4 |
| Invention | 1.0 | 0.13 | +0.02 | −0.01 | −0.02 | −0.02 | −0.02 | −0.01 | 5 |
| 1-I-5 | 0.5 | 0.1 | ±0 | ±0 | ±0 | ±0 | ±0 | ±0 | 5 |
| Invention | 1.0 | 0.05 | +0.01 | +0.01 | +0.01 | −0.01 | +0.01 | +0.01 | 5 |
| 1-I-6 | 0.5 | 0.15 | ±0 | ±0 | ±0 | +0.01 | −0.01 | ±0 | 4 |
| Invention | 1.0 | 0.11 | +0.01 | +0.02 | +0.02 | +0.02 | −0.02 | +0.01 | 5 |
| 1-I-7 | 0.5 | 0.21 | +0.01 | +0.01 | ±0 | +0.01 | ±0 | ±0 | 4 |
| Invention | 1.0 | 0.12 | +0.02 | +0.02 | +0.01 | +0.02 | +0.01 | +0.01 | 5 |
| 1-I-9 | 0.5 | 0.19 | ±0 | ±0 | +0.01 | −0.01 | ±0 | ±0 | 4 |
| Invention | 1.0 | 0.1 | +0.01 | +0.02 | +0.02 | −0.02 | +0.01 | +0.02 | 5 |
| 1-II-1 | 0.5 | 0.1 | ±0 | ±0 | ±0 | ±0 | ±0 | ±0 | 5 |
| Invention | 1.0 | 0.05 | ±0 | +0.01 | +0.01 | +0.01 | +0.01 | +0.01 | 5 |
| 1-II-3 | 0.5 | 0.17 | ±0 | ±0 | ±0 | ±0 | ±0 | −0.01 | 4 |
| Invention | 1.0 | 0.1 | +0.01 | +0.01 | +0.01 | −0.02 | −0.02 | −0.02 | 5 |
| 1-II-8 | 0.5 | 0.1 | ±0 | ±0 | ±0 | −0.01 | ±0 | ±0 | 5 |
| Invention | 1.0 | 0.08 | +0.01 | ±0 | −0.01 | −0.01 | −0.01 | ±0 | 5 |
| 1-C-1 | 0.5 | 0.5 | +0.02 | −0.01 | −0.01 | −0.01 | −0.01 | −0.01 | 2 |
| Comparison | 1.0 | 0.35 | +0.09 | −0.02 | −0.02 | −0.02 | −0.02 | −0.02 | 3 |
| 1-C-2 | 0.5 | 0.45 | +0.03 | +0.01 | +0.01 | +0.01 | +0.01 | +0.01 | 3 |
| Comparison | 1.0 | 0.32 | +0.06 | +0.02 | +0.02 | +0.02 | +0.02 | +0.02 | 3 |
| 1-C-3 | 0.5 | 0.4 | +0.03 | −0.01 | −0.02 | ±0 | −0.02 | −0.02 | 3 |
| Comparison | 1.0 | 0.31 | +0.08 | −0.04 | −0.04 | −0.03 | −0.04 | −0.04 | 3 |
| 1-C-4 | 0.5 | 1.8 | +0.01 | −0.02 | −0.02 | −0.02 | −0.03 | −0.02 | 1 |
| Comparison | 1.0 | 1.0 | +0.03 | −0.06 | −0.06 | −0.05 | −0.06 | −0.04 | 2 |
| Blank Comparison | — | 3.4 | — | — | — | — | — | — | 1 |

Level of stain:

5: completely no stain

4: solution was turbid but not bad effect in practice

3: silver sludge was deposited on the tank bottom, paper bore thin stains

2: edge of paper was stained

1: stains were attached throughout the paper surface

TABLE 1-2

(results in Developer (1-2))

| Compound | Addition Amount (m/M) | Amount of Silver Dissolved Out (ppm) | Dmin Difference DU-150WP | S3.0 Difference Photo-sensitive Material 1–1 | Photo-sensitive Material 1–2 | Photo-sensitive Material 1–3 | Photo-sensitive Material 1–4 | LS-5500 | Stain |
|---|---|---|---|---|---|---|---|---|---|
| 1-I-1 | 0.5 | 0.10 | ±0 | ±0 | ±0 | ±0 | ±0 | ±0 | 5 |
| Invention | 1.0 | 0.05 | ±0 | +0.01 | ±0 | +0.01 | +0.01 | +0.01 | 5 |
| 1-I-3 | 0.5 | 0.18 | +0.01 | −0.01 | −0.01 | −0.01 | −0.01 | −0.01 | 4 |
| Invention | 1.0 | 0.15 | +0.01 | −0.02 | −0.02 | −0.02 | −0.02 | −0.02 | 5 |
| 1-I-5 | 0.5 | 0.10 | ±0 | ±0 | ±0 | ±0 | ±0 | ±0 | 5 |
| Invention | 1.0 | 0.04 | +0.01 | ±0 | +0.01 | −0.01 | +0.01 | ±0 | 5 |
| 1-I-6 | 0.5 | 0.13 | ±0 | ±0 | ±0 | +0.01 | −0.01 | ±0 | 4 |
| Invention | 1.0 | 0.09 | +0.01 | +0.0 | +0.0 | +0.02 | −0.02 | +0.01 | 5 |
| 1-I-7 | 0.5 | 0.17 | +0.01 | +0.01 | ±0 | +0.01 | +0.01 | ±0 | 4 |
| Invention | 1.0 | 0.11 | +0.02 | +0.02 | +0.01 | +0.02 | +0.02 | +0.01 | 5 |
| 1-I-9 | 0.5 | 0.16 | +0.01 | +0.01 | +0.01 | −0.01 | +0.01 | ±0 | 4 |
| Invention | 1.0 | 0.12 | +0.02 | +0.02 | +0.02 | −0.02 | +0.02 | +0.02 | 5 |
| 1-II-1 | 0.5 | 0.10 | ±0 | ±0 | ±0 | ±0 | ±0 | ±0 | 5 |
| Invention | 1.0 | 0.05 | +0.01 | +0.01 | ±0 | +0.01 | ±0 | ±0 | 5 |
| 1-II-3 | 0.5 | 0.14 | ±0 | ±0 | ±0 | −0 | ±0 | −0.01 | 4 |
| Invention | 1.0 | 0.09 | +0.01 | +0.01 | +0.01 | −0.02 | −0.02 | −0.02 | 5 |
| 1-II-8 | 0.5 | 0.08 | ±0 | ±0 | ±0 | ±0 | ±0 | ±0 | 5 |
| Invention | 1.0 | 0.06 | ±0 | −0.01 | −0.01 | −0.01 | −0.01 | −0.01 | 5 |
| 1-C-1 | 0.5 | 0.45 | +0.02 | −0.01 | −0.01 | −0.01 | −0.01 | −0.01 | 3 |
| Comparison | 1.0 | 0.3 | +0.09 | −0.02 | −0.02 | −0.02 | −0.02 | −0.02 | 4 |
| 1-C-2 | 0.5 | 0.4 | +0.03 | +0.01 | ±0.01 | +0.01 | +0.01 | +0.01 | 3 |
| Comparison | 1.0 | 0.3 | +0.06 | +0.02 | +0.02 | +0.02 | +0.02 | +0.02 | 4 |
| 1-C-3 | 0.5 | 0.32 | +0.03 | −0.01 | −0.02 | −0.01 | −0.02 | ±0 | 3 |
| Comparison | 1.0 | 0.25 | +0.08 | −0.04 | −0.04 | −0.03 | −0.04 | −0.03 | 3 |
| 1-C-4 | 0.5 | 1.7 | +0.03 | −0.02 | −0.02 | −0.02 | −0.03 | −0.02 | 2 |
| Comparison | 1.0 | 1.0 | +0.08 | −0.06 | −0.06 | −0.05 | −0.06 | −0.04 | 3 |
| Blank Comparison | — | 2.8 | — | — | — | — | — | — | 1 |

Level of stain:
5: completely no stain
4: solution was turbid but not bad effect in practice
3: silver sludge was deposited on the tank bottom, paper bore thin stains
2: edge of paper was stained
1: stains were attached throughout the paper surface Comparative Compounds 1-C-1, 1-C-2, 1-C-3 and 1-C-4 in Tables 1-1 and 1-2 had the following structural formulae:

Comparative Compound 1-C-1:

Compound described in JP-A-3-53244

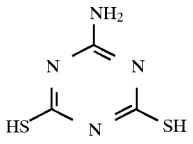

Comparative Compound 1-C-2:

Compound described in JP-A-3-53244

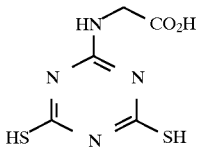

Comparative Compound 1-C-3:

Compound described in JP-A-6-230525

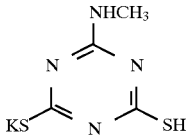

Comparative Compound 1-C-4:

Compound described in JP-A-56-24347, etc.

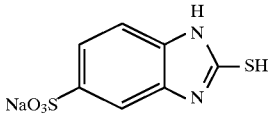

Example 2

Developer (2-1) had the following composition per 1 l of the use solution.

| | |
|---|---|
| Potassium hydroxide | 35.0 g |
| Diethylenetriaminepentaacetic acid | 2.0 g |

-continued

| | |
|---|---|
| Potassium carbonate | 40.0 g |
| Sodium metabisulfite | 40.0 g |
| Potassium bromide | 3.0 g |
| Hydroquinone | 25.0 g |
| 5-Methylbenzotriazole | 0.08 g |
| 4-Hydroxymethyl-4-methyl-1-phenyl-3-pyrazolidone | 0.45 g |
| Compound shown in Table 2-1 | shown in Table 2-1 |
| Sodium erythorbate | 3.0 g |
| Diethylene glycol | 20.0 g |
| pH | 10.5 |

Developer (2) had the following composition.

| | |
|---|---|
| Sodium hydroxide (beads, 99.5%) | 11.5 g |
| Potassium sulfite (raw powder) | 63.0 g |
| Sodium sulfite (raw powder) | 46.0 g |
| Potassium carbonate | 62.0 g |
| Hydroquinone (briquette) | 40.0 g |
| The following components were collectively briquetted. | |
| Diethylenetriaminepentaacetic acid | 2.0 g |
| 5-Methylbenzotriazole | 0.35 g |
| 4-Hydroxymethyl-4-methyl-1-phenyl-3 pyrazolidone | 1.5 g |
| Compound shown in Table 2-2 | shown in Table 2-2 |
| Sodium 3-(5-mercaptotetrazol-1-yl) benzenesulfonate | 0.1 g |
| Sodium erythorbate | 6.0 g |
| Potassium bromide | 6.6 g |
| Dissolved in water to make 1l | |
| pH | 10.65 |

With respect to the shape of raw materials, the raw powder was a general industrial product used as it was and the beads of alkali metal salt were a commercially available product.

The raw materials in the shape of a briquette each was compressed under pressure using a briquetting machine to have an undefined Rugby ball form having a length of approximately from 4 to 6 mm, and the briquette was crushed on use. With respect to the components in a small amount, respective components were blended and then briquetted.

The thus-obtained processing agents (10 l portion) were each packed into a high density polyethylene-made container capable of folding and the takeout port was sealed with aluminum seal. On dissolving and replenishing the processing agent, a dissolving/replenishing apparatus having an automatic unsealing mechanism was used.

Fixing solution (2-1) had the following formulation per 1 l of the use solution.

| | |
|---|---|
| Ammonium thiosulfate | 120 g |
| Disodium ethylenediaminetetraacetate dihydrate | 0.03 g |
| Sodium thiosulfate pentahydrate | 11.0 g |
| Sodium metasulfite | 19.0 g |
| Sodium hydroxide | 12.4 g |
| Acetic acid (100%) | 30.0 g |
| Tartaric acid | 2.9 g |
| Sodium gluconate | 1.7 g |
| Aluminum sulfate | 8.4 g |
| pH | 4.8 |

Fixing agent (2-2) had the following composition.

| | |
|---|---|
| Agent A: (solid) | |
| Ammonium thiosulfate (compact) | 125.0 g |
| Sodium thiosulfate anhydride (raw powder) | 19.0 g |
| Sodium metabisulfite (raw powder) | 18.0 g |
| Sodium acetate anhydride (raw powder) | 42.0 g |
| Agent B: (liquid) | |
| Disodium ethylenediaminetetraacetate dihydrate | 0.03 g |
| Citric anhydride | 3.7 g |
| Sodium gluconate | 1.7 g |
| Aluminum sulfate | 8.4 g |
| Sulfuric acid | 2.1 g |
| Dissolved in water to make 50 ml. | |
| Agent A and Agent B were dissolved in water to make 1l. | |
| pH | 4.8 |

Ammonium thiosulfate (compact) used was obtained by compressing flakes prepared by a spray drying method under pressure in a roller compactor into undefined form chips having a size of approximately from 4 to 6 mm and blending with sodium thiosulfate anhydride. Other raw powders used were a general industrial product.

Agent A and Agent B each in a 10 l portion were separately packed in a high density polyethylene-made container capable of folding. The takeout port of Agent A was sealed with an aluminum seal and the port of Agent B container was sealed with a screw cap. On dissolving and replenishing the processing agent, a dissolving/replenishing apparatus having an automatic unsealing mechanism was used.

Example 2-1

After dipping 16 sheets of contact film RU-100 (3.6 cm×12 cm) produced by Fuji Photo Film Co., Ltd. in 250 ml of a developer at 38° C. for 20 seconds while stirring by nitrogen bubbling, the silver concentration in the developer was measured.

The results in Developer (2-1) are shown in Table 2-1 and the results in Developer (2-2) are shown in Table 2-2. The compounds of the present invention exhibited excellent capability to inhibit dissolving out of silver.

Example 2

In an automatic developing machine FG-460A (manufactured by Fuji Photo Film Co., Ltd.) filled with a developer and a fixing solution, Photosensitive Materials (1-1) to (1-4), output photosensitive material LS-5500 produced by the same company, dupe paper photosensitive material DU-150WP each was subjected to sensitometry. Developer (2-1) was used in combination with Fixing Solution (2-1) and Developer (2-2) was used in combination with Fixing Solution (2-2). The exposure and processing conditions were the same as in Example 1-2

In Tables 2-1 and 2-2, difference of the minimum density (Dmin) from blank and difference of sensitivity at a density of 3.0 (S3.0) from blank are shown. The smaller the difference, the smaller the influence on photographic properties and the more preferred. It is seen that the compounds of the present invention little affect the photographic properties. In particular, even when the addition amount is large, excellent result is obtained that the Dmin of dupe photosensitive material is not affected. The tolerance in practice is 0.03 or less for Dmin difference and within ±0.02 for S3.0 difference.

Example 2-3

After unexposed contact film RU-100 produced by the same company was processed at a rate of 100 $m^2$ per day for 5 days in Example 2-2, unexposed contact paper photosensitive material KU-150WP (10×12 inches) produced by the same company was processed and stains were observed. Developer (2-1) was replenished in an amount of 320 ml/$m^2$, Developer (2-2) was replenished in an amount of 160 ml/$m^2$ and the fixing solutions each was replenished in an amount of 260 ml/$m^2$. The results obtained are shown in Tables 2-1 and 2-2. Samples on the level of 4 or higher have no problem in practice.

By using the compounds of the present invention, an excellent effect in preventing silver stains can be achieved without affecting the photographic properties at all.

TABLE 2-1

(results in Developer (2-1))

| Compound | Addition Amount (mg/l) | Amount of Silver Dissolved Out (ppm) | Dmin Difference DU-150WP | S3.0 Difference: Photo-sensitive Material 1–1 | Photo-sensitive Material 1–2 | Photo-sensitive Material 1–3 | Photo-sensitive Material 1–4 | LS-5500 | Stain |
|---|---|---|---|---|---|---|---|---|---|
| 2-I-1 | 73 | 0.20 | ±0.00 | ±0.00 | ±0.00 | +0.01 | −0.01 | ±0.00 | 4 |
| Invention | 145 | 0.15 | +0.01 | +0.02 | +0.02 | +0.02 | −0.02 | +0.01 | 5 |
| 2-I-2 | 87 | 0.18 | +0.01 | ±0.00 | ±0.00 | +0.02 | ±0.00 | ±0.00 | 4 |
| Invention | 173 | 0.12 | +0.02 | +0.01 | +0.01 | ±0.00 | +0.01 | +0.01 | 5 |
| 2-I-3 | 133 | 0.17 | ±0.00 | ±0.00 | +0.00 | +0.01 | ±0.00 | ±0.00 | 5 |
| Invention | 265 | 0.10 | +0.01 | +0.02 | +0.02 | −0.01 | +0.01 | +0.02 | 5 |
| 2-I-10 | 64 | 0.20 | +0.01 | ±0.00 | ±0.00 | −0.02 | ±0.00 | ±0.00 | 4 |
| Invention | 128 | 0.15 | +0.02 | +0.01 | +0.01 | ±0.00 | +0.01 | +0.01 | 5 |
| 2-I-24 | 88 | 0.20 | ±0.00 | ±0.00 | ±0.00 | +0.01 | ±0.00 | −0.01 | 4 |
| Invention | 177 | 0.16 | +0.01 | +0.01 | +0.01 | ±0.00 | −0.02 | −0.02 | 5 |
| 2-I-25 | 102 | 0.21 | ±0.00 | ±0.00 | ±0.00 | −0.02 | ±0.00 | ±0.00 | 4 |
| Invention | 203 | 0.16 | +0.01 | −0.02 | −0.02 | −0.01 | −0.02 | −0.02 | 4 |
| 2-I-26 | 108 | 0.19 | ±0.00 | ±0.00 | ±0.00 | −0.02 | ±0.00 | ±0.00 | 4 |
| Invention | 216 | 0.13 | ±0.00 | +0.01 | +0.01 | ±0.00 | −0.02 | −0.02 | 4 |
| 2-C-1 | 91 | 0.50 | +0.02 | −0.01 | −0.01 | +0.01 | −0.01 | −0.01 | 2 |
| Comparison | 182 | 0.35 | +0.09 | −0.02 | −0.02 | −0.02 | −0.02 | −0.02 | 3 |
| 2-C-2 | 65 | 0.40 | +0.03 | +0.01 | −0.02 | ±0.00 | −0.02 | −0.02 | 1 |
| Comparison | 129 | 0.31 | +0.08 | +0.04 | −0.04 | −0.03 | −0.04 | −0.04 | 2 |
| 2-C-3 | 144 | 1.8 | +0.0 | −0.02 | −0.02 | −0.02 | −0.03 | −0.02 | 1 |
| Comparison | 288 | 1.0 | +0.03 | −0.06 | −0.06 | −0.05 | −0.06 | −0.04 | 2 |
| Blank Comparison | — | 3.4 | — | — | — | — | — | — | 1 |

Level of stain:
5: completely no stain
4: solution was turbid but not bad effect in practice
3: silver sludge was deposited on the tank bottom, paper bore thin stains
2: edge of paper was stained
1: stains were attached throughout the paper surface

TABLE 2-2

(results in Developer (2-2))

| Compound | Addition Amount (mg/l) | Amount of Silver Dissolved Out (ppm) | Dmin Difference DU-150WP | S3.0 Difference: Photo-sensitive Material 1–1 | Photo-sensitive Material 1–2 | Photo-sensitive Material 1–3 | Photo-sensitive Material 1–4 | LS-5500 | Stain |
|---|---|---|---|---|---|---|---|---|---|
| 2-I-1 | 73 | 0.18 | ±0.00 | ±0.00 | ±0.00 | +0.01 | −0.01 | ±0.00 | 4 |
| Invention | 145 | 0.12 | ±0.00 | +0.02 | +0.02 | +0.02 | −0.02 | ±0.01 | 5 |
| 2-I-2 | 87 | 0.17 | +0.01 | ±0.00 | ±0.00 | ±0.00 | ±0.10 | ±0.00 | 4 |
| Invention | 173 | 0.11 | +0.02 | +0.01 | +0.01 | +0.01 | +0.01 | +0.01 | 5 |
| 2-I-3 | 133 | 0.16 | ±0.00 | ±0.00 | +0.01 | −0.01 | ±0.00 | ±0.00 | 5 |
| Invention | 265 | 0.12 | +0.01 | +0.02 | +0.02 | −0.02 | +0.01 | +0.02 | 5 |
| 2-I-10 | 64 | 0.18 | +0.01 | ±0.00 | ±0.00 | ±0.00 | ±0.00 | ±0.00 | 4 |
| Invention | 128 | 0.12 | +0.02 | +0.01 | +0.01 | +0.01 | +0.01 | +0.01 | 5 |
| 2-I-24 | 88 | 0.17 | ±0.00 | ±0.00 | ±0.00 | ±0.00 | ±0.00 | −0.01 | 4 |
| Invention | 177 | 0.12 | +0.01 | +0.01 | +0.01 | −0.02 | −0.02 | −0.02 | 5 |
| 2-I-25 | 102 | 0.17 | ±0.00 | ±0.00 | +0.01 | −0.01 | ±0.00 | ±0.00 | 4 |
| Invention | 203 | 0.10 | +0.01 | −0.02 | −0.02 | −0.02 | −0.02 | −0.02 | 4 |
| 2-I-26 | 108 | 0.16 | ±0.00 | ±0.00 | ±0.00 | ±0.00 | ±0.00 | ±0.00 | 4 |

TABLE 2-2-continued (results in Developer (2-2))

| Compound | Addition Amount (mg/l) | Amount of Silver Dissolved Out (ppm) | Dmin Difference DU-150WP | S3.0 Difference Photo-sensitive Material 1–1 | Photo-sensitive Material 1–2 | Photo-sensitive Material 1–3 | Photo-sensitive Material 1–4 | LS-5500 | Stain |
|---|---|---|---|---|---|---|---|---|---|
| Invention | 216 | 0.11 | ±0.00 | +0.01 | +0.01 | +0.01 | −0.02 | −0.02 | 4 |
| 2-C-1 | | 0.45 | +0.02 | −0.01 | −0.01 | −0.01 | −0.01 | −0.01 | 3 |
| Comparison | | 0.35 | +0.09 | −0.02 | −0.02 | −0.02 | −0.02 | −0.02 | |
| 2-C-2 | 65 | 0.50 | +0.03 | +0.01 | +0.01 | +0.01 | +0.01 | +0.01 | 2 |
| Comparison | 129 | 0.40 | +0.06 | +0.02 | +0.02 | +0.02 | +0.02 | +0.02 | 3 |
| 2-C-3 | 144 | 1.7 | +0.03 | −0.02 | −0.02 | −0.02 | −0.03 | −0.02 | 2 |
| Comparison | 288 | 1.0 | +0.08 | −0.06 | −0.06 | −0.05 | −0.06 | −0.04 | 3 |
| Blank Comparison | — | 2.8 | +0.01 | −0.02 | −0.02 | −0.02 | −0.03 | −0.02 | 1 |

Level of stain:
5: completely no stain
4: solution was turbid but not bad effect in practice
3: silver sludge was deposited on the tank bottom, paper bore thin stains
2: edge of paper was stained
1: stains were attached throughout the paper surface Comparative Compounds 2-C-1, 2-C-2 and 2-C-3 in Tables 2-1 and 2-2 had the following structural formulae:
Comparative Compound 2-C-1:
Compound described in JP-A-4-362942

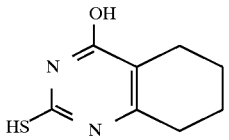

Comparative Compound 2-C-2:
Compound described in JP-A-5-303179, JP-A-5-61159 and JP-A-6-324435

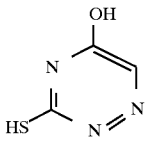

Comparative Compound 2-C-3:
Compound described in JP-A-56-24347

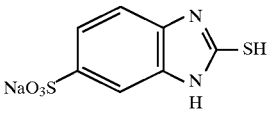

Example 3

Developer (3-1) and (3-2) were prepared in the same manner as Developer (2-1) and (2-2), respectively, except for using the compounds shown in Table 3-1 and 3-2 instead of the compounds shown in Table 2-1 and 2-2, respectively.

Example 3-1

After dipping 16 sheets of contact film RU-100 (3.6 cm×12 cm) produced by Fuji Photo Film Co., Ltd. in 250 ml of a developer at 38° C. for 20 seconds while stirring by nitrogen bubbling, the silver concentration in the developer was measured.

The results in Developer (3-1) are shown in Table 3-1 and the results in Developer (3-2) are shown in Table 3-2. The compounds of the present invention exhibited excellent capability to inhibit dissolving out of silver.

Example 3-2

In an automatic developing machine FG-460A (manufactured by Fuji Photo Film Co., Ltd.) filled with a developer and a fixing solution, Photosensitive Materials (1-1) to (1-4), output photosensitive material LS-5500 produced by the same company, dupe paper photosensitive material DU-150WP each was subjected to sensitometry. Developer (3-1) was used in combination with Fixing Solution (2-1) and Developer (3-2) was used in combination with Fixing Solution (2-2). The exposure and processing conditions were the same as in Example 1-2.

In Tables 3-1 and 3-2, difference of the minimum density (Dmin) from blank and difference of sensitivity at a density of 3.0 (S3.0) from blank are shown. The smaller the difference, the smaller the influence on photographic properties and the more preferred. It is seen that the compounds of the present invention little affect the photographic properties. In particular, even when the addition amount is large, excellent result is obtained that the Dmin of dupe photosensitive material is not affected. The tolerance in practice is 0.03 or less for Dmin difference and within ±0.02 for S3.0 difference.

Example 3-3

After unexposed contact film RU-100 produced by the same company was processed at a rate of 100 $m^2$ per day for 5 days in Example 3-2, unexposed contact paper photosensitive material KU-150WP (10×12 inches) produced by the same company was processed and stains were observed. Developer (3-1) was replenished in an amount of 320 ml/$m^2$, Developer (3-2) was replenished in an amount of 160 ml/$m^2$ and the fixing solutions each was replenished in an amount of 260 ml/$m^2$. The results obtained are shown in Tables 3-1 and 3-2. Samples on the level of 4 or higher have no problem in practice.

By using the compounds of the present invention, an excellent effect in preventing silver stains can be achieved without affecting the photographic properties at all.

TABLE 3-1

| Compound | Addition Amount (mmol/l) | Amount of Silver Dissolved Out (ppm) | Reduction Inhibition (days) | Dmin Difference DU-150WP | S3.0 Difference Photo-sensitive Material 1–1 | Photo-sensitive Material 1–2 | Photo-sensitive Material 1–3 | Photo-sensitive Material 1–4 | LS-5500 | Stain |
|---|---|---|---|---|---|---|---|---|---|---|
| | | | | (results in Developer (3-1)) | | | | | | |
| 3-I-1 | 0.5 | 0.15 | 10 | ±0 | ±0 | ±0 | ±0 | ±0 | ±0 | 4 |
| Invention | 1.0 | 0.1 | 15 | ±0 | +0.01 | ±0 | +0.01 | +0.01 | ±0 | 5 |
| 3-I-2 | 0.5 | 0.12 | 12 | ±0 | ±0 | ±0 | ±0 | ±0 | ±0 | 5 |
| Invention | 1.0 | 0.09 | 18 | +0.01 | −0.01 | −0.01 | −0.01 | −0.01 | −0.01 | 5 |
| 3-I-3 | 0.5 | 0.13 | 10 | ±0 | ±0 | +0.01 | −0.01 | ±0 | ±0 | 5 |
| Invention | 1.0 | 0.1 | 14 | +0.01 | +0.02 | +0.02 | −0.02 | +0.01 | +0.01 | 5 |
| 3-I-5 | 0.5 | 0.2 | 16 | ±0 | ±0 | ±0 | +0.01 | −0.01 | ±0 | 4 |
| Invention | 1.0 | 0.15 | 19 | ±0.01 | +0.02 | +0.02 | +0.02 | −0.02 | +0.01 | 5 |
| 3-II-4 | 0.5 | 0.18 | 16 | +0.01 | ±0 | ±0 | ±0 | ±0 | ±0 | 4 |
| Invention | 1.0 | 0.12 | 19 | +0.02 | +0.01 | +0.01 | +0.01 | +0.01 | +0.01 | 5 |
| 3-II-8 | 0.5 | 0.17 | 12 | ±0 | ±0 | +0.01 | −0.01 | ±0 | ±0 | 5 |
| Invention | 1.0 | 0.1 | 18 | +0.01 | +0.02 | +0.02 | −0.02 | +0.01 | +0.02 | 5 |
| 3-II-2 | 0.5 | 0.2 | 15 | +0.01 | ±0 | ±0 | ±0 | ±0 | ±0 | 4 |
| Invention | 1.0 | 0.15 | 17 | +0.02 | +0.01 | +0.01 | +0.01 | +0.01 | +0.01 | 5 |
| 3-II-23 | 0.5 | 0.2 | 16 | ±0 | ±0 | ±0 | ±0 | ±0 | −0.01 | 4 |
| Invention | 1.0 | 0.16 | 19 | +0.01 | +0.01 | +0.01 | −0.02 | −0.02 | −0.02 | 5 |
| 3-II-28 | 0.5 | 0.14 | 18 | ±0 | ±0 | ±0 | ±0 | ±0 | ±0 | 5 |
| Invention | 1.0 | 0.07 | >20 | ±0 | −0.01 | −0.01 | −0.01 | −0.01 | −0.01 | 5 |
| 3-II-31 | 0.5 | 0.1 | >20 | ±0 | ±0 | ±0 | ±0 | ±0 | ±0 | 5 |
| Invention | 1.0 | 0.04 | >20 | ±0 | +0.01 | ±0 | +0.01 | +0.01 | ±0 | 5 |
| 3-II-32 | 0.5 | 0.12 | >20 | ±0 | ±0 | ±0 | ±0 | ±0 | ±0 | 5 |
| Invention | 1.0 | 0.06 | >20 | ±0 | +0.01 | ±0 | +0.01 | +0.01 | ±0 | 5 |
| | | | | (results in Developer (1-1)) | | | | | | |
| 3-II-35 | 0.5 | 0.15 | >20 | ±0 | ±0 | ±0 | ±0 | ±0 | ±0 | 5 |
| Invention | 1.0 | 0.08 | >20 | ±0 | +0.01 | ±0 | +0.01 | +0.01 | ±0 | 5 |
| 3-I-9 | 0.5 | 0.13 | 17 | ±0 | ±0 | ±0 | ±0 | ±0 | ±0 | 5 |
| Invention | 1.0 | 0.07 | >20 | ±0 | +0.01 | ±0 | −0.01 | +0.01 | ±0 | 5 |
| 3-C-1 | 0.5 | 0.5 | 3 | +0.02 | −0.01 | −0.01 | −0.01 | −0.01 | −0.01 | 2 |
| Comparison | 1.0 | 0.35 | 7 | +0.09 | −0.02 | −0.02 | −0.02 | −0.02 | −0.02 | 3 |
| 3-C-2 | 0.5 | 0.45 | 4 | +0.03 | +0.01 | +0.01 | +0.01 | +0.01 | +0.01 | 3 |
| Comparison | 1.0 | 0.32 | 8 | +0.06 | +0.02 | +0.02 | +0.02 | +0.02 | +0.02 | 3 |
| 3-C-3 | 0.5 | 1.8 | <1 | +0.01 | −0.02 | −0.02 | −0.02 | −0.03 | −0.02 | 1 |
| Comparison | 1.0 | 1.0 | 1 | +0.03 | −0.06 | −0.06 | −0.05 | −0.06 | −0.04 | 2 |
| Blank Comparison | — | 3.4 | just after addtion | — | — | — | — | — | — | |

Level of stain:
5: completely no stain
4: solution was turbid but not bad effect in practice
3: silver sludge was deposited on the tank bottom, paper bore thin stains
2: edge of paper was stained
1: stains were attached throughout the paper surface

TABLE 3-2

| Compound | Addition Amount (mmol/l) | Amount of Silver Dissolved Out (ppm) | Reduction Inhibition (days) | Dmin Difference DU-150WP | S3.0 Difference Photo-sensitive Material 1–1 | Photo-sensitive Material 1–2 | Photo-sensitive Material 1–3 | Photo-sensitive Material 1–4 | LS-5500 | Stain |
|---|---|---|---|---|---|---|---|---|---|---|
| | | | | (results in Developer (3-2)) | | | | | | |
| 3-I-1 | 0.5 | 0.12 | 10 | ±0 | ±0 | ±0 | ±0 | ±0 | ±0 | 4 |
| Invention | 1.0 | 0.08 | 15 | ±0 | +0.01 | ±0 | +0.01 | +0.01 | +0.01 | 5 |
| 3-I-2 | 0.5 | 0.1 | 12 | ±0 | ±0 | ±0 | ±0 | ±0 | ±0 | 5 |
| Invention | 1.0 | 0.07 | 18 | +0.01 | −0.01 | −0.01 | −0.01 | −0.01 | −0.01 | 5 |
| 3-I-3 | 0.5 | 0.11 | 10 | ±0 | ±0 | +0.01 | −0.01 | ±0 | ±0 | 5 |
| Invention | 1.0 | 0.07 | 14 | +0.01 | +0.02 | +0.02 | −0.02 | +0.01 | +0.02 | 5 |
| 3-I-5 | 0.5 | 0.18 | 16 | ±0 | ±0 | ±0 | +0.01 | −0.01 | ±0 | 4 |
| Invention | 1.0 | 0.12 | 19 | +0.01 | +0.02 | +0.02 | +0.02 | −0.02 | +0.01 | 5 |
| 3-II-4 | 0.5 | 0.17 | 16 | +0.01 | ±0 | ±0 | ±0 | ±0 | ±0 | 4 |
| Invention | 1.0 | 0.11 | 19 | +0.02 | +0.01 | +0.01 | +0.01 | +0.01 | +0.01 | 5 |
| 3-II-8 | 0.5 | 0.16 | 12 | ±0 | ±0 | ×0.01 | −0.01 | ±0 | ±0 | 5 |
| Invention | 1.0 | 0.12 | 18 | +0.01 | +0.02 | +0.02 | −0.02 | −0.01 | +0.02 | 5 |
| 3-II-2 | 0.5 | 0.18 | 15 | +0.01 | ±0 | ±0 | ±0 | ±0 | ±0 | 4 |

TABLE 3-2-continued (results in Developer (3-2))

| Compound | Addition Amount (mmol/l) | Amount of Silver Dissolved Out (ppm) | Reduction Inhibition (days) | Dmin Difference DU-150WP | S3.0 Difference Photo-sensitive Material 1–1 | Photo-sensitive Material 1–2 | Photo-sensitive Material 1–3 | Photo-sensitive Material 1–4 | LS-5500 | Stain |
|---|---|---|---|---|---|---|---|---|---|---|
| Invention | 1.0 | 0.12 | 17 | +0.02 | +0.01 | +0.01 | +0.01 | +0.01 | +0.01 | 5 |
| 3-II-23 | 0.5 | 0.17 | 16 | ±0 | ±0 | ±0 | ±0 | ±0 | −0.01 | 4 |
| Invention | 1.0 | 0.12 | 19 | +0.01 | +0.01 | +0.01 | −0.02 | −0.02 | −0.02 | 5 |
| 3-II-28 | 0.5 | 0.13 | 18 | ±0 | ±0 | ±0 | ±0 | ±0 | ±0 | 5 |
| Invention | 1.0 | 0.07 | >20 | ±0 | +0.01 | ±0 | ×0.01 | +0.01 | ±0 | 5 |
| 3-II-31 | 0.5 | 0.09 | >20 | ±0 | ±0 | ±0 | ±0 | ±0 | ±0 | 5 |
| Invention | 1.0 | 0.04 | >20 | ±0 | +0.01 | ±0 | +0.01 | +0.01 | +0.01 | 5 |
| 3-II-32 | 0.5 | 0.11 | >20 | ±0 | ±0 | ±0 | ±0 | ±0 | ±0 | 5 |
| Invention | 1.0 | 0.06 | >20 | ±0 | +0.01 | ±0 | +0.01 | +0.01 | ±0 | 5 |
| 3-II-35 | 0.5 | 0.15 | >20 | ±0 | ±0 | ±0 | ±0 | ±0 | ±0 | 5 |
| Invention | 1.0 | 0.07 | >20 | ±0 | −0.01 | −0.01 | −0.01 | −0.01 | −0.01 | 5 |
| 3-I-9 | 0.5 | 0.13 | 17 | ±0 | ±0 | ±0 | ±0 | ±0 | ±0 | 5 |
| Invention | 1.0 | 0.06 | >20 | +0.01 | +0.01 | +0.01 | +0.01 | +0.01 | +0.01 | 5 |
| 3-C-1 | 0.5 | 0.45 | 3 | +0.02 | −0.01 | −0.01 | −0.01 | −0.01 | −0.01 | 3 |
| Comparison | 1.0 | 0.3 | 7 | +0.09 | −0.02 | −0.02 | −0.02 | −0.02 | −0.02 | 3 |
| 3-C-2 | 0.5 | 0.4 | 4 | ±0 | ±0 | ±0 | ±0 | ±0 | ±0 | 2 |
| Comparison | 1.0 | 0.3 | 8 | ±0 | +0.01 | +0.01 | +0.01 | −0.02 | −0.02 | 3 |
| 3-C-3 | 0.5 | 1.2 | <1 | +0.01 | −0.02 | −0.02 | −0.02 | −0.03 | −0.02 | 2 |
| Comparison | 1.0 | 0.9 | 1 | +0.03 | −0.06 | −0.06 | −0.05 | −0.06 | −0.04 | 2 |
| Blank Comparison | — | 2.8 | just after addtion | — | — | — | — | — | — | 1 |

Level of stain:
5: completely no stain
4: solution was turbid but not bad effect in practice
3: silver sludge was deposited on the tank bottom, paper bore thin stains
2: edge of paper was stained
1: stains were attached throughout the paper surface Comparative Compounds 3-C-1, 3-C-2 and 3-C-3 in Tables 3-1 and 3-2 had the following structural formulae:

Comparative Compound 3-C-1:

Compound described in JP-A-4-362942

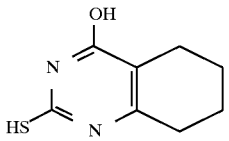

Comparative Compound 3-C-2:

Compound described in JP-B-46-11630 and JP-A-49-11333

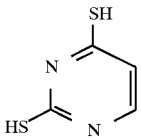

Comparative Compound 3-C-3:

Compound described in JP-A-56-24347, etc.

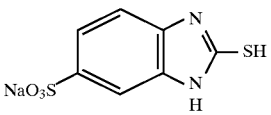

Example 4

Developer (4-1) had the following composition per 1 l of the use solution.

| | |
|---|---|
| Potassium hydroxide | 105.0 g |
| Diethylenetriaminepentaacetic acid | 6.0 g |
| Potassium carbonate | 120.0 g |
| Sodium metabisulfite | 120.0 g |
| Potassium bromide | 9.0 g |
| Hydroquinone | 75.0 g |
| 5-Methylbenzotriazole | 0.25 g |
| 4-Hydroxymethyl-4-methyl-1-phenyl-3-pyrazolidone | 1.35 g |
| Compound represented by formula (4) | shown in Table 4-1 |
| Sodium erythorbate | 9.0 g |
| Diethylene glycol | 60.0 g |
| pH | 10.7 |

Upon use, 1 part of the above-described concentrated solution was diluted with 2 parts of water. The pH of the diluted solution was 10.5.

| Developer (4-2) had the following composition. | |
|---|---|
| Sodium hydroxide (beads, 99.5%) | 11.5 g |
| Potassium sulfite (raw powder) | 63.0 g |
| Sodium sulfite (raw powder) | 46.0 g |
| Potassium carbonate | 62.0 g |
| Hydroquinone (briquette) | 40.0 g |

The following components were collectively briquetted.

| | |
|---|---|
| Diethylenetriaminepentaacetic acid | 2.0 g |
| 5-Methylbenzotriazole | 0.35 g |
| 4-Hydroxymethyl-4-methyl-1-phenyl-3-pyrazolidone | 1.5 g |
| Compound represented by formula (4) | shown in Table 4-1 |
| Sodium 3-(5-mercaptotetrazol-1-yl) benzenesulfonate | 0.1 g |
| Sodium erythorbate | 6.0 g |
| Potassium bromide | 6.6 g |
| Dissolved in water to make 1l | |
| pH | 10.65 |

With respect to the shape of raw materials, the raw powder was a general industrial product used as it was and the beads of alkali metal salt were a commercially available product.

The raw materials in the shape of a briquette each was compressed under pressure using a briquetting machine to have a plate form, and the briquette was crushed on use. With respect to the components in a small amount, respective components were blended and then briquetted.

The thus-obtained processing agents (10 l portion) were each packed into a high density polyethylene-made container capable of folding and the takeout port was sealed with aluminum seal. On dissolving and replenishing the processing agent, a dissolving/replenishing apparatus having an automatic unsealing mechanism was used.

Fixing solution (4-1) had the following formulation per 1 l of the use solution.

| | |
|---|---|
| Ammonium thiosulfate | 360 g |
| Disodium ethylenediaminetetraacetate dihydrate | 0.09 g |
| Sodium thiosulfate pentahydrate | 33.0 g |
| Sodium metasulfite | 57.0 g |
| Sodium hydroxide | 37.2 g |
| Acetic acid (100%) | 90.0 g |
| Tartaric acid | 8.7 g |
| Sodium gluconate | 5.1 g |
| Aluminum sulfate | 25.2 g |
| pH | 4.85 |

Upon use, 1 part of the above-described concentrated solution was diluted with 2 parts of water. The pH of the diluted solution was 4.8.

Fixing agent (4-2) had the following composition.

| Agent A: (solid) | |
|---|---|
| Ammonium thiosulfate (compact) | 125.0 g |
| Sodium thiosulfate anhydride (raw powder) | 19.0 g |
| Sodium metabisulfite (raw powder) | 18.0 g |
| Sodium acetate anhydride (raw powder) | 42.0 g |

-continued

| Agent B: (liquid) | |
|---|---|
| Disodium ethylenediaminetetraacetate dihydrate | 0.03 g |
| Citric anhydride | 3.7 g |
| Sodium gluconate | 1.7 g |
| Aluminum sulfate | 8.4 g |
| Sulfuric acid | 2.1 g |
| Dissolved in water to make 50 ml. | |
| Agent A and Agent B were dissolved in water to make 1l. | |
| pH | 4.8 |

Ammonium thiosulfate (compact) used was obtained by compressing flakes prepared by a spray drying method under pressure in a roller compactor into undefined form chips having a size of approximately from 4 to 6 mm and blending with sodium thiosulfate anhydride. Other raw powders used were a general industrial product.

Agent A and Agent B each in a 10 l portion were separately packed in a high density polyethylene-made container capable of folding. The takeout port of Agent A was sealed with an aluminum seal and the port of Agent B container was sealed with a screw cap. On dissolving and replenishing the processing agent, a dissolving/replenishing apparatus having an automatic unsealing mechanism was used.

Example 4-1

In an automatic developing machine FG-680AG (manufactured by Fuji Photo Film Co., Ltd.) filled with a developer and a fixing solution, Photosensitive Materials (1-1) to (1-4), output photosensitive material LS-5500 produced by the same company, dupe paper photosensitive material DU-150WP which is imagewise exposed at a blackened ratio of 30% each was subjected to sensitometry after a 10-day processing of the photosensitive materials at a rate of 100 $m^2$ per day. Photosensitive Materials (1-1), (1-2) and (1-4) were processed at a development temperature of 35° C. and a fixing temperature of 34° C. for a development time of 30 seconds. The other photosensitive material was processed at a development temperature of 38° C. and a fixing temperature of 37° C. for a development time of 20 seconds. The replenishment amount of the developers are shown in Tables 4-1 and 4-2. The fixing solutions each was replenished in an amount of 160 ml/$m^2$. The exposure conditions for each photosensitive material were the same as in Example 1-2.

In Table 4-1, difference of the minimum density (Dmin) from blank and difference of sensitivity at a density of 1.5 ($S_{1.5}$) from blank are shown. The tolerance in practice is 0.03 or less for Dmin difference and within ±0.03 for $S_{1.5}$ difference.

TABLE 4-1

(results in Developer (4-1))

| Compound | Addition Amount (mmol/l) | Amount of Developer replenished (ml/m$^2$) | Dmin Difference DU-150WP | S3.0 Difference Photo-sensitive Material 1–1 | Photo-sensitive Material 1–2 | Photo-sensitive Material 1–3 | Photo-sensitive Material 1–4 | LS-5500 | Remark |
|---|---|---|---|---|---|---|---|---|---|
| 4-I-1 | 1.0 | 160 | 0.01 | 0.02 | 0.01 | 0.01 | 0 | −0.01 | Invention |
| 4-I-3 | 0.08 | 160 | 0 | 0 | 0.01 | 0.01 | 0.01 | 0.01 | Invention |
| 4-I-4 | 1.0 | 160 | 0 | 0.01 | 0 | 0.01 | −0.02 | −0.02 | Invention |
| 4-I-5 | 1.0 | 160 | 0 | 0.01 | 0 | 0.01 | 0.01 | 0.01 | Invention |
| 4-I-6 | 1.0 | 160 | 0 | 0.01 | 0 | 0.01 | −0.01 | 0.01 | Invention |
| 4-I-8 | 1.0 | 160 | 0.2 | −0.02 | 0.01 | −0.01 | 0.01 | 0 | Invention |
| 4-I-16 | 1.0 | 160 | 0.01 | 0.01 | 0.01 | −0.01 | 0.01 | −0.01 | Invention |
| 4-I-33 | 1.0 | 160 | 0.02 | −0.02 | 0.01 | −0.01 | 0.01 | 0.01 | Invention |
| 4-I-3 | 0.008 | 160 | 0 | −0.01 | −0.01 | −0.02 | 0 | 0.02 | Comparison |
| 4-C-1 | 1.0 | 160 | 0.08 | −0.04 | −0.06 | −0.04 | −0.05 | −0.04 | Comparison |
| 4-C-2 | 1.0 | 160 | 0.04 | −0.03 | −0.03 | −0.02 | 0.03 | −0.03 | Comparison |

Comparative Compounds 4-C-1 and 4-C-2 in Table 4-1 had the following structural formulae:

Comparative Compound 4-C-1:

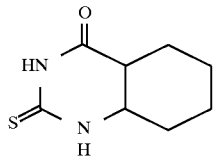

Comparative Compound 4-C-2:

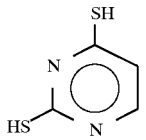

Example 4-2

After processing unexposed Photosensitive Material (3) was processed at a rate of 100 m$^2$ per day for 10 days under the same conditions as in Example 4-1, generation of sludge in the development tank was visually observed. Then, unexposed contact paper photosensitive material KU-150WP (10×12 inches) produced by Fuji Photo Film Co., Ltd. was processed and stains were evaluated. The results obtained are shown in Table 4-2. Samples on the level of 4 or higher have no problem in practice.

TABLE 4-2

| Compound | Addition Amount (mmol/l) | Amount of Developer Replenished (ml/m$^2$) | Silver sludge | Silver Stain | Reduction Inhibition (days) | Remark |
|---|---|---|---|---|---|---|
| 4-I-1 | 1.0 | 160 | 4 | 4 | 19 | Invention |
| 4-I-3 | 0.08 | 160 | 4 | 4 | 20 | Invention |
| 4-I-4 | 1.0 | 160 | 4 | 4.5 | >20 | Invention |
| 4-I-5 | 1.0 | 160 | 5 | 5 | >20 | Invention |
| 4-I-6 | 1.0 | 160 | 5 | 5 | 20 | Invention |
| 4-I-8 | 1.0 | 160 | 4.5 | 4 | >20 | Invention |
| 4-I-16 | 1.0 | 160 | 4.5 | 4.5 | >20 | Invention |
| 4-I-33 | 1.0 | 160 | 4 | 4 | 18 | Invention |

TABLE 4-2-continued

| Compound | Addition Amount (mmol/l) | Amount of Developer Replenished (ml/m$^2$) | Silver sludge | Silver Stain | Reduction Inhibition (days) | Remark |
|---|---|---|---|---|---|---|
| 4-I-3 | 0.008 | 160 | 3.5 | 3 | 10 | Comparison |
| 4-C-1 | 1.0 | 160 | 2.5 | 2.5 | 3 | Comparison |
| 4-C-2 | 1.0 | 160 | 2.5 | 2 | 2 | Comparison |
| Blank | — | 160 | 1 | 1 | <1 | Comparison |
| Blank | — | 390 | 2 | 2 | <1 | Comparison |

Silver sludge
5: no stain in the bottom of the tank and the rack
4: rack discolored slightly
3: rack discolored
2: precipitate was formed at the bottom of the tank and rack discolored
1: great amount of precipitate was formed at the bottom of the tank, solution became turbid and rack also discolored
Level of stain:
5: completely no stain
4: slightly stained but not bad effect in practice
3: edge of paper was stained
2: paper was stained entirely
1: stains were attached throughout the paper surface and processed film
Reduction Inhibition: Days required for silver ion concentration to be reduced to 20 ppm or lower

Example 4-4

The same experiments as in Examples 4-1 and 4-2 were carried out using a solid developer (Developer 4-2) and a solid fixing agent (Fixing Agent (4-2). As a result, the same results as in Examples 4-1 and 4-2 were obtained.

Example 4-5

The same processings as in Examples 4-1 and 4-2 were carried out except for replacing the automatic developing machine with an automatic developing machine FG-680AS produced by Fuji Photo Film Co., Ltd. and changing the developing time to 11 seconds. As a result, the same results as in Examples 4-1 and 4-2 were obtained.

While the invention has been described in detail and with reference to specific embodiments thereof, it will be apparent to one skilled in the art that various changes and modifications can be made therein without departing from the spirit and scope thereof.

What is claimed is:

1. A developer for a black and white silver halide photographic photosensitive material comprising at least one black-and-white developing agent selected from the group consisting of a dihydroxybenzene, an ascorbic acid derivative and a hydroquinone monosulfonate and at least one compound represented by the following formula (3-I):

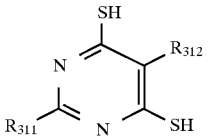

(3-I)

wherein $R_{311}$ and $R_{312}$ each represents a mercapto group or a group capable of substituting to the pyrimidine ring.

2. A developer for a black and white silver halide photographic photosensitive material comprising at least one black-and-white developing agent selected from the group consisting of a dihydroxybenzene, an ascorbic acid derivative and a hydroquinone monosulfonate and at least one compound represented by the following formula (3-II):

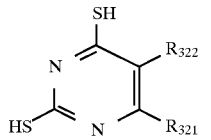

(3-II)

wherein $R_{321}$ represents an aromatic hydrocarbon group, a heterocyclic group, a halogen atom, a cyano group, a nitro group, a sulfo group, a sulfino group, a carboxy group, a phosphono group, an amino group, an ammonio group, a phosphonio group, a mercapto group, an oxy group, a thio group, an acyl group, a carbamoyl group, an acylamino group, a sulfamoyl group, a sulfonamido group, a sulfonyl group, a sulfinyl group, an oxycarbonyl group, a urethane group or a ureido group, and $R_{322}$ represents a group capable of substituting to the pyrimidine ring.

3. A developer for a black and white silver halide photographic photosensitive material comprising at least one black-and-white developing agent selected from the group consisting of a dihydroxybenzene, an ascorbic acid derivative and a hydroquinone monosulfonate and at least one compound represented by the following formula (4):

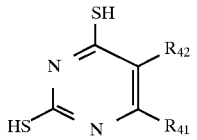

(4)

wherein $R_{41}$ represents a hydrogen atom or an aliphatic group, and $R_{42}$ represents a hydrogen atom or a substituent, with the proviso that when $R_{42}$ represents a hydrogen atom, $R_{41}$ represents an aliphatic group substituted with at least one water-soluble group.

4. The developer of claim 1, wherein $R_{311}$ is an alkyl, aryl, alkylthio, arylthio, alkoxy, alkylamino or arylamino group having at least one water-soluble group selected from the group consisting of a carboxy group (and a salt thereof), a hydroxy group, an amino group, an ammonio group and a sulfo group (and a salt thereof), and wherein $R_{312}$ is a hydrogen atom, an aliphatic hydrocarbon group, a sulfo group, a carboxy group, an amino group or a mercapto group.

5. The developer of claim 2, wherein $R_{321}$ is an alkylthio, arylthio, alkoxy, aryloxy, alkylamino or arylamino group having at least one water-soluble group selected from the group consisting of a carboxy group (and a salt thereof), a hydroxy group, an amino group, an ammonio group and a sulfo group (and a salt thereof), and $R_{322}$ is a hydrogen atom, an aliphatic hydrocarbon group, a sulfo group, a carboxy group or an amino group, or $R_{321}$ is a mercapto group, and $R_{322}$ is an alkyl, alkylthio, arylthio, alkoxy, aryloxy, alkylamino or arylamino group having at least one water-soluble group selected from the group consisting of a carboxy group (and a salt thereof), a hydroxy group, an amino group, an ammonio group and a sulfo group (and a salt thereof).

6. The developer of claim 3, wherein at least one compound of formula (4) is represented by formula (4-2):

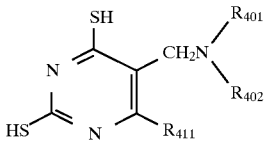

(4-2)

wherein $R_{411}$ is a hydrogen atom or an aliphatic hydrocarbon group, and $R_{401}$ and $R_{402}$ each represents a hydrogen atom, an alkyl group, an aryl group or a heterocyclic group, provided that at least one of $R_{401}$ and $R_{402}$ has at least one water-soluble group selected from the group consisting of a sulfo group (and a salt thereof), a carboxy group (and a salt thereof), a hydroxy group, a mercapto group, an amino group, an ammonio group, a sulfonamido group, an acylsulfamoyl group, a sulfonyl-sulfamoyl group and an active methine group.

7. A method for developing a black-and-white silver halide photographic photosensitive material comprising imagewise exposing a black-and-white silver halide photographic photosensitive material and then processing it with a developer described in any of claims 1 to 3.

8. A method for developing a black-and-white silver halide photographic photosensitive material comprising imagewise exposing a black-and-white silver halide photographic photosensitive material containing a hydrazine derivative and then processing it with a developer described in any of claims 1 to 3 containing 0.3 mol/l or more of sulfite.

* * * * *